US008911055B2

(12) United States Patent
Yamazaki

(10) Patent No.: US 8,911,055 B2
(45) Date of Patent: Dec. 16, 2014

(54) DOT POSITION MEASUREMENT METHOD AND DOT POSITION MEASUREMENT APPARATUS

(75) Inventor: Yoshirou Yamazaki, Kanagawa-ken (JP)

(73) Assignee: FujiFilm Corporation, Tokyo (JP)

( * ) Notice: Subject to any disclaimer, the term of this patent is extended or adjusted under 35 U.S.C. 154(b) by 1077 days.

(21) Appl. No.: 12/900,118

(22) Filed: Oct. 7, 2010

(65) Prior Publication Data

US 2011/0085184 A1 Apr. 14, 2011

(30) Foreign Application Priority Data

Oct. 8, 2009 (JP) ..... 2009-234632

(51) Int. Cl.
*B41J 29/28* (2006.01)
*B41J 29/393* (2006.01)
*B41J 2/21* (2006.01)

(52) U.S. Cl.
CPC ..... *B41J 29/393* (2013.01); *B41J 2/2146* (2013.01)
USPC ..... 347/19; 347/9; 347/14; 347/78

(58) Field of Classification Search
CPC ..... B41J 29/38
See application file for complete search history.

(56) References Cited

U.S. PATENT DOCUMENTS

| | | | | |
|---|---|---|---|---|
| 7,190,488 | B2 * | 3/2007 | Goto | 358/1.9 |
| 8,139,269 | B2 * | 3/2012 | Goto et al. | 358/3.27 |
| 8,167,412 | B2 * | 5/2012 | Yamazaki | 347/78 |
| 8,462,381 | B2 * | 6/2013 | Yamazaki | 358/1.5 |
| 8,472,069 | B2 * | 6/2013 | Yamazaki | 358/1.5 |
| 2008/0253607 | A1 | 10/2008 | Miyamoto et al. | |
| 2008/0309703 | A1 * | 12/2008 | Yamazaki | 347/19 |
| 2010/0238223 | A1 * | 9/2010 | Yamazaki | 347/14 |

FOREIGN PATENT DOCUMENTS

| | | |
|---|---|---|
| JP | 2008-44273 A | 2/2008 |
| JP | 2008-80630 A | 4/2008 |

* cited by examiner

*Primary Examiner* — Manish S Shah
*Assistant Examiner* — Jeremy Delozier
(74) *Attorney, Agent, or Firm* — Birch, Stewart, Kolasch & Birch, LLP

(57) ABSTRACT

A dot position measurement method and a dot position measurement apparatus provide a plurality of common line blocks and averaging measurement values of positions of lines in each common line blocks when correcting the measurement positions in each line block by taking a common line block (reference line block) as a reference position, and it is possible to reduce effects of random positional variation in a main scanning direction of an image reading apparatus.

10 Claims, 46 Drawing Sheets

VARIATION FOR EACH SCAN

DOT POSITION MEASUREMENT METHOD AND DOT POSITION MEASUREMENT APPARATUS

BACKGROUND OF THE INVENTION

1. Field of the Invention

The present invention relates to a dot position measurement method and a dot position measurement apparatus, and more particularly to a dot position measurement method and a dot position measurement apparatus suitable for measurement of a deposition position of a dot recorded by each nozzle of an inkjet head.

2. Description of the Related Art

One method of recording an image onto a recording medium such as recording paper is an inkjet drawing method in which an image is recorded by ejecting ink droplets in response to an image signal and depositing the ink droplets on the recording medium. As an image forming apparatus which employs such an inkjet drawing system, there exists a full-line head image drawing apparatus, in which recording elements (e.g., ejection units and nozzles) which eject ink droplets are disposed in a line facing the whole of one side of the recording medium, and the recording medium is conveyed in a direction orthogonal to the line of the ejection units so as to record an image over the whole area of the recording medium. By conveying the recording medium without moving the ejection units, the full-line head image drawing apparatus is able to draw an image over the whole area of the recording medium and increase the recording speed.

However, with line-head image forming apparatuses, there is the problem that streaks or unevenness of the image recorded on the recording medium occurs due to inconsistencies during production such as displacement of the ejection units. Such streaks and unevenness are caused by scatter of the ink droplet deposition position, and techniques to correct streaks and unevenness, based on the deposition position, are known.

Japanese Patent Application Publication No. 2008-044273 discloses a technology whereby a line pattern and, at the same time, a reference pattern are read with a scanner, and the deposition position is measured while correcting any scanner conveyance errors.

Japanese Patent Application Publication No. 2008-080630 discloses a technology which reads a line pattern with a scanner to determine the edge position of a line from the read image, and measure the line position (deposition position) from a plurality of edge positions for each line.

In recent years, as paper widths have grown larger and higher line-head densities have been developed, the number of nozzles, which are used for measuring the positions of ink liquid droplets, to be measured has reached the tens of thousands or more. For example, a recording width of eleven inches at a resolution of 1200 DPI requires 13200 nozzles per ink, and for the four inks of the CMYK color model, there are a total of 52800 nozzles. A print head with such a large number of nozzles requires a high-speed, high-accuracy, and low-cost deposition position measurement method.

More specifically, taking a 1200-DPI image drawing apparatus as an example, the recording lattice pitch for 1200 DPI is 21.17 μm, and a dot diameter equal to or more than $21.17\times\sqrt{2}$ is required to deposit dots without any gaps, and therefore a dot diameter of approximately 30 to 40 μm is required.

4800 DPI is about the upper limit for commercial scanners, even for high-resolution scanners, and, at this resolution, the reading lattice pitch of the scanner is approximately 5.29 μm. In comparison with the dot diameter, the deposition position must be found from as many as 6 to 8 pixels. These figures are cut in half for 2400 DPI. Although higher resolutions are desirable for reading devices (scanners) in order to improve deposition position accuracy, higher reading device resolutions cause (1) problems with the size of read image data, and (2) the problem that reading is not completed in a single pass.

Suppose, for example, that, for a reading resolution of 4800 DPI, the size of the deposition position precision measurement sample is A3-size, the A3 reading range is then 11.5 inches×15.5 inches, which means that, for a color image, the total data amount of the read image, for the 8 bits on each of the three RGB channels, is 12.3 GB. The reading resolution is 3.08 GB even for 2400 DPI. Such a large volume of data is time-consuming even when the data is written to a hard disk device (HDD).

On the other hand, commercial scanners are inexpensive compared to microscope type scanners and moving stage type scanners, and also have a benefit of being able to read an image of large surface area at high speed. However, with current commercial scanners, there are limits on the possible reading range (area) at the highest resolutions (for example, 4800 DPI with an A4 scanner and 2400 DPI with an A3 scanner) and therefore it is not possible to read the range of a read object in a single operation. Therefore, it is necessary to divide the range of the read object into strip-shaped regions and to perform a plurality of reading actions.

If one image is read in a plurality of reading actions in this way, then time is required for the initial operation of the scanner in each reading action (e.g., the time for correcting brightness and the moving time to the designated reading position). In general, in order to ensure consistency between the data corresponding to the divided reading regions, it is necessary to provide overlapping regions between the mutually adjacent reading regions. In other words, the volume of the overlapping regions is additionally required in the image data, and the reading time also becomes longer in accordance with the overlapping regions. In general, the ratio of the overlapping regions with respect to the reading regions becomes larger, as the number of divisions of the whole reading region increases. Even if measures are adopted to reduce the volume of image data and reduce the processing and data writing time, dividing up the image still creates problems in terms of increase in the volume of image data and increase in the reading time.

The technologies disclosed in Japanese Patent Application Publication Nos. 2008-044273 and 2008-080630 are faced by the problem that, because the main and sub-scanning resolutions during reading are the same, when these technologies are used, an image cannot be read all at once, or the processing time is long due to the large size of the image to be processed.

Further, many commercial scanners repeat operations of reading and data transfer, rather than reading in the whole of the reading range at a uniform speed. In this case, it is possible that the reading operation is interrupted and the carriage is halted, whereupon the carriage is moved again. If a dot deposition position accuracy of approximately 10 μm is expected, the position displacement due to the carriage restarting may be ignored, but when measurement accuracy is determined at the sub-micron level, then positional variation caused by this restarting of the carriage gives rise to error which cannot be ignored.

Furthermore, if the measurement object is long in the sub-scanning direction (this varies depending on the model of scanner, but as a general benchmark, 10 cm or longer, for instance), then positional variation caused by fluctuation in the carriage of the scanning mechanism also gives rise to error. Error of this kind is particular marked in the case of measuring a line pattern in which lines of dots deposited by mutually adjacent nozzles are arranged at different positions in the sub-scanning direction as shown in FIG. 45, which illustrates an example of a dot position measurement line pattern in the related art.

If the nozzle numbers are taken to be 0, 1, 2, 3, and so on, in sequence from the end of the line head, then the line block 0 shown in FIG. 45 is a block of a group of lines 92 formed by nozzles having nozzle numbers of "4N+0" (where N is an integer equal to or greater than j), such as the nozzle numbers 0, 4, 8, . . . . The line block 1 is a line block formed by nozzles having nozzle numbers of "4N+1", such as the nozzle numbers 1, 5, 9, . . . . The line block 2 is a line block formed by nozzles having nozzle numbers of "4N+2", and the line block 3 is a line block formed by nozzles having nozzle numbers of "4N+3". It is possible to form lines corresponding to all of the nozzles by means of a line pattern in which the line blocks of lines spaced apart by a uniform nozzle interval are arranged at different positions on the recording paper 16.

FIG. 46 is a chart showing the relationship between the measurement positions for different sub-scanning positions of a scanner, in the related art. As shown in FIG. 46, the measurement positions when measuring the respective line positions of line blocks A and B, which are arranged at different positions in the sub-scanning direction, have a linear relationship. Error caused by the scanner such as that described above is expressed as disruption of the grid coordinates read in by the scanner.

FIG. 47 is a chart showing results of measuring position (dot position) errors in each line from a line pattern in which line blocks spaced at an interval of 16 nozzles apart are arranged at different positions in the sub-scanning direction, in the related art, instead of the line blocks spaced at the interval of 4 nozzles apart as shown in FIG. 45.

Although errors corresponding to the respective nozzle positions ought to be originally random, regular positional error having a period of 16 nozzles occurs in the overall line pattern in practice, as shown in FIG. 47. This is because each line block in a different position in the sub-scanning direction includes offset-type positional error.

Thus, even if measurement accuracy is achieved in respect of the data within each of the line blocks which are divided into a plurality of line blocks in the sub-scanning direction, a certain offset error occurs in the measurement accuracy between respective line blocks, and therefore a phenomenon occurs whereby the measurement results repeat a similar shape at a period equal to the number of line blocks.

Error of approximately 2 to 3 μm is generally not a problem in relation to the resolution of the scanner (for example, 2400 dpi); however, if the objective is measurement at the sub-micron order, then divergence of this kind cannot be ignored and becomes problematic when the measurement results for a plurality of line blocks are merged together.

Moreover, apart from error caused by the scanner, a similar phenomenon also occurs in relation to deformation of the paper. For example, in a printing apparatus which ejects and deposits droplets of ink on a recording paper after applying a treatment liquid to the recording paper, error occurs due to variation in the elongation of the recording paper between the printing start position and the printing end position. In the measurement of dot deposition positions after deformation of the paper, the offset error and the extension error in the line spacing are compounded together.

Furthermore, FIG. 48 shows a chart in which equally spaced lines are read in by a scanner and the read line spacing is plotted for each main scanning position, in the related art. Although the line spacing is ideally constant, the line spacing is actually changed in the main scanning direction since there is positional distortion in the main scanning direction of the scanner. This positional distortion in the main scanning direction tends to vary with the sub-scanning position.

In FIG. 48, the sub-scanning position 1, the sub-scanning position 2 and the sub-scanning position 3 are respectively different sub-scanning positions and indicate results of reading in sub-scanning direction lines which are arranged at equal spacing in the main scanning direction. Since the positional distortion characteristics in the main scanning direction vary depending on the sub-scanning position, then these characteristics tend to be different.

FIG. 49 is a chart plotting the difference in the line spacing between the sub-scanning position 2 and the sub-scanning position 3, with reference to the sub-scanning position 1, in the related art. The characteristics of the positional distortion in the main scanning direction at the sub-scanning position 2 and the sub-scanning position 3 with respect to the sub-scanning position 1 are such that the line spacing tends to become shorter towards a central position in the main scanning direction. The characteristics of the positional distortion in the main scanning direction at the sub-scanning positions 2 and 3 show tendencies very different from each other in the vicinity of a 250 mm position in the main scanning direction.

As described above, in a scanner apparatus that has distortion in the main scanning direction, distortion occurs in the positions determined on the basis of the grid positions of the image read by the scanner. If this distortion has a tendency to vary with the sub-scanning position, then it is necessary to have two-dimensional parameters (in the main scanning direction and the sub-scanning direction) as parameters for correcting the distortion. In order to obtain such two-dimensional parameters, a scale which is accurate in the two dimensions is required. A two-dimensional scale of this kind is extremely expensive and difficult to handle, and in general, in order to compensate for the measurement accuracy, it is necessary to save the correction parameters periodically, and therefore the cost involved in measurement and saving parameters becomes very high indeed.

In respect of the above-described problems, Japanese Patent Application Publication Nos. 2008-044273 and 2008-080630 do not teach or suggest technology for correcting disturbance of image data read out by a scanner.

SUMMARY OF THE INVENTION

The present invention has been contrived in view of these circumstances, an object thereof being to provide a dot position measurement method and a dot position measurement apparatus, whereby the effects of variation in the image reading device (scanner) carriage, optical distortion, deformation of the recording medium, and the like are reduced so that dot positions can be measured with high accuracy and high robustness can be attained.

In order to attain the aforementioned object, the present invention is directed to a dot position measurement method comprising: a line pattern forming step of forming a measurement line pattern including a plurality of lines of rows of dots corresponding to a plurality of recording elements arranged in a first direction of a recording head respectively, on a recording medium, while causing relative movement between the recording head and the recording medium in a second direction perpendicular to the first direction, the measurement line pattern including a plurality of line blocks each including a group of the lines recorded by the recording elements spaced at a prescribed interval in the first direction, and a plurality of common line blocks each including the lines recorded by the recording elements which are same as the recording elements recording the lines included in the plurality of line blocks respectively; a reading step of reading an image of the measurement line pattern formed on the recording medium in the line pattern forming step, by an image reading apparatus; a line position measurement step of measuring positions of the lines included in the plurality of line blocks and the plurality of common line blocks, from the image of the measurement line pattern read by the image reading apparatus; an averaging step of determining average values of measurement values of positions of the lines recorded by the same recording elements among the plurality of common line blocks; and a line position correction step of correcting the measurement values of the positions of the lines according to the average values.

Desirably, the dot position measurement method further comprises: a characteristic value calculation step of calculating a characteristic value obtained by averaging the measurement values of the position of a second line recorded by a second recording element which is adjacent to a first recording element used to record a first line which is included in each of the plurality of common line blocks; and a step of line position correction within a common line block, the step correcting the measurement values of the position of the first line according to the characteristic value, wherein, in the averaging step, the average values of the measurement values which have been corrected in the step of line position correction within common line block are determined.

Desirably, the dot position measurement method further comprises a distortion correction step of correcting distortion in terms of a main scanning direction of a fixed positional of the image read by the image reading apparatus.

Desirably, the dot position measurement method further comprises: a positional distortion correction function specification step of specifying a positional distortion correction function for the image reading apparatus according to the measurement values of the positions of the lines which have been corrected in the line position correction step; and a positional distortion correction step of further correcting the measurement values of the positions of lines which have been corrected in the line position correction step, according to the specified positional distortion correction function.

Desirably, a fixed positional distortion correction table for correcting positional distortion characteristics of the image reading apparatus is created in advance; the dot position measurement method further comprises a fixed positional distortion correction step of further correcting the measurement values of the positions of the lines which have been corrected in the line position correction step according to the fixed positional distortion correction table, or correcting data of the positions of the lines before correction in the line position correction step according to the fixed positional distortion correction table.

In order to attain an object described above, another aspect of the present invention is directed to a dot position measurement apparatus comprising: an image reading apparatus reading an image of a measurement line pattern including a plurality of lines of rows of dots which are formed on a recording medium by an image forming apparatus and which corresponds to respective recording elements of a recording head arranged in a first direction while relative movement between the recording head and the recording medium is caused in a second direction perpendicular to the first direction, the measurement line pattern including a plurality of line blocks each including a group of the lines recorded by the recording elements spaced at a prescribed interval in the first direction, and a plurality of common line blocks each including the lines recorded by the recording elements which are same as the recording elements recording the lines included in the plurality of line blocks respectively; a line position measurement device which measures positions of the lines included in the plurality of line blocks and the plurality of common line blocks, from the image of the measurement line pattern read by the image reading apparatus; an averaging device which determines average values of measurement values of positions of the lines recorded by the same recording elements among the plurality of common line blocks; and a line position correction device which corrects the measurement values of the positions of the lines according to the average values.

Desirably, the dot position measurement apparatus further comprises: a characteristic value calculation device which calculates a characteristic value obtained by averaging the measurement values of the position of a second line recorded by a second recording element which is adjacent to a first recording element used to record a first line which is included in each of the plurality of common line blocks; and a correction device of a line position within a common line block, the correction device correcting the measurement values of the position of the first line according to the characteristic value, wherein the averaging device determines the average values of the measurement values which have been corrected by the correction device of a line position within a common line block.

Desirably, the dot position measurement apparatus further comprises a distortion correction device which corrects distortion in terms of a main scanning direction of a fixed positional of an image read by the image reading apparatus.

Desirably, the dot position measurement apparatus further comprises: a positional distortion correction function specification device which specifies a positional distortion correction function for the image reading apparatus according to the measurement values of the positions of the lines which have been corrected by the line position correction device; and a positional distortion correction device which further corrects the measurement values of the positions of the lines which have been corrected by the line position correction device, according to the specified positional distortion correction function.

Desirably, a fixed positional distortion correction table for correcting positional distortion characteristics of the image reading apparatus is created in advance; the dot position measurement apparatus further comprises a fixed positional distortion correction device which further corrects the measurement values of the positions of the lines which have been corrected by the line position correction device according to the fixed positional distortion correction table, or correcting data of the positions of the lines before correction by the line position correction device according to the fixed positional distortion correction table.

According to the present invention, by providing a plurality of common line blocks and averaging the measurement values of the positions of lines in each common line blocks when correcting the measurement positions in each line block by taking a common line block (reference line block) as a reference position, then it is possible to reduce the effects of random positional variation in the main scanning direction of an image reading apparatus.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Here, an example of the application to the measurement of the dot deposition positions (that is, dot positions) by an image forming apparatus (inkjet recording apparatus) is described. Firstly, the overall composition of an inkjet recording apparatus will be described.

Description of Inkjet Recording Apparatus

Figure 1:
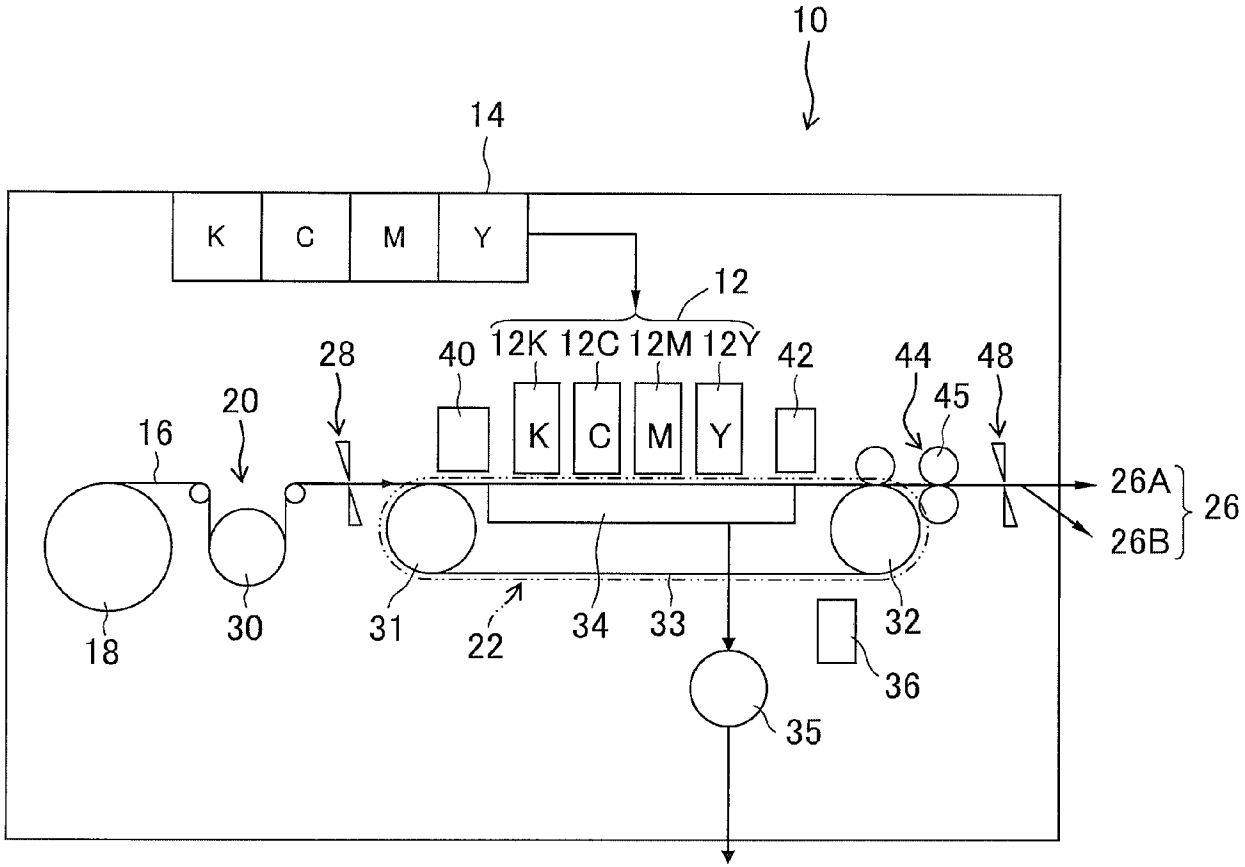
FIG. 1 is a general schematic drawing of an inkjet recording apparatus according to one embodiment of the present invention.

FIG. 1 is a general schematic drawing of an inkjet recording apparatus related to one embodiment of the invention.

As illustrated in FIG. 1, the inkjet recording apparatus 10 includes: a print unit 12 having a plurality of inkjet recording heads (corresponding to "liquid ejection heads", hereinafter referred to as "heads") 12K, 12C, 12M and 12Y provided for ink colors of black (K), cyan (C), magenta (M), and yellow (Y), respectively; an ink storing and loading unit 14 for storing inks to be supplied to the heads 12K, 12C, 12M and 12Y; a paper supply unit 18 for supplying recording paper 16 forming a recording medium; a decurling unit 20 for removing curl in the recording paper 16; a belt conveyance unit 22, disposed facing the nozzle face (ink ejection face) of the print unit 12, for conveying the recording paper 16 while keeping the recording paper 16 flat; and a paper output unit 26 for outputting recorded recording paper (printed matter) to the exterior.

The ink storing and loading unit 14 has ink tanks for storing the inks of each color to be supplied to the heads 12K, 12C, 12M, and 12Y, respectively, and the tanks are connected to the heads 12K, 12C, 12M, and 12Y by means of prescribed channels.

In FIG. 1, a magazine for rolled paper (continuous paper) is illustrated as an example of the paper supply unit 18; however, a plurality of magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (media) can be used, it is desirable that a device for identifying the type of recording medium to be used (type of medium) is provided, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is desirably controlled so that the recording paper 16 has a curl in which the surface on which the print is to be made is slightly round outward.

The decurled recording paper 16 is cut by a cutter (first cutter) 28 into a desired size, and is delivered to the belt conveyance unit 22. The belt conveyance unit 22 has a configuration in which an endless belt 33 is set around rollers 31 and 32 so that the portion of the endless belt 33 facing at least the nozzle face of the print unit 12 forms a horizontal plane (flat plane).

The belt 33 has a width that is greater than the width of the recording paper 16, and a plurality of suction apertures (not illustrated) are formed on the belt surface. A suction chamber 34 is disposed in a position facing the nozzle surface of the print unit 12 on the interior side of the belt 33, which is set around the rollers 31 and 32. The suction chamber 34 provides suction with a fan 35 to generate a negative pressure, and the recording paper 16 is held on the belt 33 by suction. It is also possible to use an electrostatic attraction method, instead of a suction-based attraction method.

The belt 33 is driven in the clockwise direction in FIG. 1 by the motive force of a motor 88 (illustrated in FIG. 6) being transmitted to at least one of the rollers 31 and 32, and the recording paper 16 held on the belt 33 is conveyed from left to right in FIG. 1.

A belt-cleaning unit 36 is disposed in a predetermined position (a suitable position outside the printing area) on the exterior side of the belt 33. Although the details of the configuration of the belt-cleaning unit 36 are not illustrated, examples thereof include a configuration of nipping with a brush roller and a water absorbent roller or the like, an air blow configuration of blowing clean air, or a combination of these.

A heating fan 40 is disposed on the upstream side of the print unit 12 in the conveyance pathway formed by the belt conveyance unit 22. The heating fan 40 blows heated air onto the recording paper 16 to heat the recording paper 16 immediately before printing so that the ink deposited on the recording paper 16 dries more easily.

Figure 2A:
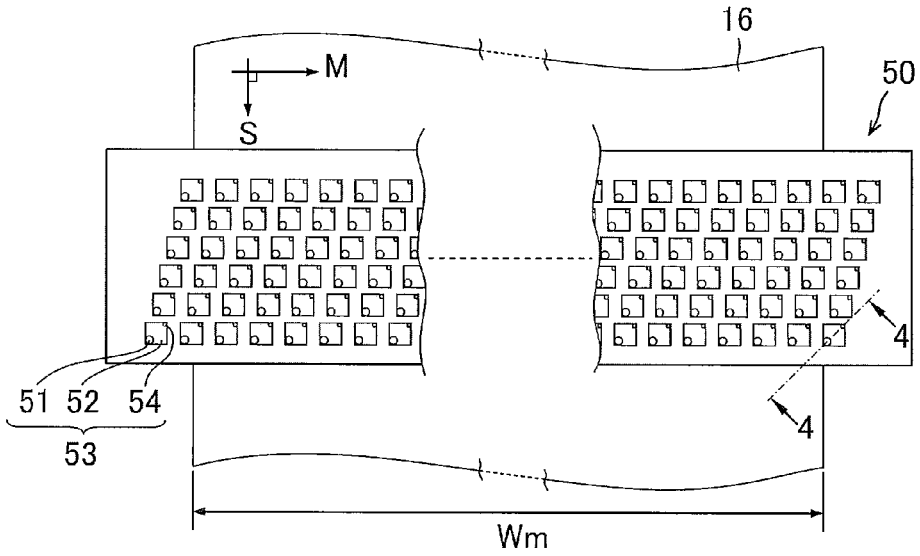
FIG. 2A is a plan view perspective diagram illustrating an example of the structure of a head.
Figure 2B:
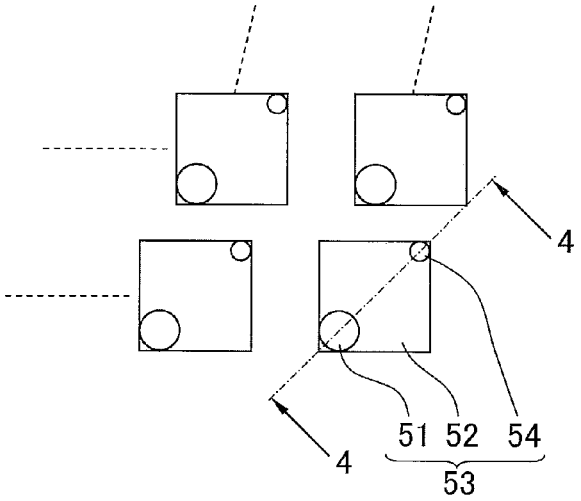
FIG. 2B is a partial enlarged diagram of FIG. 2A.

The heads 12K, 12C, 12M and 12Y of the print unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIGS. 2A and 2B).

The print heads 12K, 12C, 12M and 12Y are arranged in color order (black (K), cyan (C), magenta (M), yellow (Y)) from the upstream side in the feed direction of the recording paper 16, and the respective heads 12K, 12C, 12M and 12Y are arranged to extend along a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the print unit 12 in the paper conveyance direction (the sub-scanning direction), in other words, by means of a single sub-scanning action. It is possible for the image formation based on a single-pass system with such a full-line type (page-wide type) head to perform high speed printing, compared to the image formation based on a multi-pass system with a serial (shuttle) head reciprocating in a direction (main scanning direction) perpendicular to the conveyance direction (sub-scanning direction) of a recording medium, thereby improving printing productivity.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

A post-drying unit 42 is disposed following the print unit 12. The post-drying unit 42 is a device to dry the printed image surface, and includes a heating fan, for example. It is desirable to avoid contact with the printed surface until the printed ink dries, and a device that blows heated air onto the printed surface is desirable.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are desirably outputted separately. In the inkjet recording apparatus 10, a sorting device (not illustrated) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48.

Although not illustrated in FIG. 1, the paper output unit 26A for the target prints is provided with a sorter for collecting prints according to print orders. Moreover, the inkjet recording apparatus 10 is also provided with: a head maintenance unit for cleaning the heads 12K, 12C, 12M and 12Y (e.g., wiping of the nozzle surface, purging, and suction for the nozzles); sensors for determining the position of the recording paper 16 in the medium conveyance path, and the like; and temperature sensors for measuring temperature in the respective parts of the inkjet recording apparatus 10.

Structure of the Head

Next, the structure of a head will be described. The heads 12K, 12C, 12M and 12Y of the respective ink colors have the same structure, and a reference numeral 50 is hereinafter designated to any of the heads.

Figure 3:
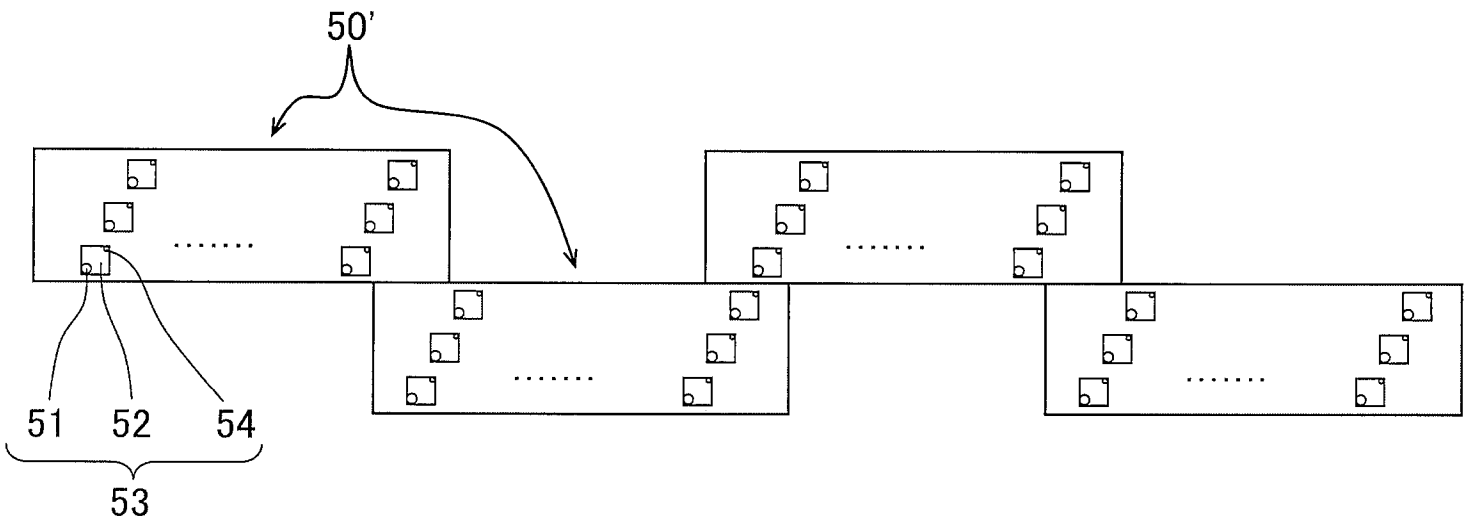
FIG. 3 is a plan view perspective diagram illustrating another example of the composition of a head.
Figure 4:
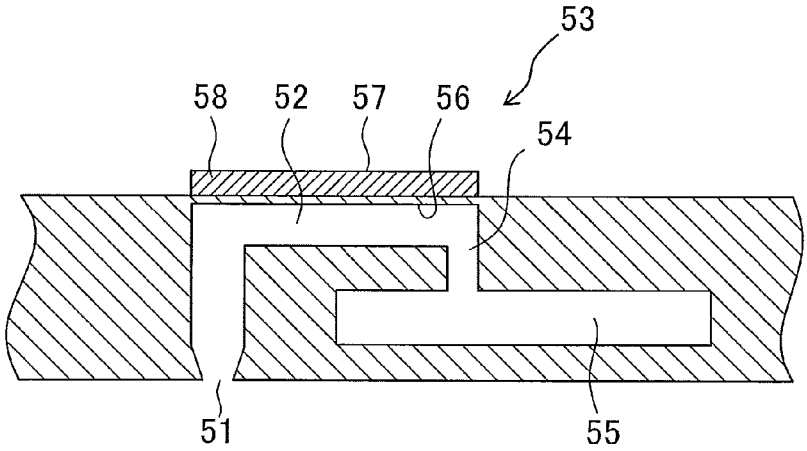
FIG. 4 is a cross-sectional diagram showing the composition of one droplet ejection element which is a unit recording element (an ink chamber unit corresponding to one nozzle) (namely, a cross-sectional diagram along line 4-4 in FIGS. 2A and 2B)

FIG. 2A is a plan view perspective diagram illustrating an example of the structure of a head 50, and FIG. 2B is an enlarged diagram of a portion of same. Furthermore, FIG. 3 is a plan view perspective diagram (a cross-sectional view along the line 4-4 in FIGS. 2A and 2B) illustrating another example of the structure of the head 50, and FIG. 4 is a cross-sectional diagram illustrating the composition of a liquid droplet ejection element corresponding to one which forms a unit recording element (namely, an ink chamber unit corresponding to one nozzle 51).

As illustrated in FIGS. 2A and 2B, the head 50 according to the present embodiment has a structure in which a plurality of ink chamber units (droplet ejection elements) 53, each comprising a nozzle 51 forming an ink ejection port, a pressure chamber 52 corresponding to the nozzle 51, and the like, are disposed two-dimensionally in the form of a staggered matrix, and hence the effective nozzle interval (the projected nozzle pitch) as projected (orthogonal projection) in the lengthwise direction of the head (the direction perpendicular to the paper conveyance direction) is reduced and high nozzle density is achieved.

The mode of forming nozzle rows with a length not less than a length corresponding to the entire width Wm of the recording paper 16 in a direction (the direction of arrow M; main-scanning direction) substantially perpendicular to the conveyance direction (the direction of arrow S; sub-scanning direction) of the recording paper 16 is not limited to the example described above. For example, instead of the configuration in FIG. 2A, as illustrated in FIG. 3, a line head having nozzle rows of a length corresponding to the entire width of the recording paper 16 can be formed by arranging and combining, in a staggered matrix, short head modules 50' having a plurality of nozzles 51 arrayed in a two-dimensional fashion.

As illustrated in FIGS. 2A and 2B, the planar shape of the pressure chamber 51 provided corresponding to each nozzle 52 is substantially a square shape, and an outlet port to the nozzle 51 is provided at one of the ends of a diagonal line of the planar shape, while an inlet port (supply port) 54 for supplying ink is provided at the other end thereof. The shape of the pressure chamber 52 is not limited to that of the present example and various modes are possible in which the planar shape is a quadrilateral shape (rhomb shape, rectangular shape, or the like), a pentagonal shape, a hexagonal shape, or other polygonal shape, or a circular shape, elliptical shape, or the like.

As illustrated in FIG. 4, each pressure chamber 52 is connected to a common channel 55 through the supply port 54. The common channel 55 is connected to an ink tank (not shown), which is a base tank that supplies ink, and the ink supplied from the ink tank is delivered through the common flow channel 55 to the pressure chambers 52.

An actuator 58 provided with an individual electrode 57 is bonded to a pressure plate (a diaphragm that also serves as a common electrode) 56 which forms the surface of one portion (in FIG. 4, the ceiling) of the pressure chambers 52. When a drive voltage is applied to the individual electrode 57 and the common electrode, the actuator 58 deforms, thereby changing the volume of the pressure chamber 52. This causes a pressure change which results in ink being ejected from the nozzle 51. For the actuator 58, it is possible to adopt a piezoelectric element using a piezoelectric body, such as lead zirconate titanate, barium titanate, or the like. When the displacement of the actuator 58 returns to its original position after ejecting ink, the pressure chamber 52 is replenished with new ink from the common channel 55 via the supply port 54.

By controlling the driving of the actuators 58 corresponding to the nozzles 51 in accordance with the dot arrangement data generated from the input image, it is possible to eject ink droplets from the nozzles 51. By controlling the ink ejection timing of the nozzles 51 in accordance with the speed of conveyance of the recording paper 16, while conveying the recording paper in the sub-scanning direction at a uniform speed, it is possible to record a desired image on the recording paper 16.

Figure 5:
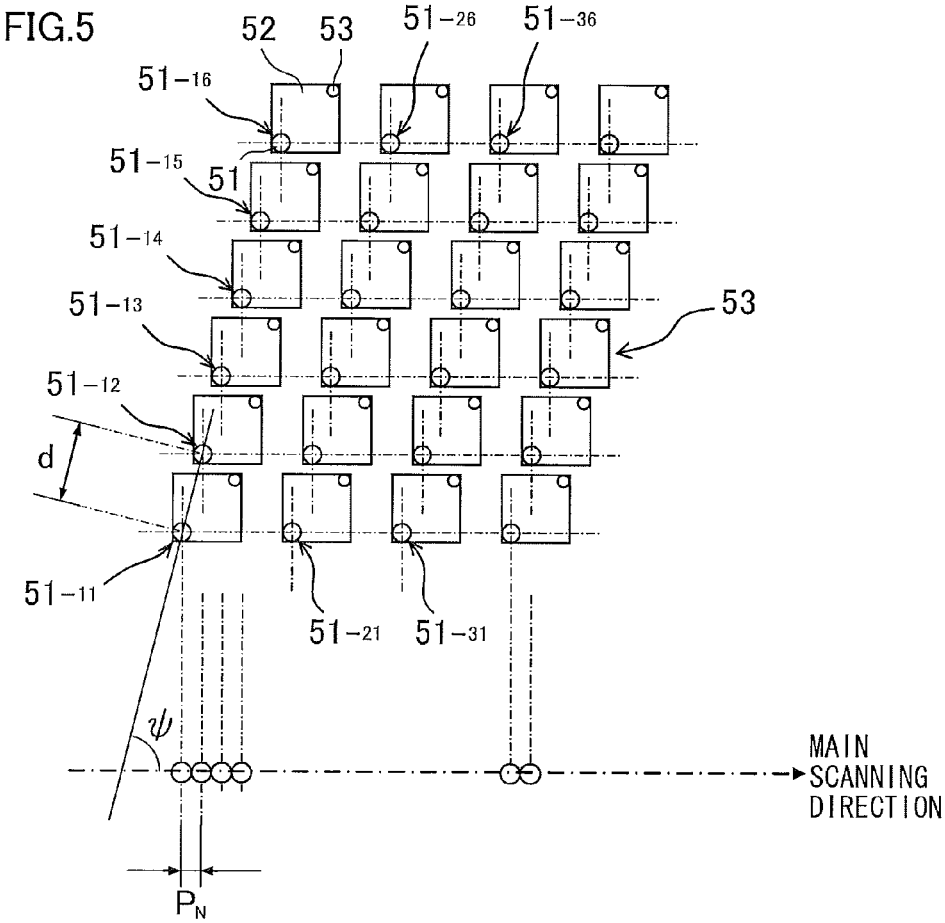
FIG. 5 is an enlarged diagram illustrating an example of the arrangement of nozzles in a head.

As illustrated in FIG. 5, the high-density nozzle head according to the present embodiment is achieved by arranging obliquely a plurality of ink chamber units 53 having the above-described structure in a lattice fashion based on a fixed arrangement pattern, in a row direction which coincides with the main scanning direction, and a column direction which is inclined at a fixed angle of $\psi$ with respect to the main scanning direction, rather than being perpendicular to the main scanning direction. More specifically, by adopting a structure in which a plurality of ink chamber units 53 are arranged at a uniform pitch d in line with a direction forming an angle of ψ with respect to the main scanning direction, the nozzles 51 can be regarded to be substantially equivalent to those arranged linearly at a fixed pitch $P_N$=d×cos ψ along the main scanning direction.

When the nozzles 51 arranged in a matrix such as that illustrated in FIG. 5 are driven, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line (a line formed of a row of dots, or a line formed of a plurality of rows of dots) is printed in the width direction of the recording paper 16 (the direction perpendicular to the conveyance direction of the recording paper) by sequentially driving the nozzles from one end toward the other end in each block (sequentially driving the nozzles 51-11, 51-12, . . . , 51-16) in accordance with the conveyance velocity of the recording paper 16.

The direction along the one line (or the lengthwise direction of a band-shaped region) printed by such the nozzle driving (main scanning) is referred to as the "main scanning direction", and it is referred to as the "sub-scanning" to perform printing of one line (a line formed of a row of dots, or a line formed of a plurality of rows of dots) formed by the main scanning, while moving the head and the recording paper 16 relatively to each other, repeatedly in the relative moving direction. In other words, in the present embodiment, the conveyance direction of the recording paper 16 is the sub-scanning direction, and the direction perpendicular to the sub-scanning direction is the main scanning direction.

The present embodiment applies the piezoelectric elements as ejection power generation devices to eject the ink from the nozzles 51 arranged in the head 50; however, the devices for generating pressure for ejection (ejection energy) are not limited to the piezoelectric elements, and it is possible to employ various devices and systems, such as actuators operated by heaters (heating elements) based on a thermal method, or actuators using another method.

In implementing the present invention, the mode of arrangement of the nozzles 51 in the head 250 is not limited to the examples shown in the drawings, and various difference nozzle arrangement structures can be employed. For example, instead of a matrix arrangement as described in FIGS. 2A and 2B, it is also possible to use a single linear arrangement, a V-shaped nozzle arrangement, or an undulating nozzle arrangement, such as zigzag configuration (W-shape arrangement), which repeats units of V-shaped nozzle arrangements.

Description of Control System

Figure 6:
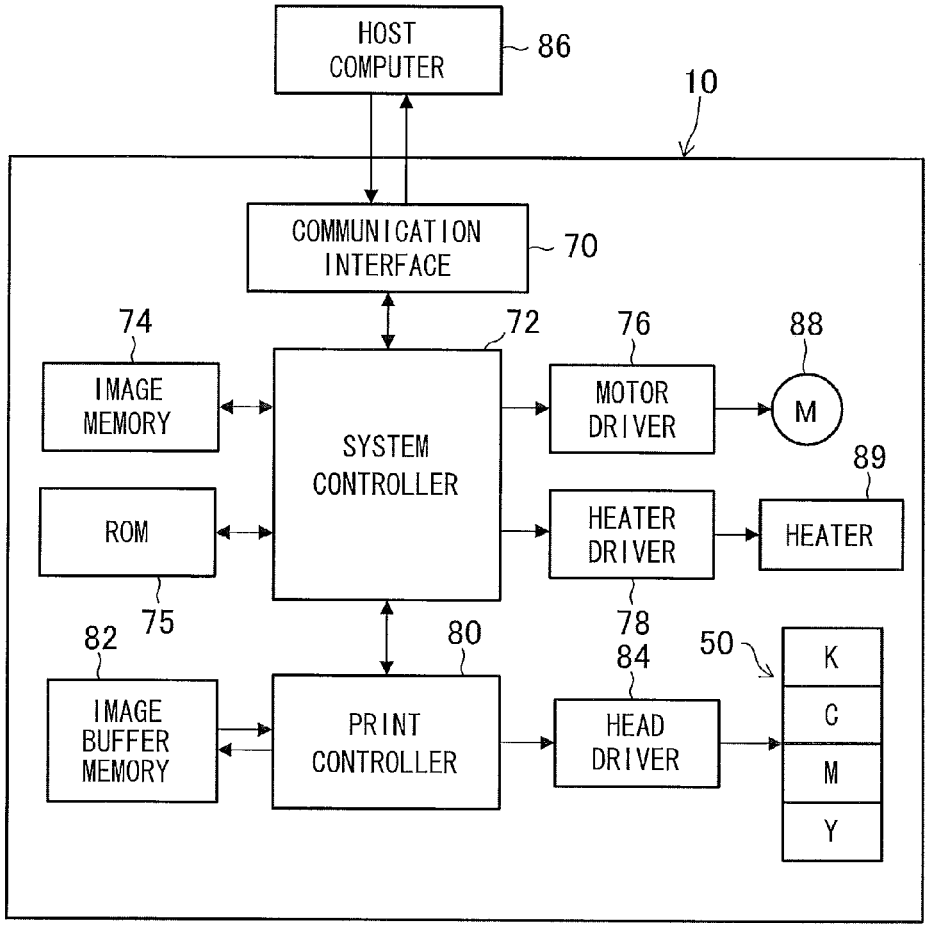
FIG. 6 is a block diagram illustrating a system composition of the inkjet recording apparatus.

FIG. 6 is a block diagram illustrating the system configuration of the inkjet recording apparatus 10.

As illustrated in FIG. 6, the inkjet recording apparatus 10 includes: a communication interface 70, a system controller 72, an image memory 74, a ROM 75, a motor driver 76, a heater driver 78, a print controller 80, an image buffer memory 82, a head driver 84, and the like.

The communication interface 70 is an interface unit (image input unit) for receiving image data sent from a host computer 86. A serial interface such as USB (Universal Serial Bus), IEEE1394, Ethernet (registered trademark), wireless network, or a parallel interface such as a Centronics interface may be used as the communication interface 70. A buffer memory (not illustrated) may be mounted in this portion in order to increase the communication speed.

The image data sent from the host computer 86 is received by the inkjet recording apparatus 10 through the communication interface 70, and is stored temporarily in the image memory 74. The image memory 74 is a storage device for storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74 and ROM 75, and it also generates control signals for controlling the motor 88 of the conveyance system and heater 89.

Programs executed by the CPU of the system controller 72 and the various types of data which are required for control procedures are stored in the ROM 75. The ROM 75 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 of the conveyance system in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data (original image data) stored in the image memory 74 in accordance with commands from the system controller 72 so as to supply the generated print data (dot data) to the head driver 84.

The print controller 80 is provided with the image buffer memory 82; and image data, parameters, and other data are temporarily stored in the image buffer memory 82 when image data is processed in the print controller 80. The aspect illustrated in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

To give a general description of the sequence of processing from image input to print output, image data to be printed (original image data) is input from an external source via a communication interface 70, and is accumulated in the image memory 74. At this stage, RGB image data is stored in the image memory 74, for example.

In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the image memory 74 is sent to the print controller 80 through the system controller 72, and is converted to the dot data for each ink color by a half-toning technique, using a threshold value matrix, error diffusion, or the like, in the print controller 80.

In other words, the print controller 80 performs processing for converting the input RGB image data into dot data for the four colors of K, C, M and Y. The dot data generated by the print controller 180 in this way is stored in the image buffer memory 82.

The head driver 84 outputs a drive signal for driving the actuators 58 corresponding to the nozzles 51 of the head 50, on the basis of print data (in other words, dot data stored in the image buffer memory 82) supplied by the print controller 80. A feedback control system for maintaining constant drive conditions in the head may be included in the head driver 84.

By supplying the drive signal output by the head driver 84 to the head 50, ink is ejected from the corresponding nozzles 51. By controlling ink ejection from the print heads 50 in synchronization with the conveyance speed of the recording paper 16, an image is formed on the recording paper 16.

As described above, the ejection volume and the ejection timing of the ink droplets from the respective nozzles are controlled via the head driver 84, on the basis of the dot data generated by implementing prescribed signal processing in the print controller 80, and the drive signal waveform. By this means, desired dot sizes and dot positions can be achieved.

Furthermore, the print controller 80 carries out various corrections with respect to the head 50, on the basis of information on the dot positions acquired by the dot position measurement method described below, and furthermore, it implements control for carrying out cleaning operations (nozzle restoration operations), such as preliminary ejection or nozzle suctioning, or wiping, according to requirements.

Explanation of Dot Position Measurement Method

The dot position measurement method according to the present embodiment will be described in detail hereinafter.

Figure 7:
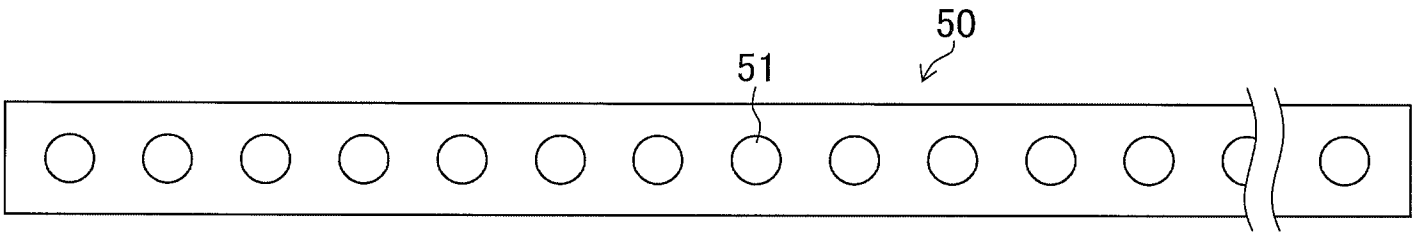
FIG. 7 is a schematic drawing illustrating a full line type of head.
Figure 8A:
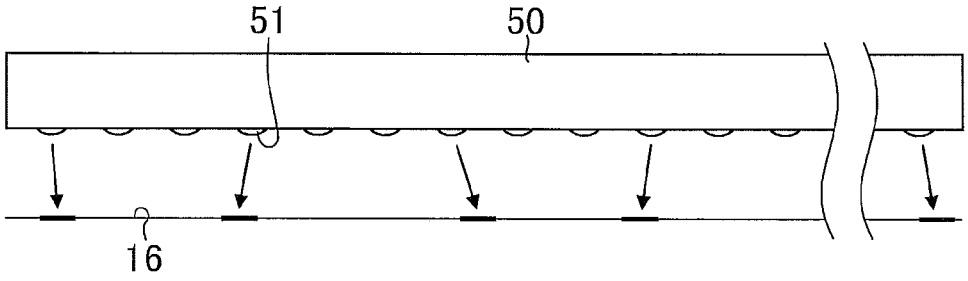
FIG. 8A is a diagram showing an aspect of variation of the dot deposition position with respect to an ideal position, due to the variation in the ejection direction of the ink droplets ejected from the nozzles of the line head.
Figure 8B:
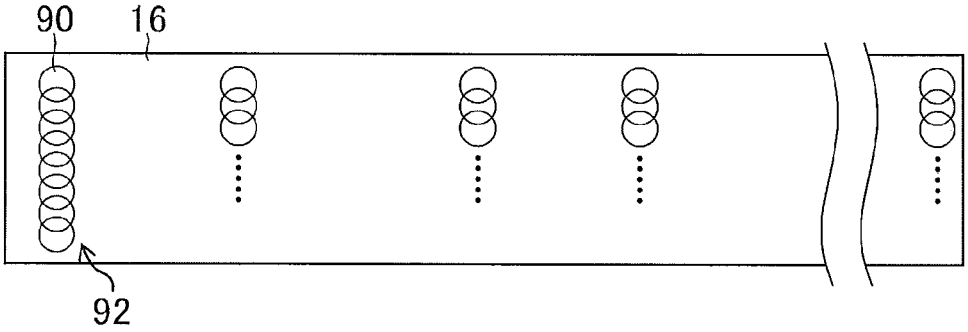
FIG. 8B is a diagram showing an example in which a sub-scanning direction line is drawn on recording paper using a head having the characteristics shown in FIG. 8A.
Figure 8C:
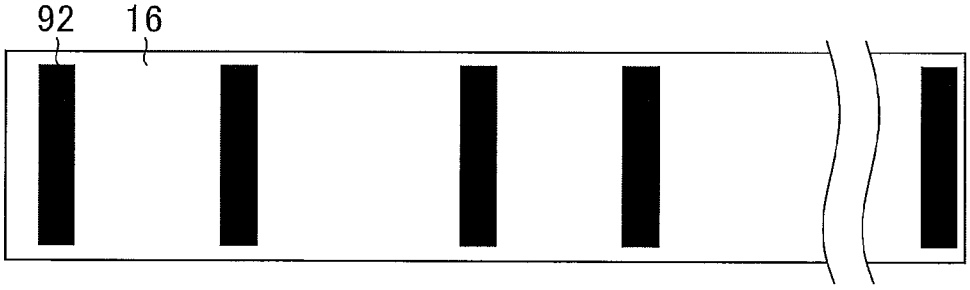
FIG. 8C illustrates lines in FIG. 8B in simplified form.

FIG. 7 is a schematic drawing illustrating a full line head. In order to simplify the illustration, FIG. 7 illustrates a head 50 with a plurality of nozzles 51 in a single row. However, as illustrated in FIGS. 2A to 5, a matrix head with a plurality of nozzles arranged in two dimensions is of course also applicable. That is, in light of a substantial nozzle row obtained by orthogonally projecting a nozzle group in a two-dimensional array on a straight line in the main scanning direction, such a nozzle group in a two-dimensional array can be treated so as to be substantially equivalent to one nozzle row FIG. 8A illustrates an aspect in which the deposition position varies with respect to an ideal position, due to inconsistency in the ejection direction of ink droplets ejected by the nozzles in a line head. FIG. 8B is an example for when a print head 50 with the characteristics illustrated in FIG. 8A is used to draw a line on recording paper 16, in the sub-scanning direction. When the recording paper 16 is conveyed while droplets are ejected toward the recording paper 16 from the nozzles 51 of the head 50, the ink droplets deposition on the recording paper 16, and, as illustrated in FIG. 8B, a dot row (line 92) in which a row of dots 90 caused by the ink droplets deposited from the nozzles 51 stand in a line, is formed. FIG. 8C illustrates lines 92 in FIG. 8B in simplified form. Hereinafter, the line 92 formed by a row of deposited dots caused by continuously ejected droplets, will be described using FIG. 8C to facilitate the illustration.

As illustrated in FIGS. 8B and 8C, each of the lines 92 is formed by continuous droplets from a single nozzle 51. When a line head of high recording density is used, because there is a partial overlap between the dots of adjacent nozzles when ejection is performed simultaneously from all the nozzles, a line comprising a single dot row is not formed. In order to prevent a mutual overlap between the lines 92, there is desirably at least one nozzle, and desirably three or more nozzles between the simultaneously ejecting nozzles at a distance therefrom. Note that FIGS. 8A to 8C illustrate an aspect in which there is a two-nozzle interval between the simultaneously ejecting nozzles for illustrative purposes.

As can be seen from FIGS. 8A to 8C, the line position changes according to the dot deposition position, based on the characteristics of the print head. In other words, it is clear that measuring the deposition position of each nozzle is the same thing as measuring the positions of the lines.

Example of a Dot Position Measurement Line Pattern

Figure 9:
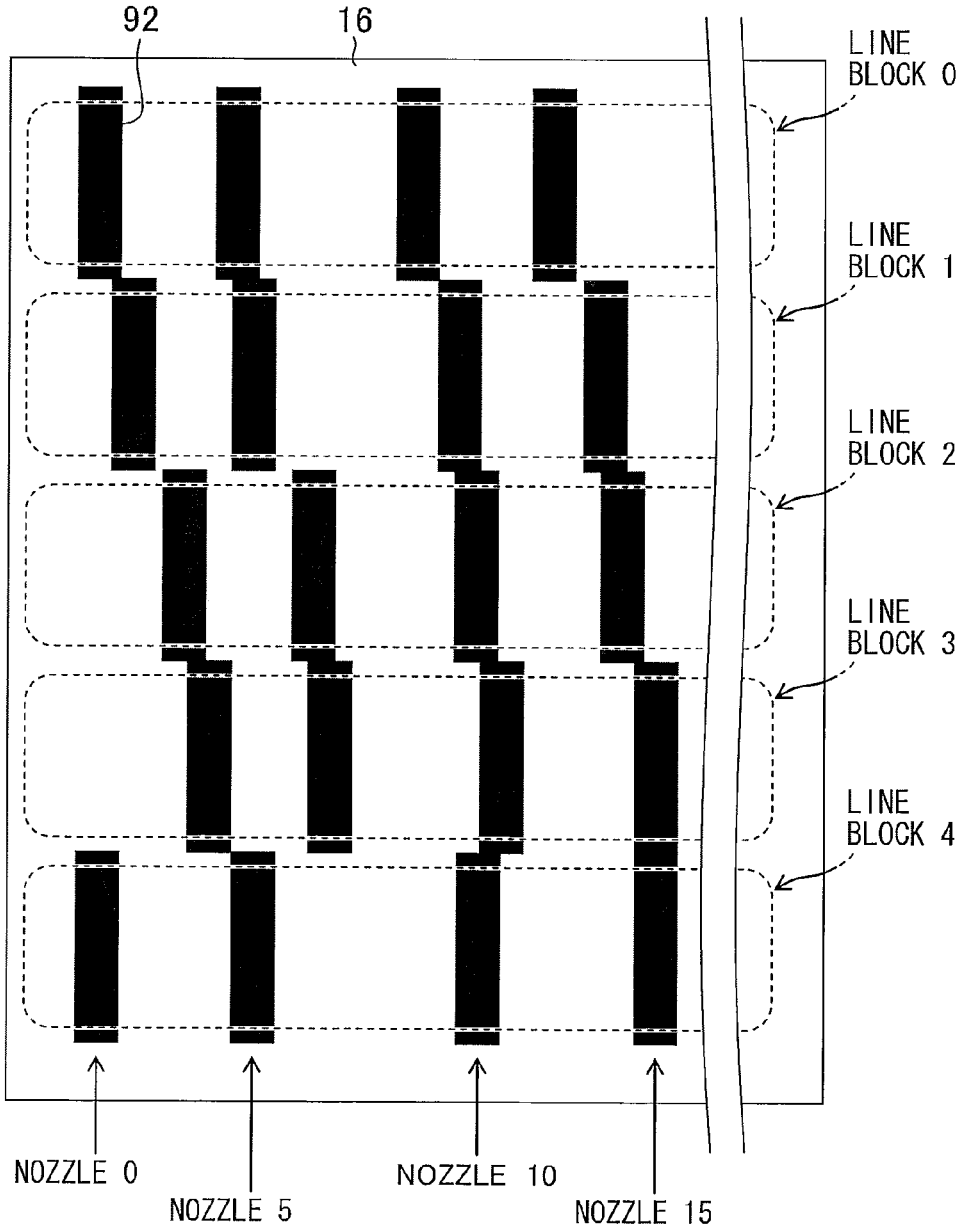
FIG. 9 is a general diagram of a line pattern for dot position measurement which is used in an embodiment of the present invention.

FIG. 9 provides an overall view of a dot position measurement line pattern that is used in an embodiment of the present invention. In order to obtain lines from all the nozzles 51 in the head 50, for example, a sample chart (measurement chart) for the line pattern as indicated in FIG. 9, is formed.

The illustrated chart includes a plurality of line blocks (here, line blocks 0 to 4 in five stages are illustrated). The line blocks are blocks having a plurality of lines (line group) for which lines are drawn using nozzles at fixed intervals.

The nozzle numbers are taken to be 0, 1, 2, 3, and so on, in sequence from the left-hand end of the line head in FIG. 8A. The line block 0 shown in FIG. 9 is a line block formed by the nozzles with the nozzle numbers "4N+0" (where N is an integer equal to or greater than 0), such as the nozzle numbers 0, 4, 8 . . . (a block of a group of lines formed by the nozzles with the nozzle numbers of multiples of 4). The line block 1 is a line block formed by the nozzles with the nozzle numbers "4N+1", such as nozzle numbers 1, 5, 9, and so on. The line block 2 is a line block formed by the nozzles with the nozzle numbers "4N+2", and the line block 3 is a line block formed by the nozzles with the nozzle numbers "4N+3". The line block 4 is a common line block (reference line block), and is formed by the nozzles with the nozzle numbers which are the same as those in the line blocks 0 to 3, in substantially even fashion.

The line block 4 in the present embodiment is formed by the nozzles with the nozzle numbers "5N+0" (nozzle numbers 0, 5, 10, 15, 20, . . . ). Between the line block 0 and the line block 4, the nozzle numbers 0, 20, 40, 60, . . . are the common nozzle numbers. Between the line block 1 and the line block 4, the nozzle numbers 5, 25, 45, 65, . . . are the common nozzle numbers. Between the line block 2 and the line block 4, the nozzle numbers 10, 30, 50, 70, . . . are the common nozzle numbers. Between the line block 3 and the line block 4, the nozzle numbers 15, 35, 55, 75, . . . are the common nozzle numbers. In this way, the lines are formed at separate positions by droplets ejected from the same nozzles. Using the line positions of these nozzle numbers which are common to the line block 0 and the line block 4, the rotation angle when reading the line pattern is corrected.

An example of 4N+M (M=0, 1, 2, 3) is described in the present embodiment, but is not limited to multiples of four. AN+B (B=0, 1, . . . A−1) where A is an integer of two or more may be adapted.

The reference line block corresponding to the line block 4 has a format of CN+D (where C≠A; C and A do not have a common divisor apart from 1 (C and A are coprime); and D can be any one of 0, 1, or C−1) and has a period corresponding to the nozzle numbers which have a common value for A×C.

In the example in FIG. 9, the lines corresponding to all the nozzles of one head are formed from the line blocks 0 to 3.

In other words, in the line head, when nozzle numbers are assigned in order starting from the end, in the main scanning direction, to the nozzles constituting a nozzle row (a substantial nozzle row obtained through orthogonal projection) that stands in one row substantially in the main scanning direction, the ejection timing for each of the groups (blocks) of nozzle numbers, 4N+0, 4N+1, 4N+2, and 4N+3, for example, is changed, thereby forming line groups (so-called "1 ON n OFF" type line patterns).

Consequently, as illustrated in FIG. 9, adjacent lines do not overlap within the same block and independent lines can be formed for all the nozzles (so-called "1 ON n OFF" type line pattern). A line block group as illustrated in FIG. 9 is formed for each of the heads corresponding to the respective ink colors CMYK.

Below, the line block 4 is taken as a common line block (or a line block containing common nozzles). Firstly, the line positions in each line block are measured for each of the line blocks (line blocks 0 to 4). Thereupon, a nozzle that is common to the line block 4 is extracted from each line block. Here, the line positions are represented as follows:

a line position belonging to the line block 0: xi@LB0, yi@LB0, i: nozzle number;

a line position belonging to the line block n: xi@LBn, yi@LBn, i: nozzle number; and a line position belonging to the common line block: xi@LCB, yi@LCB, i: nozzle number.

Next, all of the nozzle numbers which are the same as the nozzle numbers of the common line block are extracted from line block 0. The nozzles with the nozzle numbers 0, 20, 40 . . . are the same (common) nozzles, and therefore these measurement positions are extracted.

The line positions belonging to line block 0 are represented as INPUT_DATA@LB0={x0@LB0, x20@LB0, x40@LB0 . . . }, and the line positions belonging to the common line block are represented as OUTPUT_DATA@LB0={x0@LCB, x20@LCB, x40@LCB . . . }.

Next, the corrective function g@LB0(x) which converts INPUT_DATA@LB0 OUTPUT_DATA@LB0 is specified. As indicated below, the measurement values of the line block 0 are converted using this corrective function g@LB0(x).

$$\{x0@LB0, x4@LB0, x8@LB0 \ldots\} \rightarrow \{x'0@LB0, x'4@LB0, x'8@LB0 \ldots\}$$

All of the nozzle numbers which are the same as the nozzle numbers of the common line block are also extracted similarly from the line blocks 1, 2 and 3, the corrective functions g@LB1(x), g@LB2(x), g@LB3(x) are specified, and the conversion is performed according to the respective corrective functions. Since the relative positions in the converted data are defined on the basis of a single benchmark, namely, the common line block, then the effects of positional variation due to the sub-scanning positions are reduced in the measurement positions obtained.

However, since it is presumed that the line positions belonging to the line blocks match those of the common line block with a high degree of accuracy, then if there is large positional variation during line formation (random variation occurring during line formation), and especially if there is variation in the common line block, a problem arises in that the overall error would become large because the measurement positions of each line block are corrected on the basis of the measurement position of the common line block, which contains variation.

Figure 10:
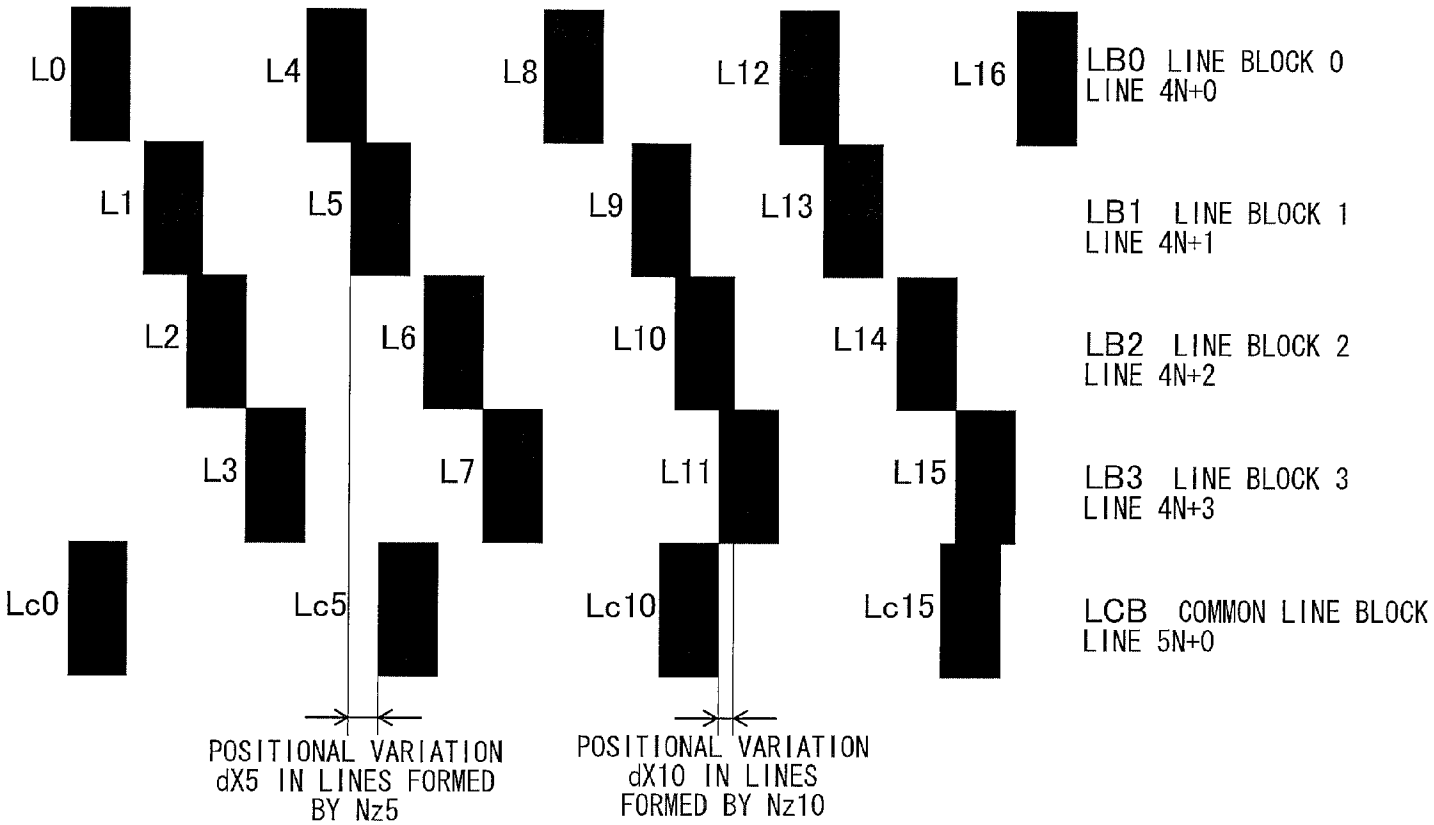
FIG.10 RELATED ART
FIG. 10 is a diagram for describing a measurement line pattern based on the related art.

FIG. 10 is a diagram for describing a measurement line pattern based on the related art. For example, if there is variation in line L5 (which corresponds to nozzle 5) and line L10 (which corresponds to nozzle 10), then the positional variation (error) dx5 between the lines L5 and Lc5 which are formed by nozzle 5, and the positional variation (error) dx10 between lines L10 and Lc10 which are formed by nozzle 10 are respectively expressed by Expressions (1-1) and (1-2) below.

$$dx5 = x5@LB1 - x5@LCB \quad (1\text{-}1)$$

$$dx10 = x10@LB3 - x10@LCB \quad (1\text{-}2)$$

As stated previously, when there is positional variation (error) in the common line block, then if the measurement positions of the line blocks are corrected on the basis of the measurement positions of the common line block as described above, then this error affects the corrected measurement positions of the respective line blocks.

Figure 11:
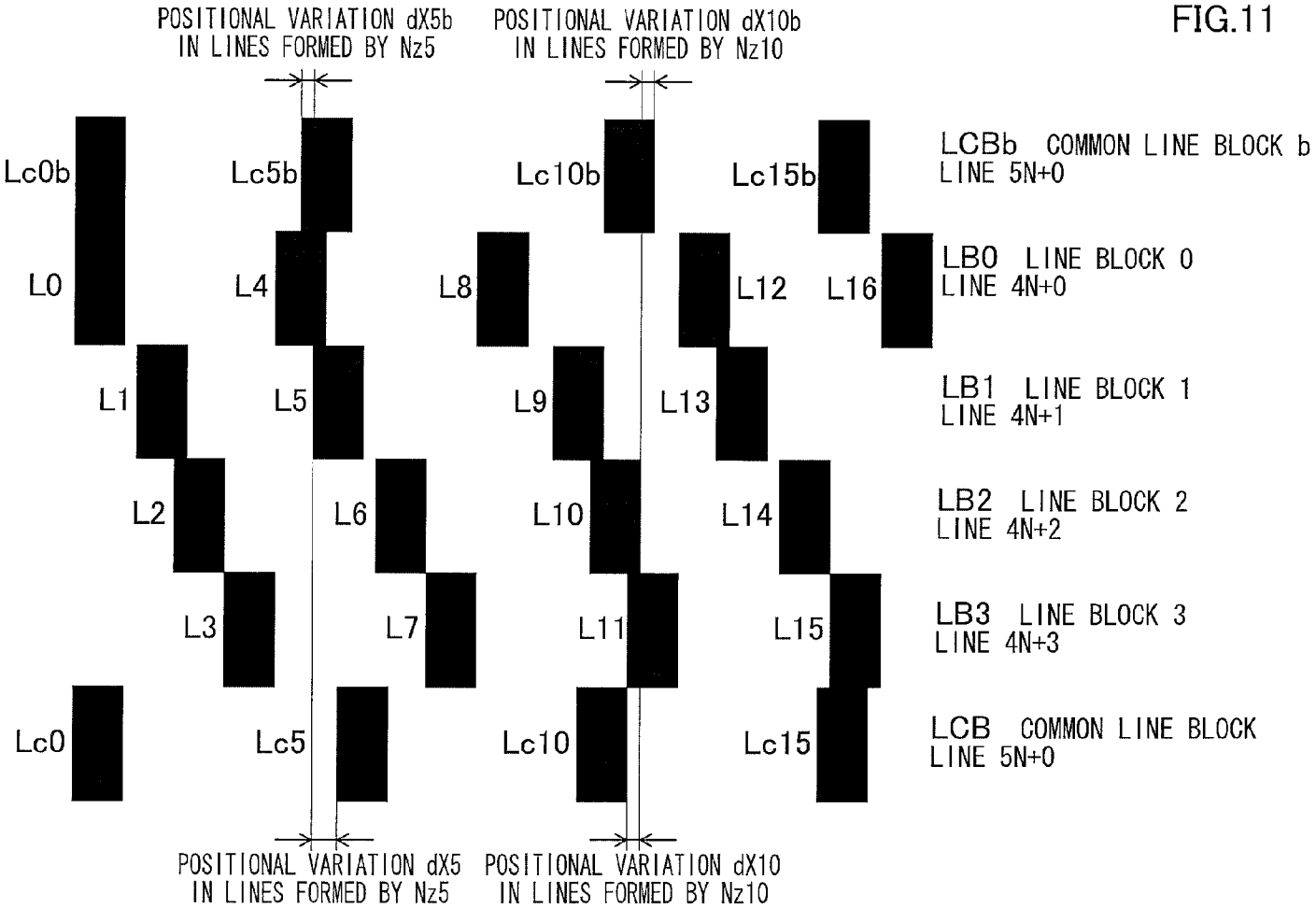
FIG. 11 is a diagram for describing a measurement line pattern relating to one embodiment of the present invention.

FIG. 11 is a diagram for describing a measurement line pattern relating to one embodiment of the present invention.

In the example shown in FIG. 11, two common line blocks (LCB and LCBb) are provided.

If it is supposed that there is variation in line L5 (which corresponds to nozzle 5) and line L10 (which corresponds to nozzle 10), similarly to FIG. 10, then the positional variation (error) dx5 between the lines L5 and Lc5 which are formed by nozzle 5, the positional variation (error) dx10 between the lines L10 and Lc10 which are formed by nozzle 10, the positional variation (error) dx5*b* between the lines L5 and Lc5*b* which are formed by nozzle 5 and the positional variation (error) dx10*b* between the lines L10 and Lc10*b* which are formed by the nozzle 10 are as expressed in Expressions (2-1) to (2-4) below.

$$dx5 = x5@LB1 - x5@LCB \quad (2\text{-}1)$$

$$dx10 = x10@LB3 - x10@LCB \quad (2\text{-}2)$$

$$dx5b = x5@LB1 - x5@LCBb \quad (2\text{-}3)$$

$$dx10b = x10@LB3 - x10@LCBb \quad (2\text{-}4)$$

Figure 12:
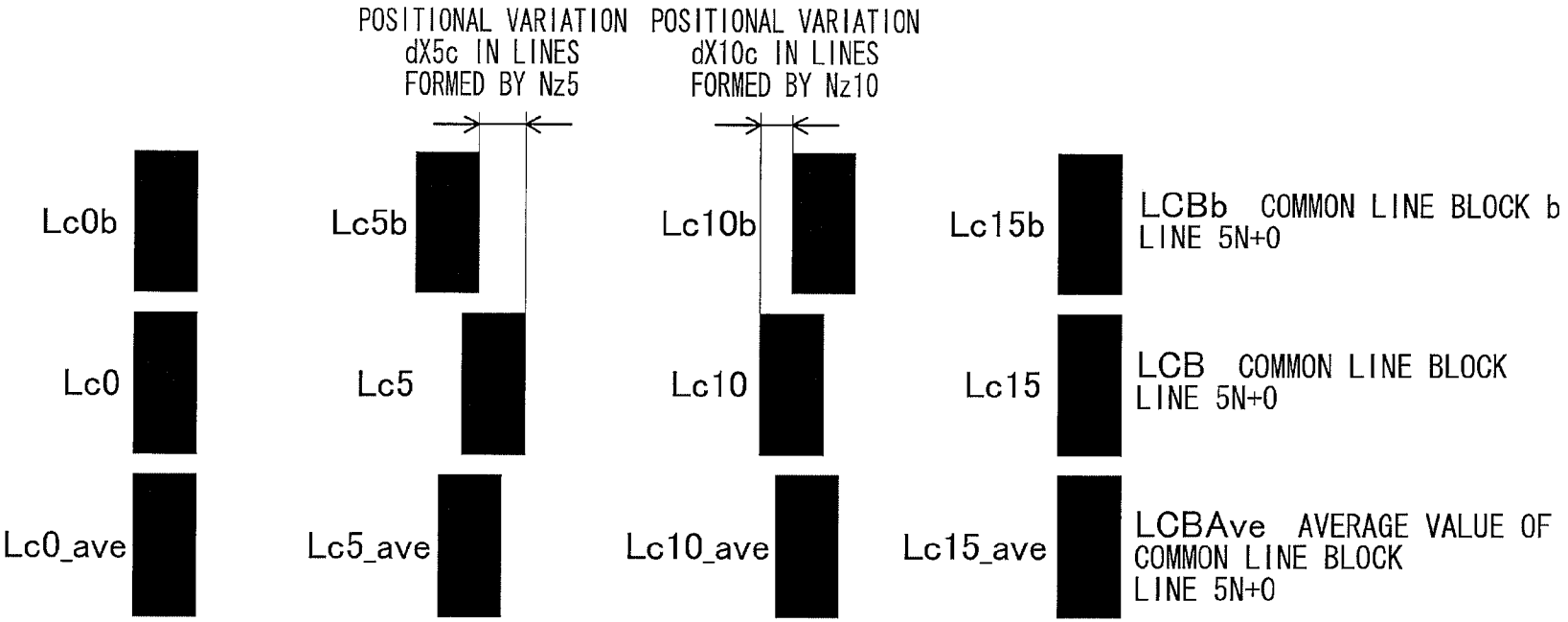
FIG. 12 is a diagram showing results of averaging a common line block assuming that there is no (or negligible) sub-scanning variation in the scanner.
Figure 13:
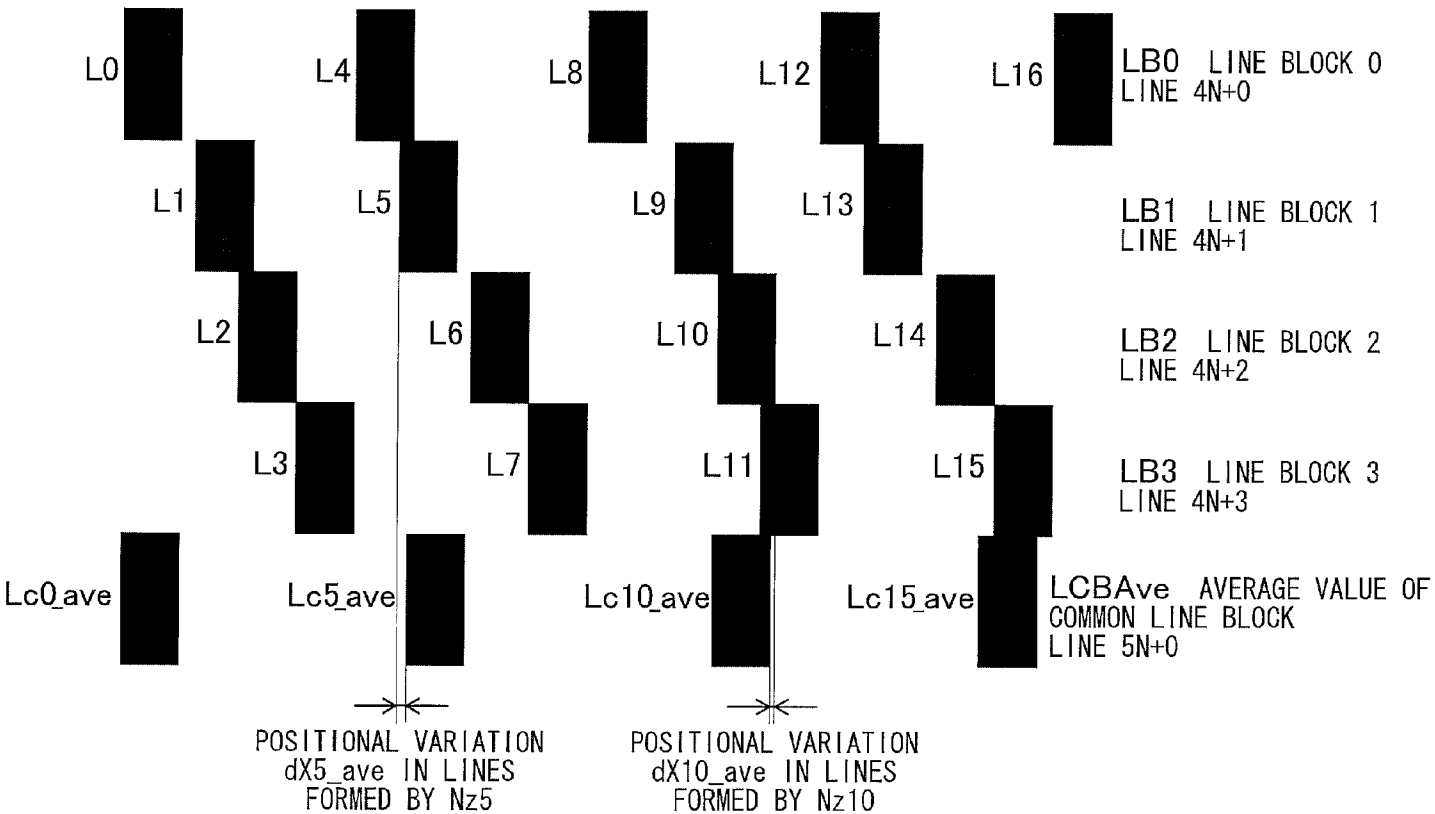
FIG. 13 is a diagram showing the relationship between the averaged results for the common line block and the other measurement positions (line block measurement positions)

FIG. 12 is a diagram showing the results of averaging the common line blocks assuming that there is no (or negligible) sub-scanning variation in the scanner. FIG. 13 is a diagram showing the relationship between the averaged results of the common line blocks and the other measurement positions (line block measurement positions).

In FIG. 12 and FIG. 13, a virtual line block which is obtained by averaging the common line blocks LCB and LCBb formed by the nozzles 0, 5, 10, 15 . . . is taken as LCBAve, and the X coordinates of the lines Lc0_ave, Lc5_ave and Lc10_ave . . . of the line block LCBAve are represented as respectively: x0@LCB_ave, x5@LCB_ave, x10@LCB_ave . . . . The coordinates x0@LCB_ave, x5@LCB_ave, x10@LCB_ave, . . . are determined by calculating the average value (for example, the arithmetic average) of the X coordinates of the respective lines in the common line blocks LCB and LCBb.

The positional variation (error) dx5_ave between the line L5 formed by nozzle 5 and the averaged common line block Lc5_Ave and the positional variation (error) dx10_ave between the line L10 formed by nozzle 10 and the averaged common line block Lc10_Ave are expressed by Expressions (3-1) and (3-2) below.

$$dx5_ave = x5@LB1 - x5@LCB_ave \quad (3\text{-}1)$$

$$dx10_ave = x10@LB3 - x10@LCB_ave \quad (3\text{-}2)$$

According to the present embodiment, the aforementioned error is made smaller by creating a plurality of common line blocks and averaging them, as shown in FIG. 13. In other words, dx5_ave<dx5, dx5*b*; dx10_ave<dx10, dx10*b*. By this means, it is possible to reduce the effects of the positional variation (error) of the common line blocks on the results of correcting the measurement positions of the line blocks.

Reading of Measurement Line Pattern in the Present Embodiment

Figure 14:
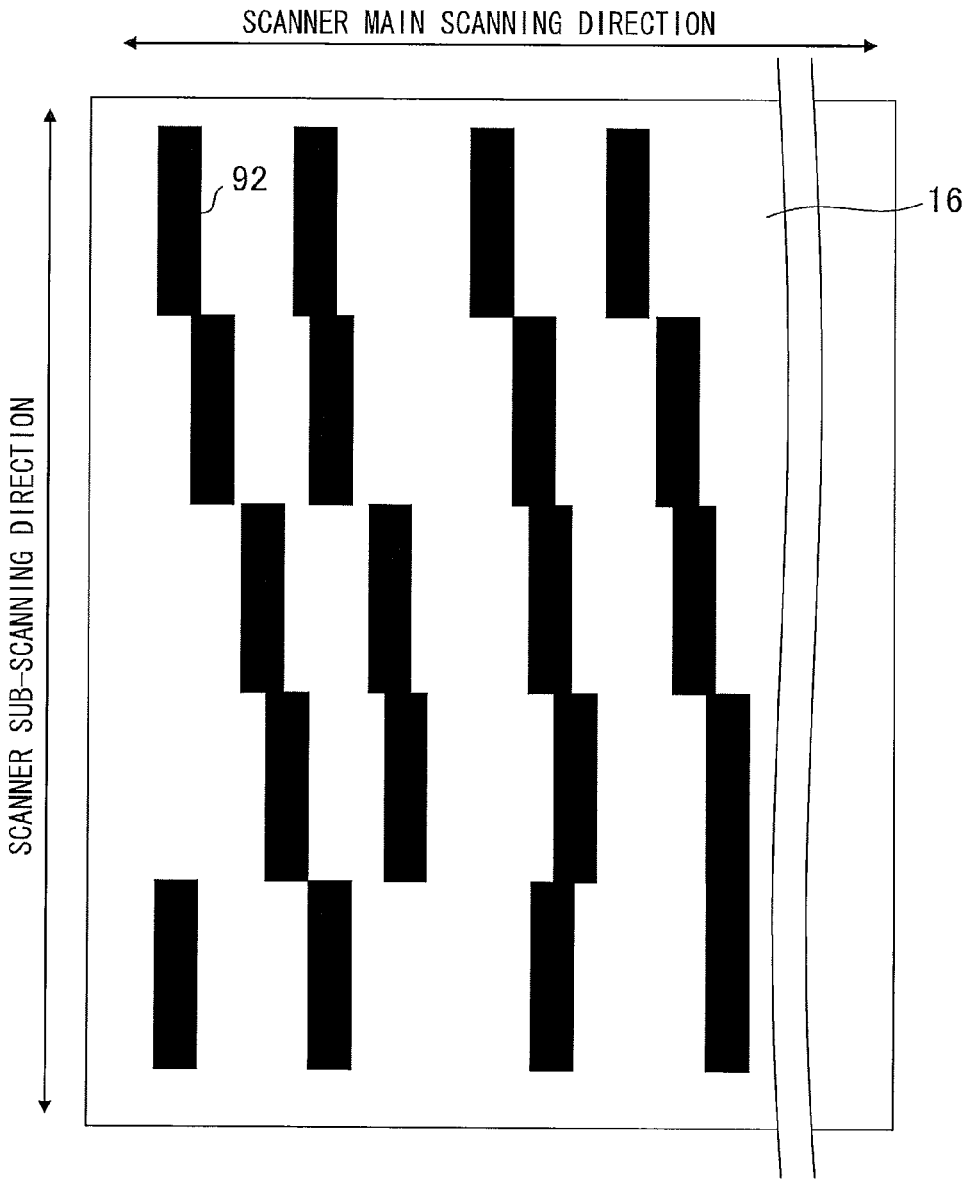
FIG. 14 is a diagram illustrating the relationship between the scanner main scanning direction and the scanner sub-scanning direction when a line pattern for dot position measurement is read with the scanner.

FIG. 14 illustrates a relationship in the scanner main scanning direction and sub-scanning direction when the dot position measurement line pattern is read with the scanner. As illustrated in FIG. 14, the direction in which the lines 92 are arranged within the line block is matched to the scanner main scanning direction, and the longitudinal direction (lengthwise direction) of the lines 92 is matched to the scanner sub-scanning direction, in order to read the dot position measurement line pattern.

Figure 15:
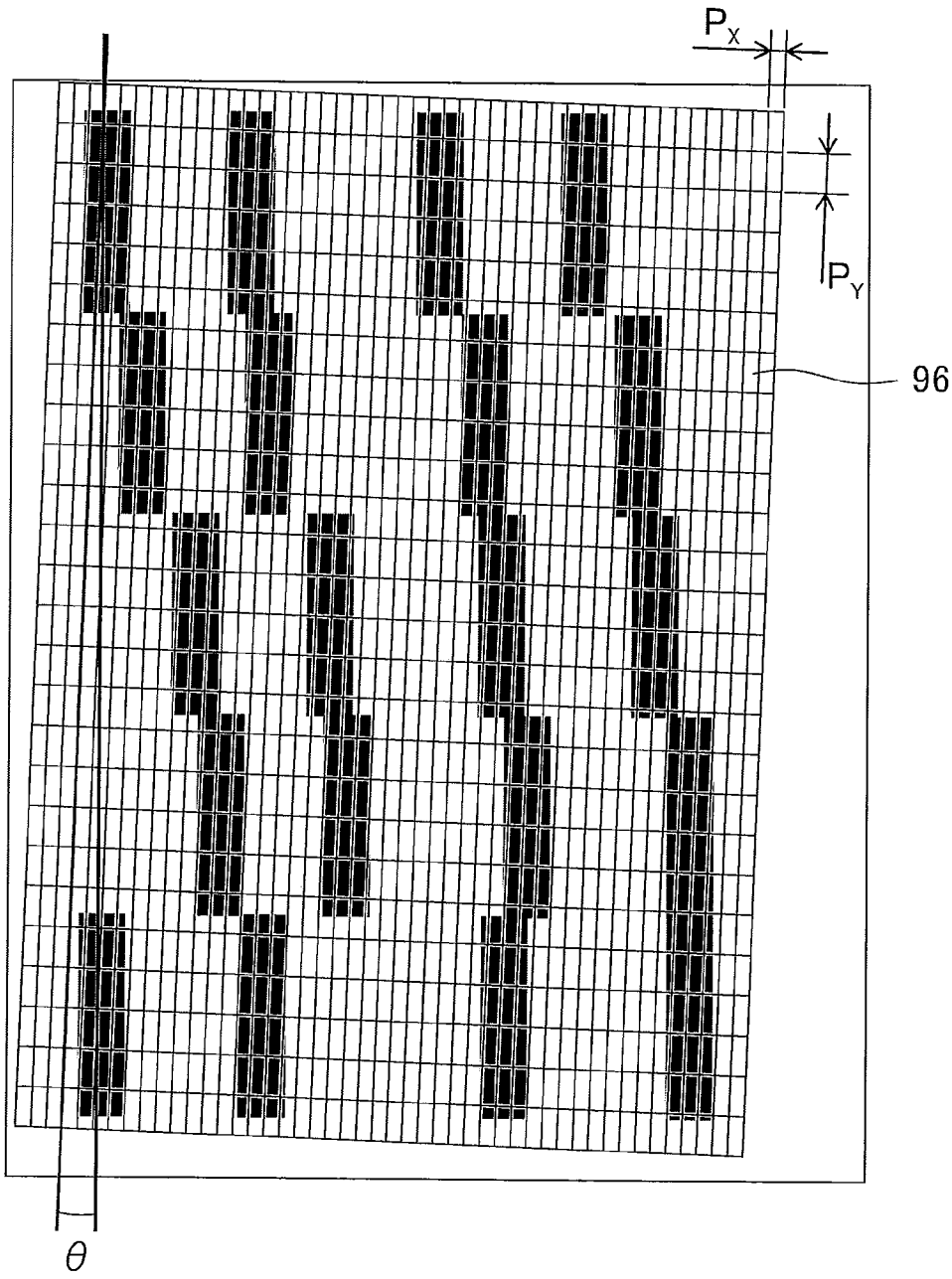
FIG. 15 is a diagram illustrating the relationship between a scanner coordinates system (reading coordinates system) and a line pattern for dot position measurement.

FIG. 15 illustrates a relationship between the scanner coordinate system (reading coordinate system) and the dot position measurement line pattern. The scanner performs reading with a setting of a high resolution (high accuracy) in the scanner main scanning direction and a low resolution in the scanner sub-scanning direction. For example, when the recording resolution of the image forming apparatus is 1200 DPI, the main scanning resolution of the scanner is, according to the sampling theorem, desirably 2400 DPI or more, while the sub-scanning resolution is desirably a much lower resolution of 200 DPI or less. The lower limit of the sub-scanning resolution varies, based on the line length and the setting of A in AN+B mentioned earlier, but may be 100 DPI or 50 DPI, as long as the lower limit falls within the operating range of the scanner.

The desirable conditions for the reading resolution of the scanner is a reading resolution in the sub-scanning direction of within a range not more than one-tenth of the reading resolution in the main scanning direction but not less than one-sixtieth of the reading resolution in the main scanning direction.

When the printer apparatus has a recording resolution of 1200 DPI, the reading resolution is desirably 2400 DPI in the main scanning direction, while the sub-scanning resolution is desirably 50 to 200 DPI.

The main scanning resolution varies depending on the required measurement accuracy. For example, when the margin of error $\sigma \leq 0.4$ (μm), the main scanning resolution desirably corresponds to 2400 DPI and the sub-scanning resolution is desirably not more than 200 DPI. The lower limit of the resolution is determined based on the number of 1 ON N OFF stages (N+1 stages) in the sampling chart and on the conditions that the line length L per stage is read based on NL pixels.

Note, as a constraint, that the (N+1 stages) in the sample chart should fit onto a single sheet of recording paper and be readable in a single reading operation.

In other words, it is required to satisfy the following conditions (Expressions (4) and (5)):

$$(N+1)\times L>(N+1)\times NL/(\text{Sub-scanning resolution}); \text{ and} \quad (4)$$

$$(\text{Longitudinal length of an A3-size or A4-size paper sheet})>(N+1)\times L \quad (5)$$

In the above expressions (4) and (5), NL is determined by the pixel count in the Y direction of the image averaging regions ROI, described subsequently, the number of ROI, and the shift amount in the Y direction of each ROI, and therefore NL is found by the following Expression (6):

$$NL=(\text{Pixel count in Y direction of ROI})+(\text{ROI number}-1)\times(\text{ROI shift amount}) \quad (6)$$

If (pixel count in Y direction of ROI)=10 pixels, (number of ROI (i.e., the above ROI number))=4, and (ROI shift amount)=2 pixels, then NL=10+(4−1)×2=16 (pixels), based on the above Expression (6).

If N=4 and L=2 (inches), then "the sub-scanning resolution >{(N+1)×NL}/{(N+1)×L}" is obtained based on Expression (4), ant therefore, the sub-scanning resolution >(NL/L)=16/2=8 (DPI).

As a further example, if N is 16, then L is 0.6 (inch) and the sub-scanning resolution >16/0.6≈26 (DPI).

The cells (denoted with reference numeral 96) in the scanner coordinate lattice illustrated in FIG. 15 represent regions (single-pixel aperture) occupied by a single read pixel of the scanner. For illustrative purposes in FIG. 15, these cells have been drawn as rectangles proportioned such that the scanner sub-scanning pixel size ($P_Y$) is approximately twice the scanner main scanning pixel size ($P_X$); however, the actual pixel aspect ratio mirrors the relationship between the main scanning resolution and the sub-scanning resolution of the scanner.

Note that even when a print of a dot position measurement line pattern to be read is carefully placed in the scanner (more specifically, on the flat bed of the scanner), it is unavoidable to form a rotation angle (θ) between the dot position measurement line pattern and the scanner reading coordinate system. When this rotation angle is not corrected, a certain error arises between the line blocks in accordance with the height of the line pattern. Hence, processing to correct the rotation angle is carried out in the present embodiment. Details on the rotation angle correction will be provided subsequently.

Figure 16:
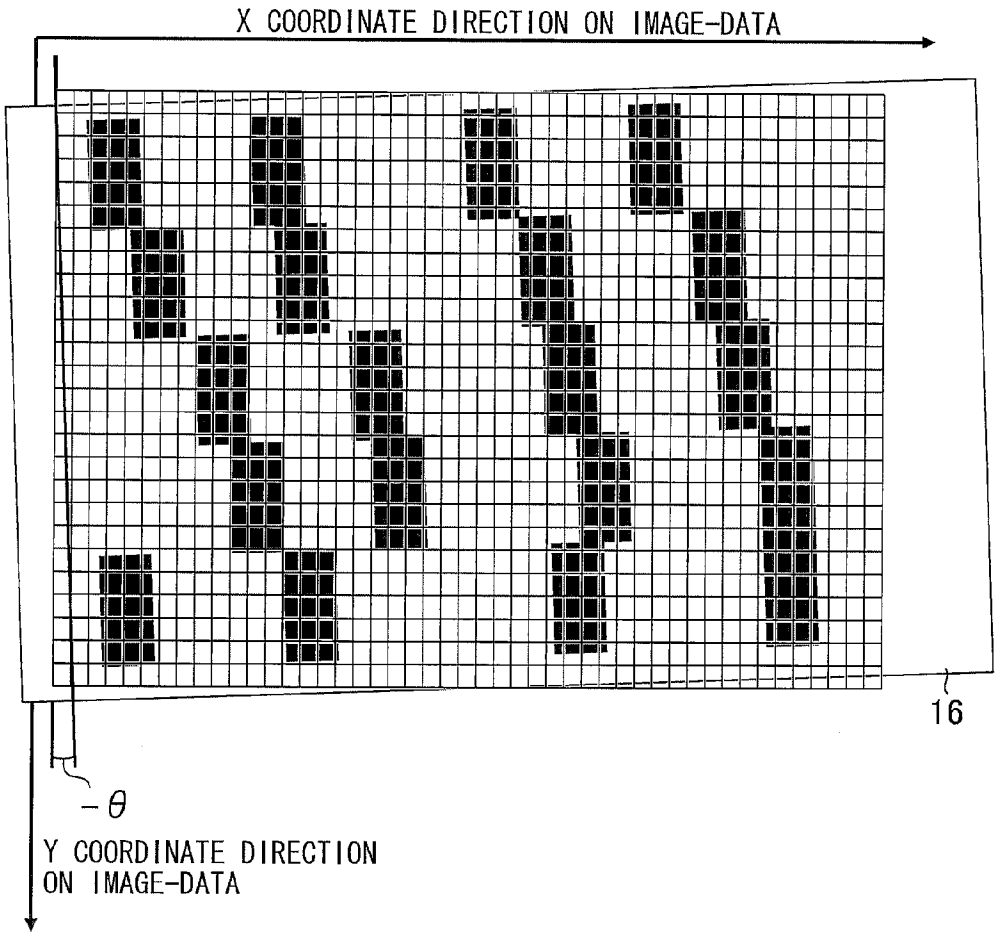
FIG. 16 is a diagram showing a dot position measurement line pattern on an image read by a scanner apparatus (the scanner pixel is depicted as a square shape)

FIG. 16 illustrates a dot position measurement line pattern on an image read with the scanner (where the scanner pixels are represented as squares). The X coordinate of the image data is plotted in the scanner main scanning direction, and the Y coordinate of the image data is plotted in the scanner sub-scanning direction.

Analysis of Read Image Data

Figure 17:
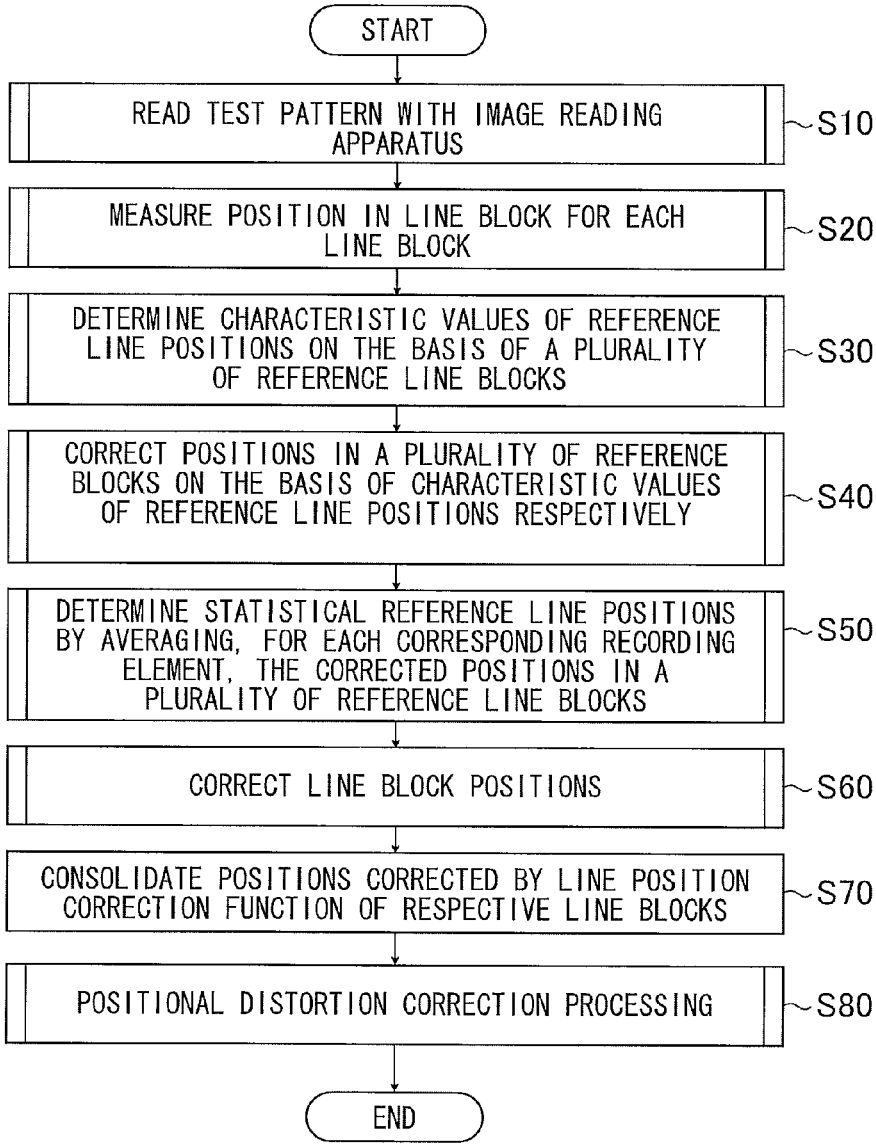
FIG. 17 is a flowchart showing a sequence of dot position measurement processing relating to one embodiment of the present invention.

FIG. 17 is a flowchart showing the process flow of the dot position measurement related to one embodiment of the invention. Prior to the start of the measurement flow of FIG. 17, ink droplets to be measured is ejected and deposited onto the recording paper 16 from each nozzle of the inkjet head while moving the recording paper 16 and the head 50 relatively to each other, so that a line pattern of dot rows corresponding to the respective nozzles is thus formed on the recording paper 16 from the ink ejected from each nozzle 51, as illustrated in FIG. 9. In other words, a sample chart (measurement chart), on which a line pattern is formed, is formed using the ink to be measured.

The line pattern thus obtained is then read using an image reading apparatus (scanner) (step S10 in FIG. 17). Here, as is illustrated in FIG. 14, with the line lengthwise direction oriented in the sub-scanning direction of the scanner, and the line row direction oriented in the main scanning direction of the scanner, the line pattern is imaged such that the resolution is high in the main scanning direction and low in the sub-scanning direction. Note that the scanner (not illustrated) includes a 3-line sensor (so-called "RGB line sensor") with a light-receiving element array for each of the colors R (red), G (green), and B (blue) with a color filter for each of RGB colors, and the whole surface (all the line blocks) of the sample chart are captured as electronic image data.

The colors in the read image are then selected according to the ink to be measured. In other words, captured image color channels are set according to the inks in the line pattern. An R channel (red channel) is set when the color of the ink is cyan (C), a G channel (green channel) is set when the ink is magenta (M), and a B channel (blue channel) is set when the ink is yellow (Y). A G channel is desirable when the ink is black ink, but an R channel is acceptable. In cases where other secondary color inks or ink of specialized colors are used, the channel selected among the scanner color channels is the channel allowing reading at the highest contrast when the ink to be measured is imaged, based on the relationship between the spectral reflectance of the ink recorded on the recording paper 16 and the spectral sensitivity of the scanner color channels. In other words, processing is carried out using one channel for each ink color.

The line block position on the image data thus read in step S10 is then detected, and the line position is measured for each line block (step S20).

Position Measurement in Line Block

Figure 18:
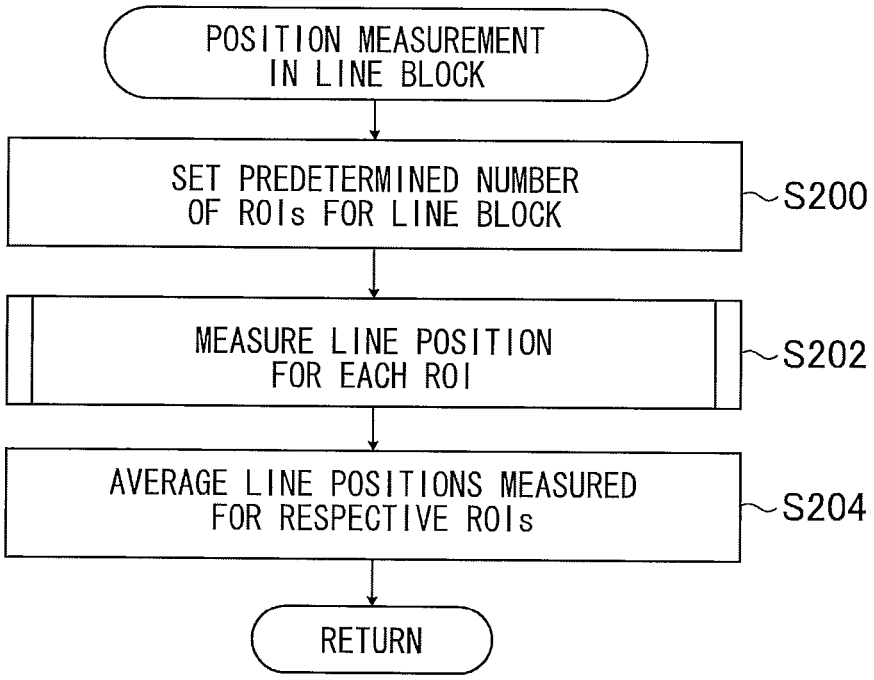
FIG. 18 is a flowchart showing a sequence of the position measurement processing in a line block in the step S20 in FIG. 17.
Figure 19:
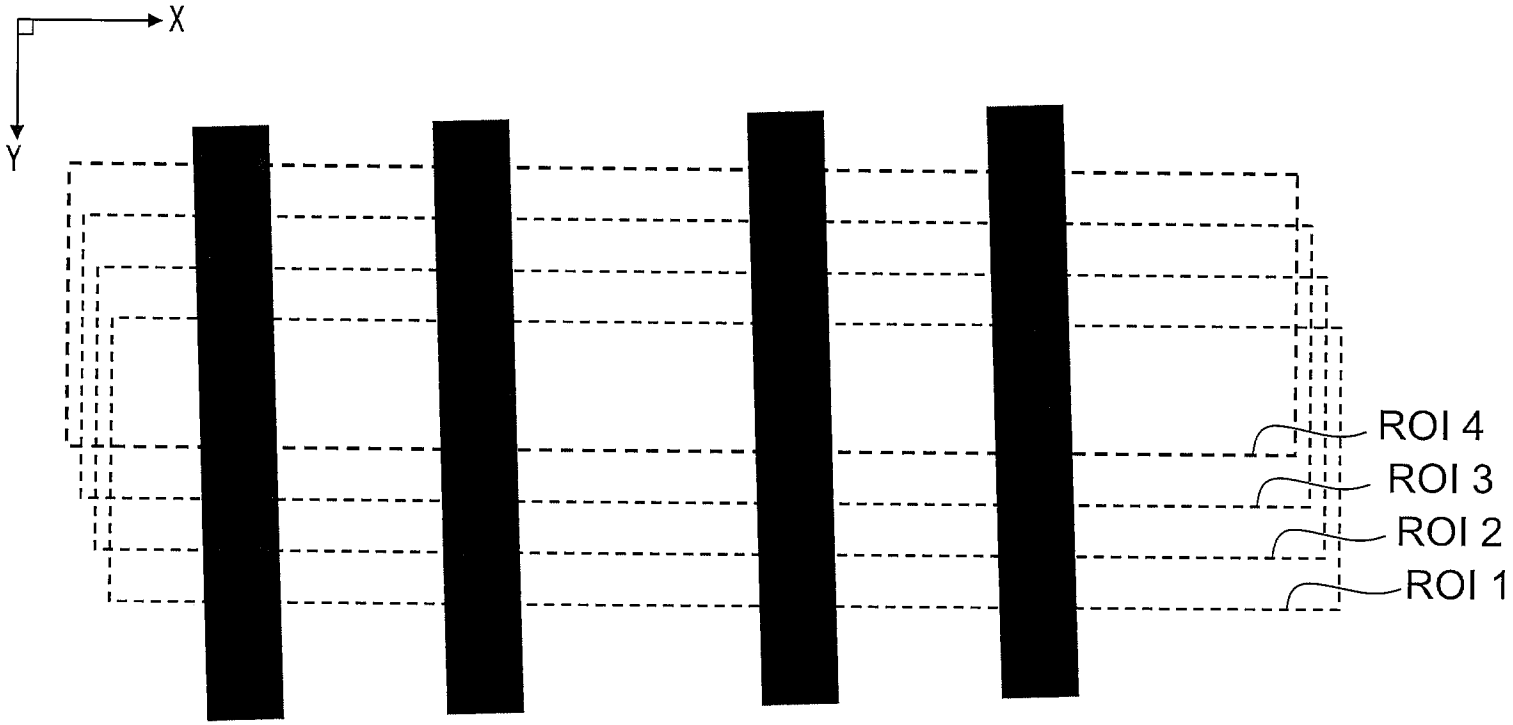
FIG. 19 is a chart showing the contents of line position measurement processing in ROI.

FIG. 18 is a flowchart showing a sequence of processing for measuring the position in a line block in the step S20 in FIG. 17. In the processing for measuring the position in a line block of FIG. 18, firstly, a prescribed number of averaging regions on the image, ROIs (Regions of Interest), are set for each line block (step S200). In other words, as shown in FIG. 19, a plurality of ROIs (Regions Of Interest) are set for one line block. Each ROI specifies a region of a prescribed shape which extracts one portion of a line block that is a calculation object, and in the example shown in FIG. 19, four rectangular regions of interest, ROI1, ROI2, ROI3 and ROI4, are set. Here, the respective ROIs are mutually staggered at a uniform interval in the Y direction. For example, if the uniform interval is two pixels, then ROI2 is set to a position staggered by 2 pixels in the Y direction with respect to ROI1, ROI3 is set to a position staggered by 4 pixels with respect to ROI1, and ROI4 is set to a position staggered by 6 pixels with respect to ROI1. In the X direction, if the lines do not exit from the ROIs, then it is not necessary to stagger the respective ROIs. In FIG. 19, for the sake of convenience, the ROIs are also depicted as being staggered at a uniform interval in the X direction, in order that ROI1 to ROI4 are not overlapping.

Next, the line positions are measured for each ROI set in step S200 above (step S202 in FIG. 18). In step S202, the X coordinates indicating the line positions are specified in accordance with the flowchart shown in FIG. 20. The central position in the Y direction of each ROI, ROI1 to ROI4, is taken as the Y coordinate value. The line positions from ROI1 to ROI4 which have been specified in this way are averaged to determine the line positions (coordinates) of the line block (step S204 in FIG. 18).

Figure 20:
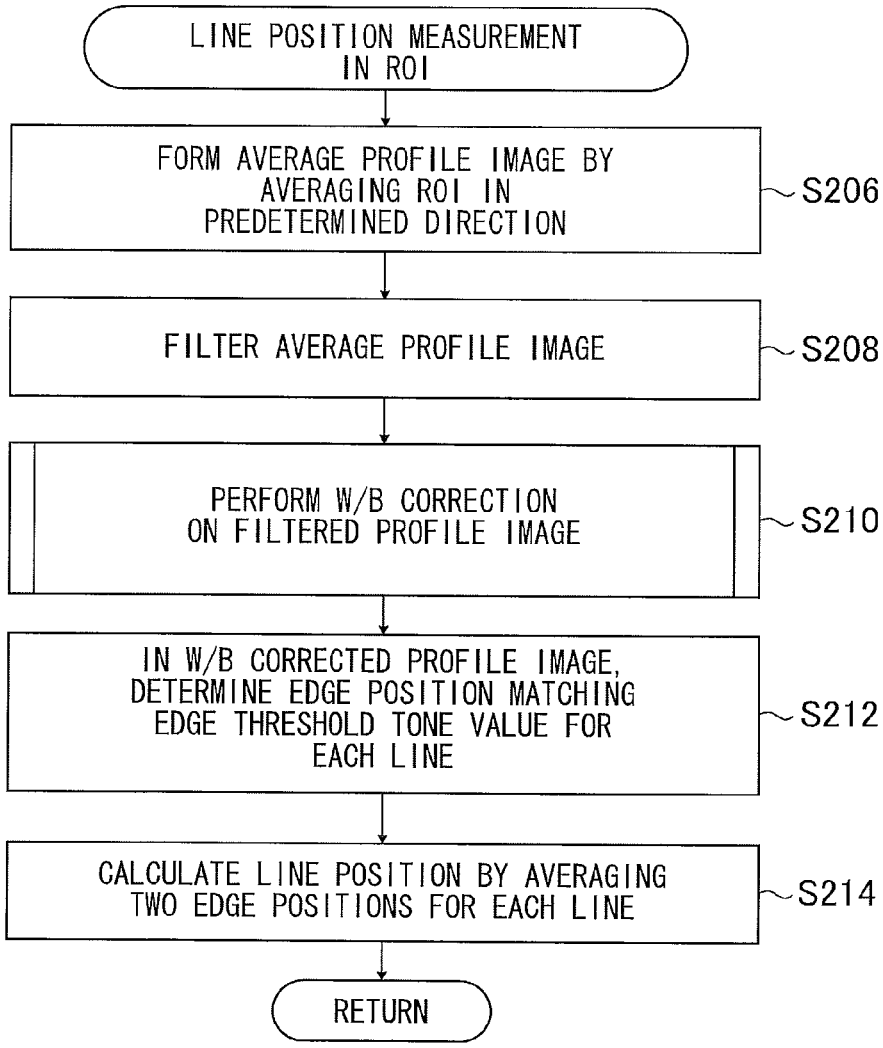
FIG. 20 is a flowchart showing the line position measurement processing in ROI.

FIG. 20 is a flowchart showing processing for line position measurement in a ROI. In the processing for position measurement in line block in FIG. 20, firstly, the image signal in the ROI is averaged in a prescribed direction (in the present embodiment, the sub-scanning direction of the scanner (Y-coordinate direction)), and an average profile image is created (step S206 in FIG. 20).

Figure 21A:
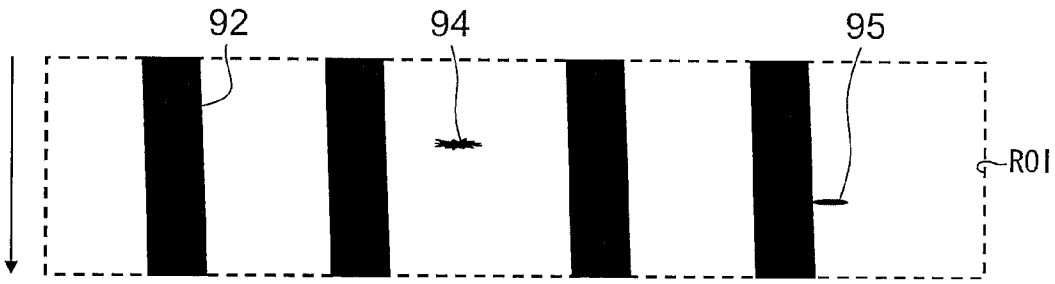
FIG. 21A is a diagram showing an example of one ROI which is a calculation object.
Figure 21B:
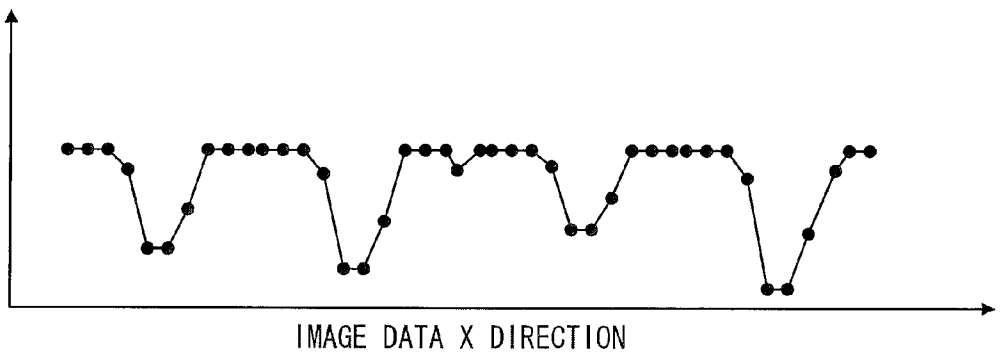
FIG. 21B is a diagram showing an average profile image obtained by averaging the image signal of the ROI shown in FIG. 21A, in the line lengthwise direction (the direction of the downward arrow in FIG. 21A)

FIG. 21A is an example of one ROI to be computed, and FIG. 21B is an average profile image obtained from the ROI illustrated in FIG. 21A by averaging the image signal in terms of the line longitudinal direction (direction of the down arrow in the drawing). Note that, in FIG. 21B, the horizontal axis represents the position (pixel position) of the image data in the X direction, and the vertical axis represents the tone values of the image data thus read. Here, the higher the density of ink dots, the smaller the tone values; parts without dots (white ground parts of the recording paper 16) have large tone values.

Even when dirt 94 adheres to the dot position measurement line pattern as illustrated in FIG. 21A, or a satellite 95 (a sub-droplet known as a satellite droplet which separates from a main droplet during ink ejection is generated and this satellite droplet adheres to a different position on the recording paper 16 from the main droplet) is generated on the line 92, by performing averaging in the line longitudinal direction (direction of downward arrow in the drawing), the contrast of the dirt 94 decreases, and distortion of the profile images caused by the satellite 95 is reduced (see FIG. 21B).

Thereupon, the average profile image created in step S206 is filtered (smoothed) by a prescribed filter (filtering process (smoothing process)). A filtered profile image (X-coordinate direction) is created (step S208 in FIG. 20).

Figure 22:
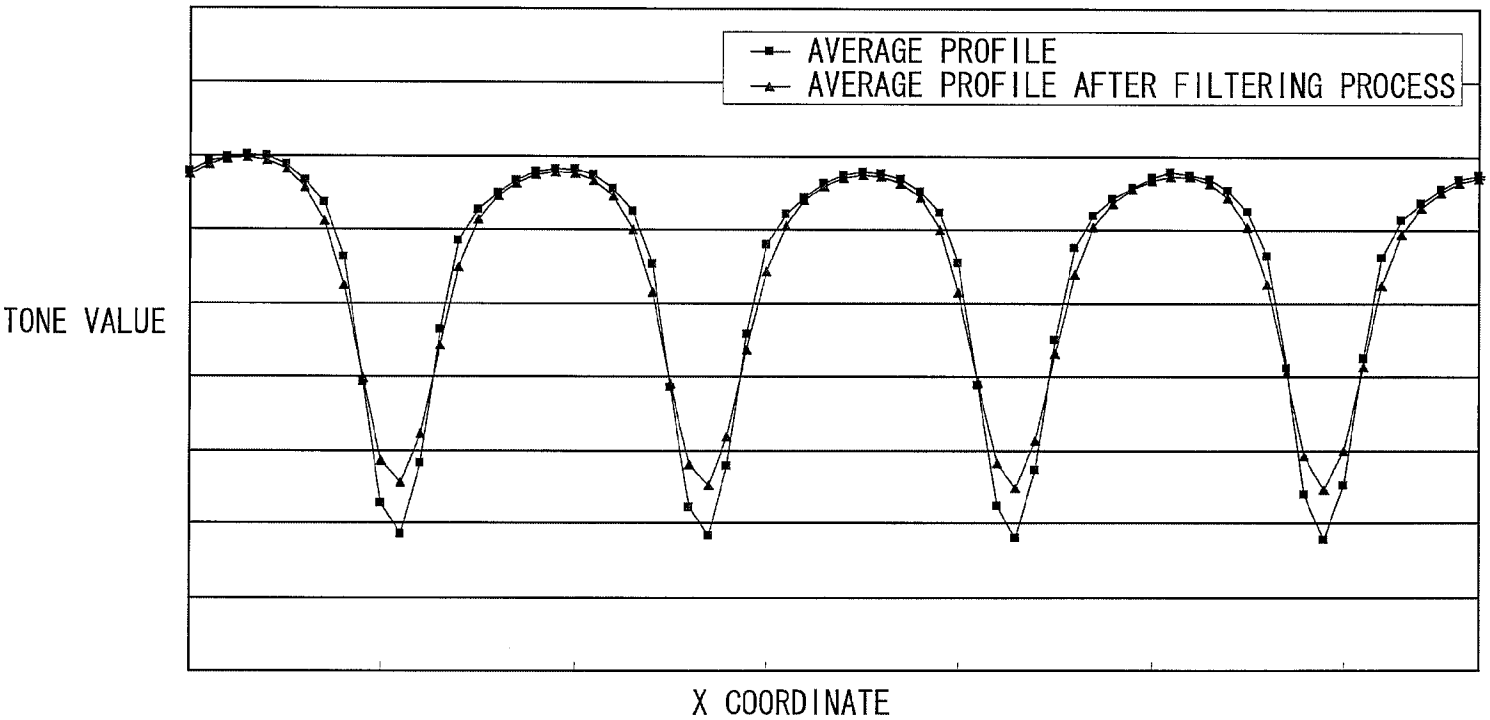
FIG. 22 is a graph showing an average profile image and the results of filtering the averaged profile.
Figure 23:
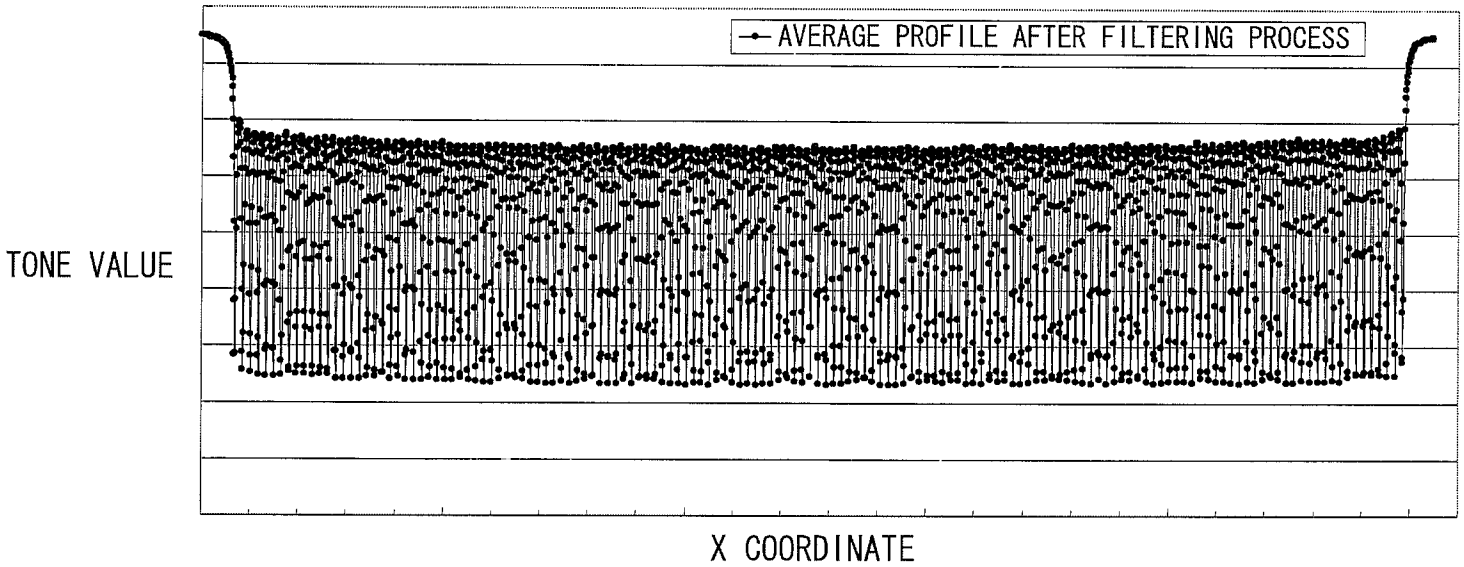
FIG. 23 is a graph showing long-period tone value variation in an average profile image after filtering.

FIG. 22 is a graph showing the average profile image and the results of filtering the averaged profile, and FIG. 23 is a graph showing the long-period tone value variation of the average profile image after filtering. The examples in FIG. 22 and FIG. 23 show results where filtering is carried out on the average profile image, and furthermore the contrast of dirt is reduced and distortion due to satellites is reduced. From the viewpoint of processing speed and effectiveness, it is desirable to use a 5 to 9-tap approx. linear filter of symmetrical shape.

As shown in FIG. 22, as a result of the filtering process, short-period distortion is corrected. However, as shown in FIG. 23, long-period tone value variation caused by shading (light/dark variation in brightness of lighting, etc.) during reading by the scanner still remains. Shading of this kind is a major cause of positional error in an algorithm which specifies the line positions on the basis of tone values. Therefore, following the filtering process (step S208 in FIG. 20), W (white, white background)/B (black, ink) correction is carried out on the average profile image which has been filtered (step S210 in FIG. 20).

Figure 24:
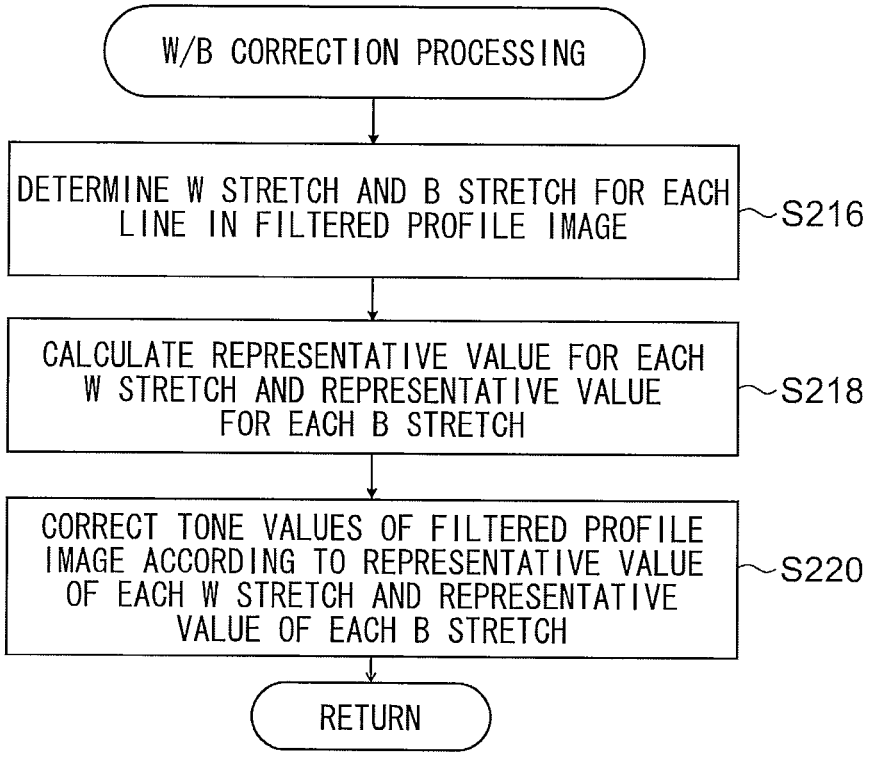
FIG. 24 is a flowchart showing a flow of W/B correction processing.

FIG. 24 is a flowchart showing a flow of W/B correction processing. In the W/B correction processing, firstly, W (white, white background) stretches and B (black, ink) stretches are set with respect to each line in the profile image after the filtering (step S216), and representative values are specified respectively for the W stretches and the B stretches (step S218).

Figure 25:
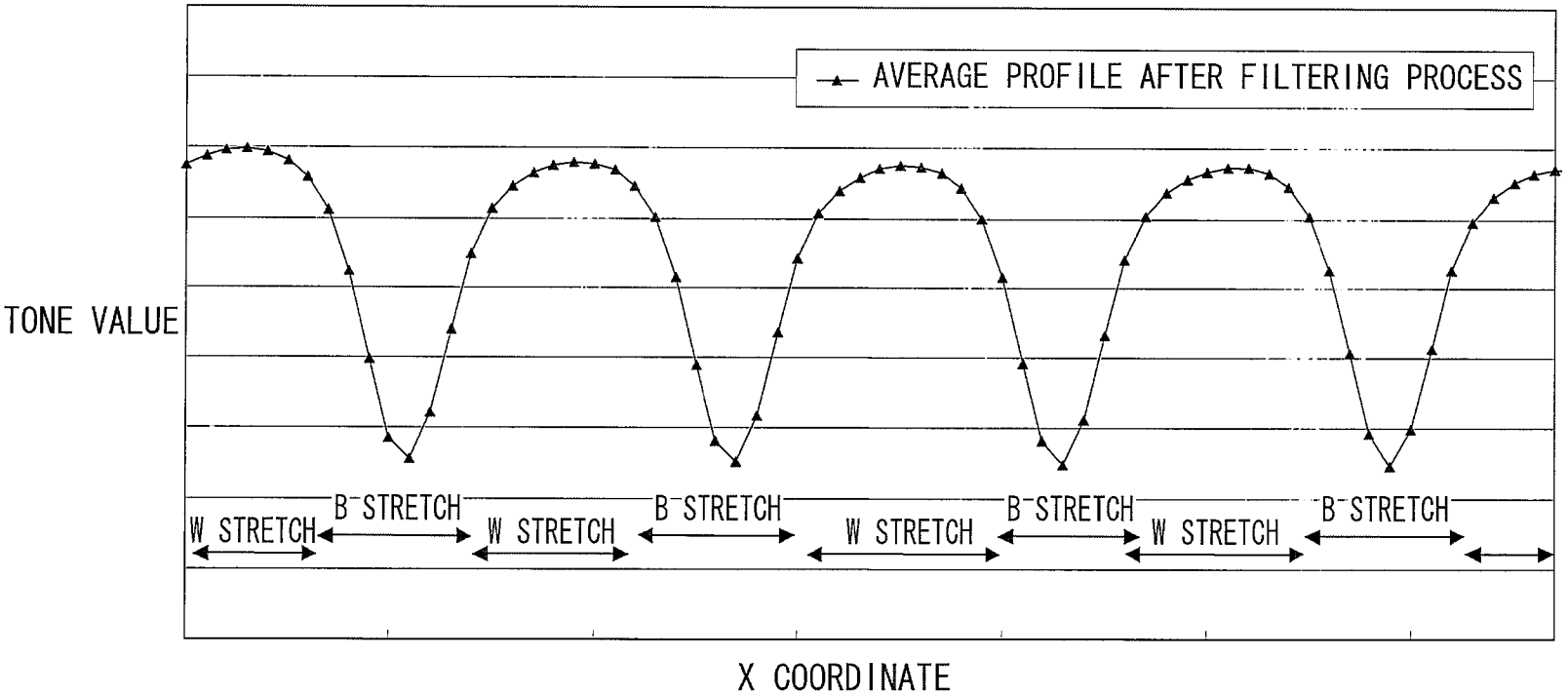
FIG. 25 is a diagram showing an aspect of setting W (white, white background) stretches and B (black, ink) stretches in respect of a filtered profile image.

FIG. 25 illustrates an aspect in which W (white, white background) stretches and B (black, ink) stretches are set for a filtered profile image. The W stretches and B stretches are laid on binarization processing based on a profile graph using a discrimination analysis method, and the result based on the binarization processing is further subjected to morphology processing (expansion is performed a predetermined number of times, and thinning is performed the same number of times), whereupon the results are set with the black pixels in the B stretches and white pixels in the W stretches. The B stretches thus occupy profile image dips (minimum values), and the W stretches occupy the profile image peaks (maximum values). An increase in black pixels by approximately a predetermined number of pixels may be set as a B stretch, while an increase in white pixels by approximately a predetermined number of pixels may be set as a W stretch.

For the W stretches determined in this way, tone values and positions representing the W stretches are found for the filtered profile images. A representative value is the maximum value in a W stretch, for example. The position of a W stretch is found using the center position of the W stretch. A representative tone value $W_{Li}$ and position $W_{Xi}$ are determined for each of the W stretches, $W_i$ (i=0, 1, 2, . . . ).

Likewise, for the B stretches, the tone value and position to represent a B stretch are determined for the filtered profile images. The minimum value in the B stretch may be used as a representative value, for example. The position of a B stretch is found using the center position of the B stretch. A representative tone value $B_{Li}$ and position $B_{Xi}$ are determined for each of the B stretches $B_i$ (i=0, 1, 2, . . . ).

The tone values of the filtered profile images are corrected on the basis of the representative values for the W and B stretches thus determined (step S220 in FIG. 24). Note that W stretch corresponds to a "non-recording region", and B stretch corresponds to "recording region".

W/B Correction Processing

In the W/B correction processing, each position X and tone value L are corrected for the filtered profile images as follows. In other words, an estimate value $W_L$ is found for an optional X by performing linear interpolation on the representative values $W_{Li}$ and $W_{Xi}$ in the determined W stretch. An estimate value $B_L$ is found for an optional X by performing linear interpolation on the representative values $B_{Li}$ and $B_{Xi}$ of the determined B stretch.

Supposing that the white tone value after W/B correction is $W_0$ and the black tone value is $B_0$, then the following Expression (7) is satisfied.

$$L' = \text{correction coefficient } K(L-B_L)+B_0 \text{ Where correction coefficient } K=(W_0-B_0)/(W_L-B_L) \quad (7)$$

In other words, a linear transform is performed so that when the input value is $W_L$, the output value is $W_0$, and when the input value is $B_L$, the output value is $B_0$.

Once the processing to correct the W/B level in this manner (step S220) ends, a subroutine of FIG. 21 is completed and the processing return to the ROI line position measurement process flow of FIG. 20, and the processing advances to step S212 in FIG. 20. In step S212, in the W/B corrected profile image, an edge position (X coordinate) which matches a predetermined tone value (edge threshold tone value) is determined at two points (left and right) for each line.

Figure 26:
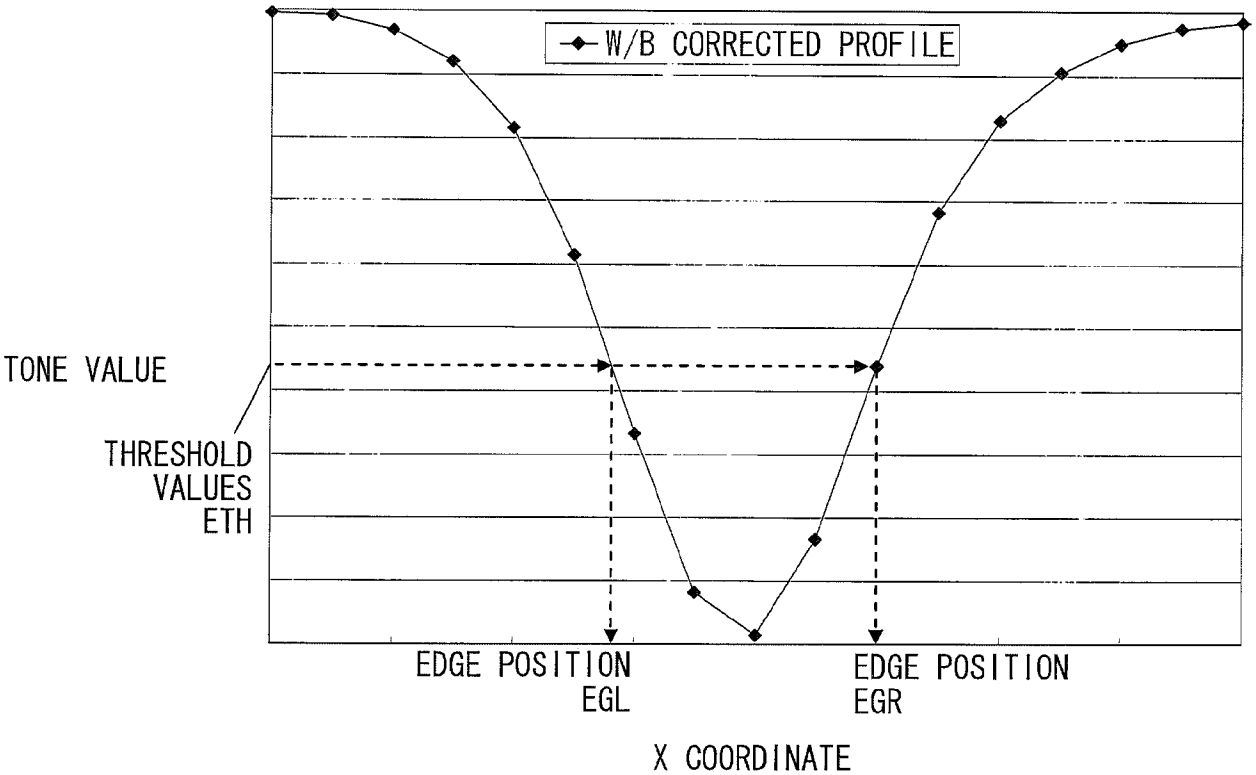
FIG. 26 is a diagram showing an aspect of specifying two positions that indicate a threshold value ETH specifying edges, one before and one after a line (in FIG. 26 the left-hand-side edge position EGL and the right-hand-side edge position EGR), in a profile image resulting from W/B correction.

FIG. 26 illustrates an aspect in which, in the W/B corrected profile image, positions serving as threshold values ETH for defining the edges are determined with respect to the line at two forward and rear points (an edge position EGL on the left in FIG. 26 and an edge position EGR on the right).

In cases where W/B corrected profile image and the threshold values ETH do not accurately match, the edge positions can be determined using a publicly known interpolation algorithm. Linear or spline interpolation or cubic interpolation may be adopted as the publicly known interpolation algorithm.

The edge positions determined at two points of each line are then averaged for each line and the average value is determined as the line position (X coordinate) (step S214 of FIG. 16). The center position of the ROI in the Y coordinate direction is also determined as the Y coordinate of the line position. In other words, the Y coordinate of the line position is found using the center position of each ROI in the Y direction.

After the line positions corresponding to each ROI have been thus determined, a subroutine in FIG. 20 is completed, the processing returns to the position measurement process flow in a line block in FIG. 18 and the processing advances to step S204 of FIG. 18. In step S204, line positions found by averaging the line positions which are measured for the respective ROIs (ROI 1 to ROI 4) is determined as the line positions (X coordinates, Y coordinates) corresponding to the line block. The same or similar processing is performed for each line block to measure the line positions for each line block.

The method of identifying the line positions is not limited to a method which determines on the basis of the respective edge positions as described above, and it is also possible to employ other calculation methods, such as determining the line positions on the basis of the peak value of a profile image, for instance.

Physical Value Conversion

Information on the line positions determined as above corresponds to the pixel positions of the scanner coordinate system, and therefore these pixel positions are converted to physical units (for example, micrometers (μm)). In other words, the line positions are converted into physical values by multiplying these values by coefficients corresponding to the main scanning resolution and the sub-scanning resolution. This conversion of physical values is performed before performing the rotation correction described below, in order to correct the difference between the main resolution and the sub resolution.

In a case where the main scanning read resolution is 2400 DPI, for example, the coefficient is 25400/2400 (μm/dots). When the sub-scanning read resolution is 200 DPI, the coefficient is then 25400/200 (μm/dots). Computation to convert the pixel positions into physical values in μm units is performed by using these coefficients.

Note that the conversion from a coordinate system for pixels of image data to a coordinate system on an actual recording medium is defined by a conversion expression using the aforementioned coefficients. Hence, which coordinate system is used in the computation and at which stage of the computation the coordinate conversion is performed, are optional.

Figure 27:
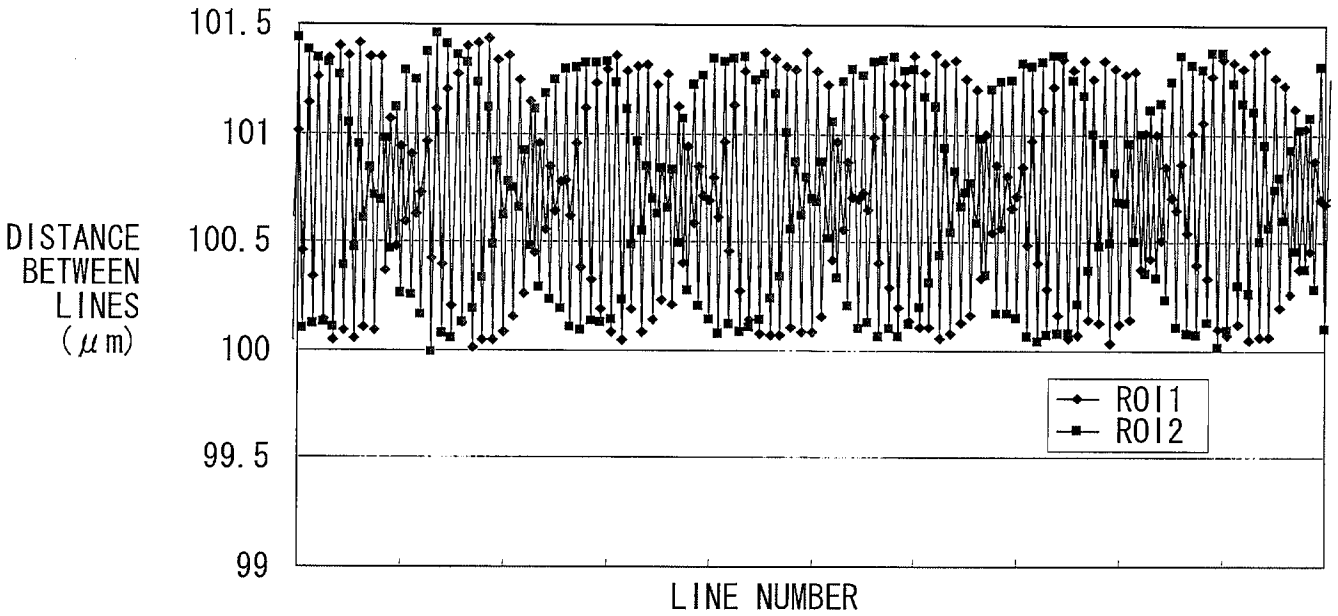
FIG. 27 is a diagram showing results of converting the line positions (X coordinates) specified in ROI1 and ROI2 to a distance between lines (line spacing) by reading in a corrective line block which is made accurately with a pitch of 100 μm.
Figure 28:
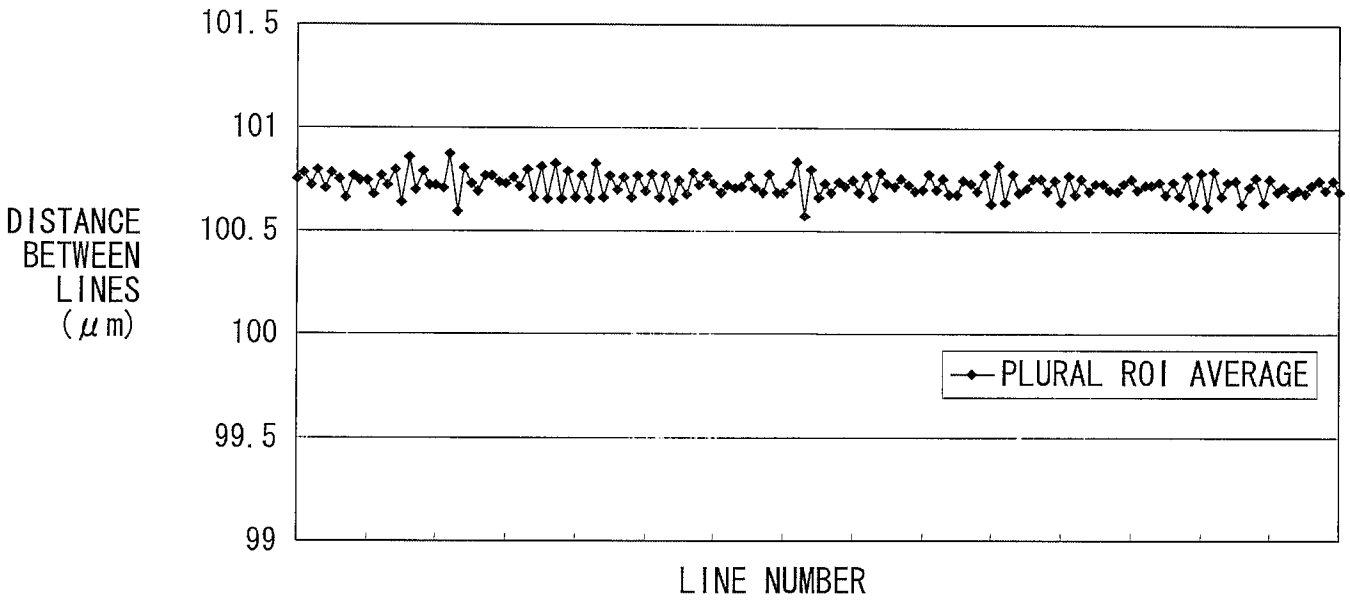
FIG. 28 is a diagram showing the results of converting line positions (X coordinates) averaged from ROI1 to ROI4 to a distance between lines by reading in a corrective line block which is made accurately with a spacing of 100 μm, similarly to FIG. 27.

FIG. 27 is a diagram showing the results of converting the line positions (X coordinates) specified in ROI1 and ROI2 to a distance between lines (line spacing) by reading in a line block for correction which is manufactured accurately with a spacing of 100 μm. FIG. 28 is a diagram showing the results of converting the line positions (X coordinates) averaged from ROI1 to ROI4 to a distance between lines by reading in a line block for correction which is manufactured accurately with a spacing of 100 μm, similarly to FIG. 27. In FIG. 27 and FIG. 28, the horizontal axis is the line number and the vertical axis is the distance between lines (μm). In FIG. 27, the central value diverges slightly from 100 μm because the rotation angle of the line block has not been corrected.

As a comparison between FIG. 28 and FIG. 27 reveals, in FIG. 28, the variation in the line spacing is reduced and it can be seen that the distance between lines approaches a uniform value. In other words, it can be seen that an excellent effect is obtained by averaging the line positions specified in respect of a plurality of ROIs which are staggered in regular fashion at uniform spacing.

Correction of Rotation Angle

Next, processing for correcting the rotation angle will be described. The processing for correcting the rotation angle is carried out on the basis of either one of the reference line blocks LCB or LCBb, for example.

Figure 29:
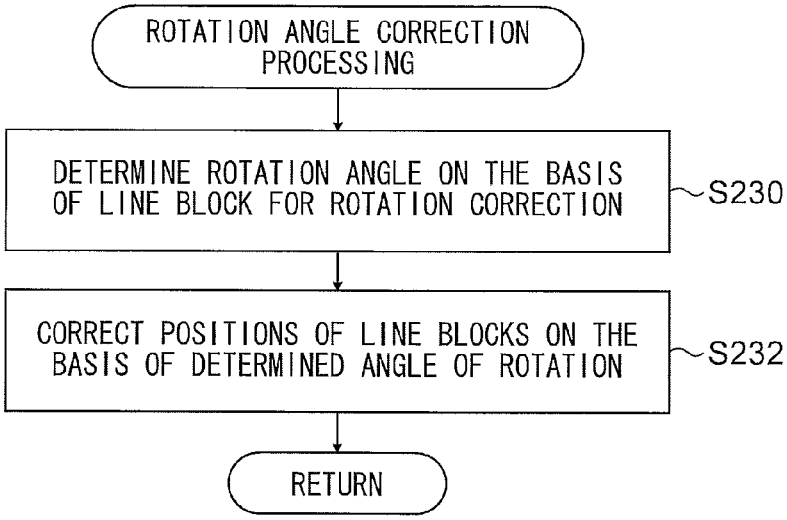
FIG. 29 is a flowchart showing a flow of rotation angle correction processing.

FIG. 29 is a flowchart showing a flow of rotation angle correction processing.

In the rotation angle correction processing, firstly, the rotation is specified on the basis of a line block for rotation correction (step S230). In other words, the rotation angle of the line pattern and the scanner reading coordinates (see θ in FIG. 15) is determined on the basis of the positional coordinates (line positions (X coordinates and Y coordinates) specified in step S20 as shown in FIG. 17) of lines which belong to different line blocks but are formed by the same nozzles, of the line positions of the line blocks included in the measurement chart. Then, the rotation of the line block positions (in other words, the line positions) is corrected on the basis of the rotation angle (θ) thus determined (step S232).

Calculation of Rotation Angle and Rotation Angle Correction

In this embodiment, the line blocks 0 and 4 in FIG. 9 are used as rotational correction line blocks. After determining the line positions for line blocks 0 to 4 as is described in step S204 of FIG. 18, the positional coordinates of lines created by the same nozzle are found in the line blocks 0 and 4.

Since, in this example, the lines are created in the line blocks 0 and 4 by the common nozzles with the nozzle numbers 0, 20, 40, 60, . . . the line positions corresponding to these common nozzle numbers can be utilized.

Suppose that the line position of the nozzle number 0 belonging to the line block 0 is $P_0@LB_0=(x_0_LB_0, y_0_LB_0)$ and the line position of the nozzle number 0 belonging to the line block 4 is $P_0@LB_4=(x_0_LB_4, y_0_LB_4)$.

The angle θ0 between the two positions can be determined from the relationship tan θ0=ΔY/ΔX, where ΔY0=y0_LB4−y0_LB0 and ΔX0=x0_LB4−x0_LB0.

The angles θ20, θ40, θ60, . . . are likewise found for other nozzle numbers, namely, nozzle 20, nozzle 40, nozzle 60, . . . and the average value of these angles is determined as the rotation angle θ. Rotational correction is performed using the rotation angle θ thus determined.

Each line position (x, y) for the line blocks 0 to 3 is converted using rotation matrix R (−θ) to find a line position (x', y') with the rotation angle canceled out.

Correction of Reference Line Positions

Next, the procedure advances from step S30 to step S60 in the flowchart in FIG. 17, and correction of the reference line positions and correction of the line block positions is carried out on the basis of the reference line position characteristic values. Firstly, the reference line position characteristic values are specified on the basis of a plurality of reference line blocks (see FIG. 9) (step S30 in FIG. 17).

Figure 30:
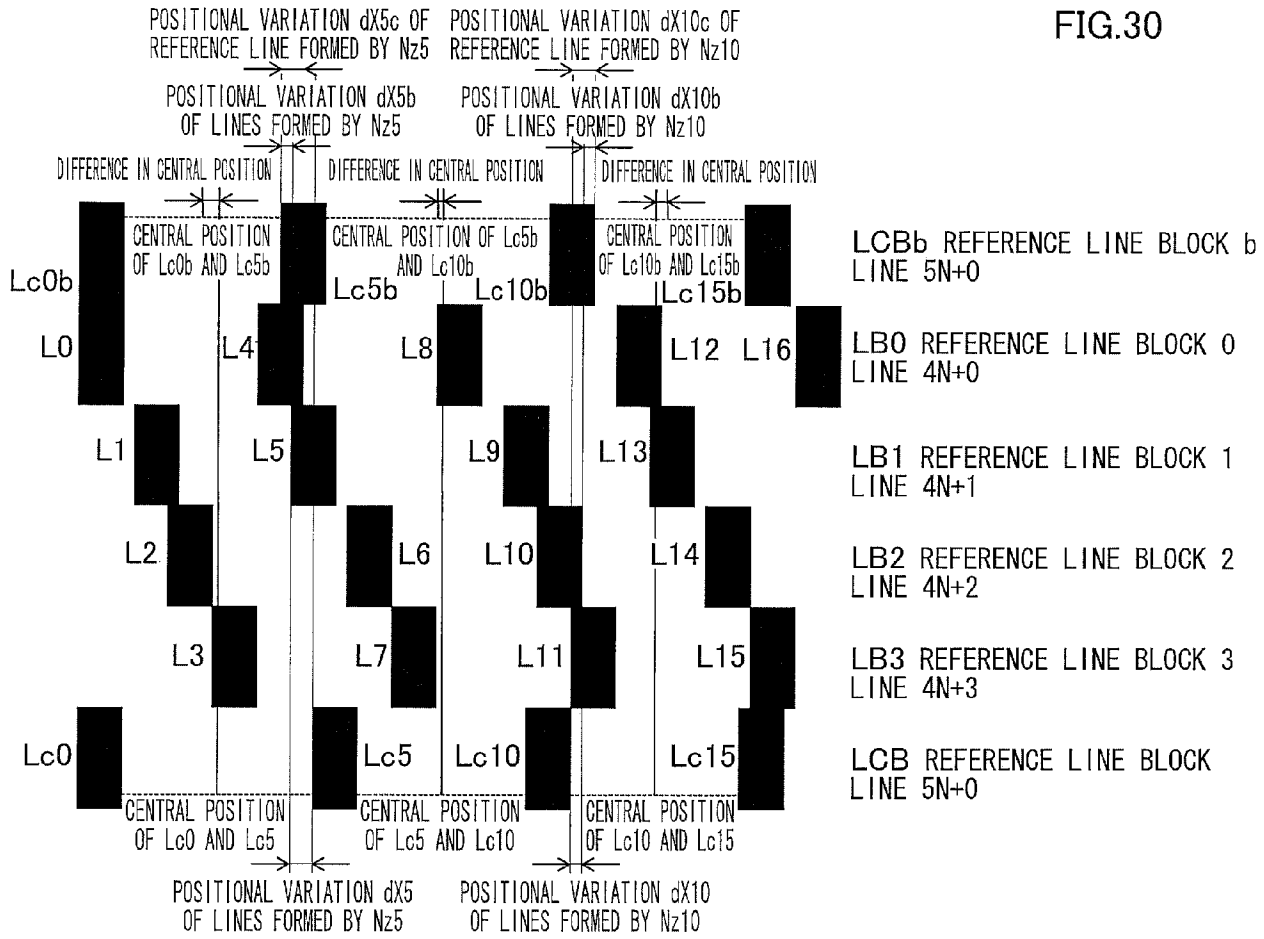
FIG. 30 is a diagram for describing processing for correcting reference line positions relating to one embodiment of the present invention.

FIG. 30 is a diagram for describing processing for correcting reference line positions relating to one embodiment of the present invention.

As shown in FIG. 30, in the present embodiment, the line blocks LB0 (4N+0, N=0), LB1 (4N+1, N=0), LB2 (4N+2, N=0), LB3 (4N+3, N=0), and so on, are formed on a recording paper, and furthermore two line blocks LCB and LCBb are formed as common line blocks (reference line blocks) corresponding to the line block LB0 (4N+0, N=0).

Figure 31:
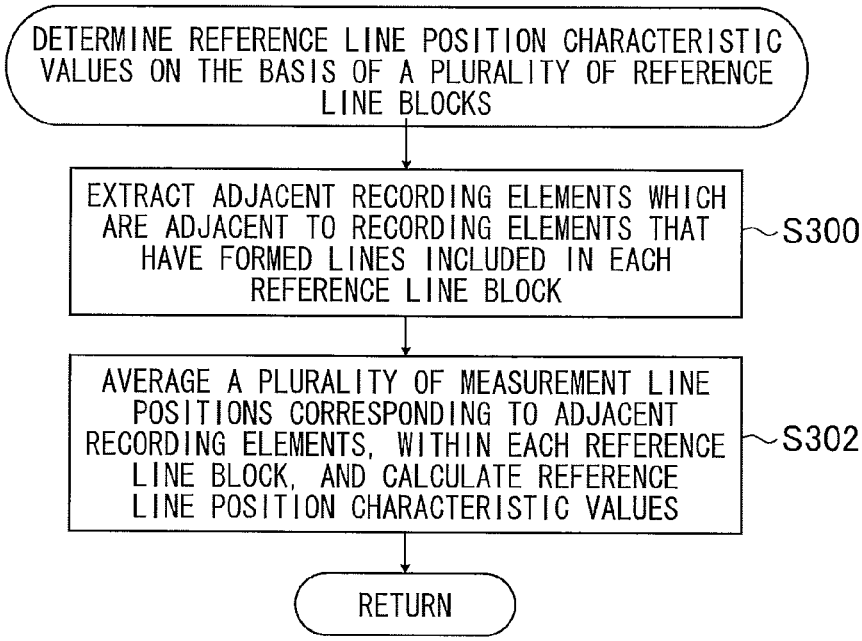
FIG. 31 is a flowchart showing the flow of processing for specifying a characteristic value of a reference line position.

FIG. 31 is a flowchart showing the flow of processing for specifying a characteristic value of a reference line position.

Firstly, adjacent recording elements which are adjacent to the recording elements which have formed the lines included in the reference line blocks are extracted (step S300).

In the example shown in FIG. 30, nozzle 0 and nozzle 5, nozzle 5 and nozzle 10, nozzle 10 and nozzle 15 . . . are the adjacent nozzles. The selection criteria for the adjacent recording elements are desirably specified in accordance with the characteristics of the scanner. For example, in a case where there is very severe distortion in the main scanning direction of the scanner, then it is desirable that there be no overlap in the combination of adjacent recording elements, for instance: nozzle 0 and nozzle 5, nozzle 10 and nozzle 15, and so on. Furthermore, in cases where there is minor distortion in the main scanning direction of the scanner, it is desirable to have an overlap, as in nozzle 0, nozzle 5 and nozzle 10, nozzle 5, nozzle 10 and nozzle 15, and so on. Below, the combinations of adjacent recording elements extracted as described above are taken as 0, 1, and so on, in series.

Next, a reference line position characteristic value is calculated by averaging the plurality of measurement line positions corresponding to the adjacent recording elements extracted at step S300 within each reference line block (step S302). In step S302, an average value is determined for each combination of adjacent recording elements and this average value is taken as a reference line position characteristic value.

The measurement positions belonging to the common line block LCB (5N+0) are xi@LCB, yi@LCB (i: nozzle number), and the measurement positions belonging to the common line block LCBb (5N+0) are xi@LCBb, yi@LCBb (i: nozzle number). If the X coordinates of the lines Lc0, Lc5, Lc10, Lc15 belonging to the common line block LCB are taken as x0@LCB, x5@LCB, x10@LCB, x15@LCB, and so on, and the X coordinates of the lines Lc0*b*, Lc5*b*, Lc10*b*, Lc15*b* belonging to the common line block LCBb are taken as x0@LCBb, x5@LCBb, x10@LCBb, x15@LCBb, and so on, then the reference line position characteristic values x_mk__0@LCB, x_mk__1@LCB, x_mk__2@LCB, . . . x_mk__0@LCBb, x_mk__1@LCBb, x_mk__2@LCBb, . . . of the combination 0 of adjacent recording elements (nozzle 0 and nozzle 5), the combination 1 (nozzle 5 and nozzle 10), the combination 2 (nozzle 10 and nozzle 15), and so on, are expressed respectively by the Expressions (8-1), . . . (9-1), . . . indicated below.

$$x_mk_0@LCB=(x0@LCB+x5@LCB)/2 \quad (8\text{-}1)$$

$$x_mk_1@LCB=(x5@LCB+x10@LCB)/2 \quad (8\text{-}2)$$

$$x_mk_2@LCB=(x10@LCB+x15@LCB)/2 \quad (8\text{-}3)$$

. . . .

$$x_mk_0@LCBb=(x0@LCBb+x5@LCBb)/2 \quad (9\text{-}1)$$

$$x_mk_1@LCBb=(x5@LCBb+x10@LCBb)/2 \quad (9\text{-}2)$$

$$x_mk_2@LCBb=(x10@LCBb+x15@LCBb)/2 \quad (9\text{-}3)$$

. . . and so on.

Next, the positions in the plurality of reference line blocks are corrected on the basis of the reference line position characteristic values (step S40 in FIG. 17).

Figure 32:
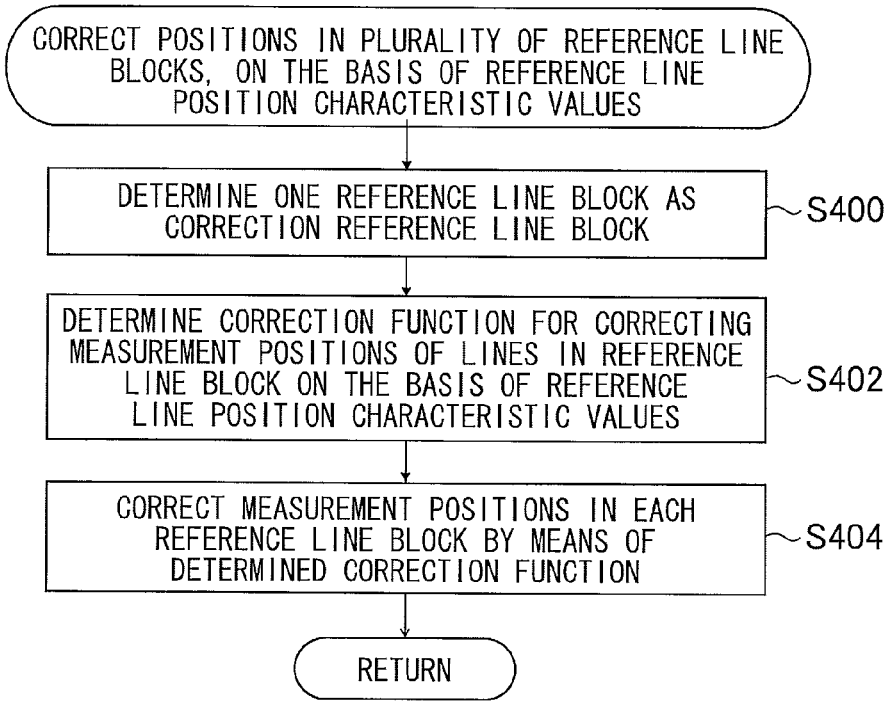
FIG. 32 is a flowchart showing a flow of processing for correcting positions in a reference line block.

FIG. 32 is a flowchart showing a flow of processing for correcting positions in a reference line block.

Firstly, one of the reference line blocks is designated as a correction reference line block (step S400). In step S400, a parameter x_mk_distance_j expressed by Expression (10) below is calculated for each reference block from the reference line position characteristic value x_mk_j@LCBn (here, n is a suffix for identifying the reference line block; in the present embodiment "n" is either "no symbol" or "b"), and the reference line block having the smallest statistical variation (for example, standard deviation) of the parameter x_mk_distance_j is selected as the correction reference line block.

$$x_mk_distance_j@LCBn=x_mk_j+1@LCBn-x_mk_j@LCBn \quad (10)$$

In the description given below, in order to simplify the explanation, the reference line block LCBb is selected as the correction reference line block.

Thereupon, taking a correction reference line block LCBb as the correction result, and a reference line block LCB as an uncorrected line block, a correction function h@LCB(x) for correcting the measurement position of each line in a reference line block LCB is determined on the basis of the reference line position characteristic value x_mk_j@LCBn (step S402). More specifically, the correction function h@LCB(x) converts the reference line position characteristic values of the reference line block LCB: INPUT_DATA@LCB={x_mk__0@LCB, x_mk__1@LCB, x_mk__2@LCB, . . . } to the reference line position characteristic values of the reference line block LCBb: OUTPUT_DATA@LCB={x_mk_0@LCBb, x_mk_1@LCBb, x_mk_2@LCBb, . . . }. For the function h@LCB (x) for correcting the measurement values in the reference line block described above, it is possible to use a function for a simple interpolation process (linear interpolation, spline interpolation) or a polynomial conversion function (a piecewise polynomial expression).

Next, the measurement positions in each reference line block are corrected by the correction function h@LCB(x) determined in step S402 (step S404). Below, the values obtained by converting the X coordinates {x0@LCB, x5@LCB, x10@LCB, . . . } of the lines Lc0, Lc5, Lc10, . . . in the reference line block LCB by means of the correction function h@LCB(x) are respectively taken to be {x'0@LCB, x'5@LCB, x'10@LCB, . . . }.

Thereupon, the corrected positions in the plurality of reference line blocks are averaged for each of the corresponding recording elements, and the statistical reference line positions are determined (step S50 in FIG. 17).

Figure 33:
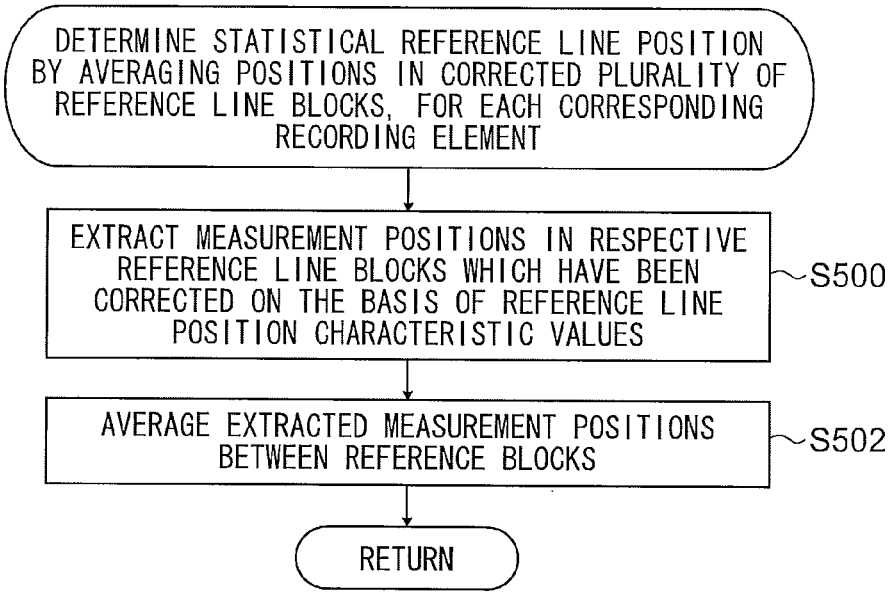
FIG. 33 is a flowchart showing the flow of processing for specifying a reference line position statistically.

FIG. 33 is a flowchart showing a flow of statistical determination processing for reference line positions.

Firstly, the measurement positions in the respective reference line blocks which have been positionally-corrected on the basis of the reference line position characteristic values in step S40 in FIG. 17 are extracted for each recording element (step S500).

Thereupon, the corrected measurement positions in the respective reference line blocks thus extracted are averaged between the reference blocks (step S502). The value xave_i@LCB determined in step S502 is set as the measurement position of a common nozzle (the statistical reference line position). In step S502, the measurement position data relating to the correction reference line block LCBb: x0@LCBb, x5@LCBb, x10@LCBb, x15@LCBb, . . . and the data relating to the reference line block LCB after correction by the correction function h@LCB(x): x'0@LCB, x'5@LCB, x'10@LCB, x'15@LCB, . . . are averaged for the respective nozzles 0, 5, 10, 15, . . . and the reference line positions shown in Expression (11) below—xave_0@LCB, xave_5@LCB, xave_10@LCB, xave_15@LCB, . . . —are calculated.

$$xave_i@LCB=(xi@LCBb+x'i@LCB)/2,\ (i\text{: nozzle number}) \tag{11}$$

Line Block Position Correction Processing

Figure 47:
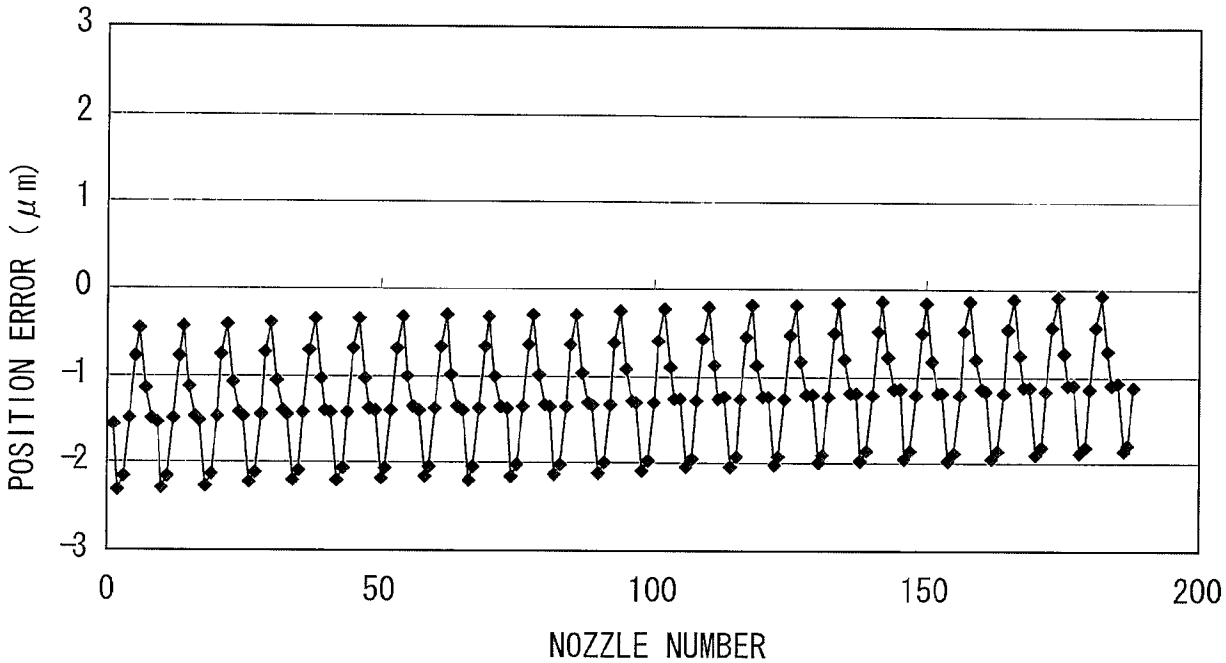
FIG.47 RELATED ART
FIG. 47 is a diagram showing an example of the measurement results of dot position error corresponding to the respective nozzles (after rotation angle correction) in the related art.
Figure 48:
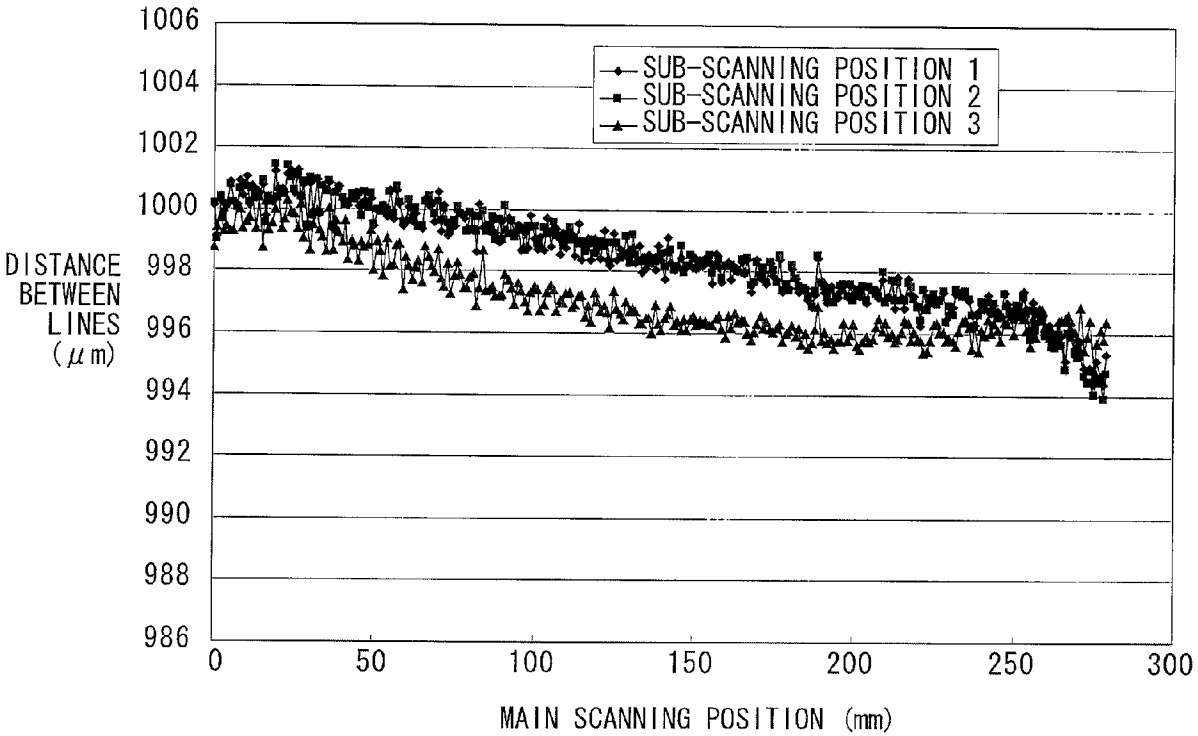
FIG.48 RELATED ART
FIG. 48 is a graph showing distortion in the main scanning direction, when an evenly spaced scale is read in, in the related art.

Next, the processing for line block position correction (step S60 in FIG. 17) will be described. Even after correction of the angle of rotation, the measurement values still contain offset error caused by the scanner, or other factors (see FIG. 47). Consequently, at step S60 in FIG. 17, processing for the positional correction is carried out between the line blocks.

Figure 34:
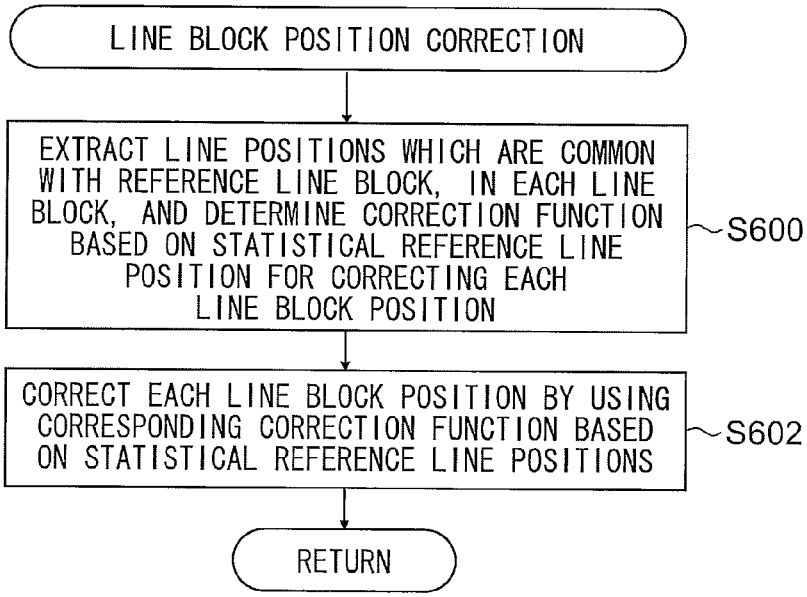
FIG. 34 is a flowchart showing a flow of line block position correction processing.

FIG. 34 is a flowchart showing a flow of line block position correction processing. In FIG. 34, positional correction processing is carried out for the line blocks (xave_0@LCB, xave_5@LCB, xave_10@LCB, xave_15@LCB, . . . ) corresponding to the respective nozzles 0, 5, 10, 15, . . . on the basis of the virtual line block that is determined on the basis of the reference line positions calculated by the processing in FIG. 29.

If the line block position correction processing flow in FIG. 34 is started, firstly, a virtual line block including virtual lines corresponding to the nozzles 0, 5, 10, 15, . . . is specified on the basis of the reference line positions xave_0@LCB, xave_5@LCB, xave_10@LCB, xave_15@LCB, . . . calculated by Expression (11) described above. Thereupon, the lines formed by nozzles which are common to the virtual line block are extracted respectively from the line blocks, and in respect of the extracted lines, a correction function which has the reference line position (X coordinate) as an output value and the each line block measurement position (X coordinate) as an input value is determined for each line block (step S600). As described below, the correction function is determined as a piecewise polynomial expression, by a least squares method. In this way, a correction function is obtained for each of the line blocks.

Thereupon, all of the measurement positions (X coordinates) of the respective line blocks are converted using the corresponding correction functions (piecewise polynomial expressions) thus determined (step S602).

Correction of Line Block Positions

A specific example of positional correction between line blocks is described here. In the present embodiment, the positions of line block 0 to line block 3 are each corrected, but here the positional correction for line block 0 is described; since the positional correction for the other line blocks is carried out in a similar fashion, description thereof is omitted here.

Firstly, a virtual line block 4' including virtual lines corresponding to the nozzles 0, 5, 10, 15, . . . is specified on the basis of the reference line positions xave_0@LCB, xave_5@LCB, xave_10@LCB, xave_15@LCB, . . . calculated by Expression (11) described above. Thereupon, the line measurement positions of the nozzle numbers which are the common between the line block 0 and the virtual line block 4' (i.e. nozzle numbers 0, 5, 10, 15 . . . ) are extracted.

If the measurement positions (X coordinates) in the line block 0 are taken as lb0_x0, lb0_x5, lb0_x10, lb0_x15, . . . , then the measurement positions of the nozzle numbers which are common to both blocks are as indicated below.

X={lb0_x0, lb0_x20, lb0_x40, lb0_x60 . . . }

Y={xave_0@LCB, xave_20@LCB, xave_40@LCB, xave_60@LCB . . . }

A correction function f0 giving y=f0(*x*) is specified using the positions of these common nozzle numbers.

Regarding the correction functions, if the variation factors relating to the scanner are a cause of offset only, then $a_0$ can be specified by a least-squares method for $Y=X+a_0$ (zeroth-order function), and if slight rotation of the carriage is a cause, then $a_0$ and $a_1$ are specified by a least-squares method for $Y=a_1\times X+a_0$ (first-order function). In respect of paper deformation, a correction function for the deformation can be used. If the paper deformation and the scanner factors are combined, then a paper deformation model×scanner deformation model can be chosen for the correction function.

In general, it is possible to use a polynomial expression, $Y=\Sigma a_i\times X\hat{}i$ (i=0, . . . n), where the "^" symbol represents a power calculation.

Problems when Using a High-Order Polynomial Expression

Figure 35:
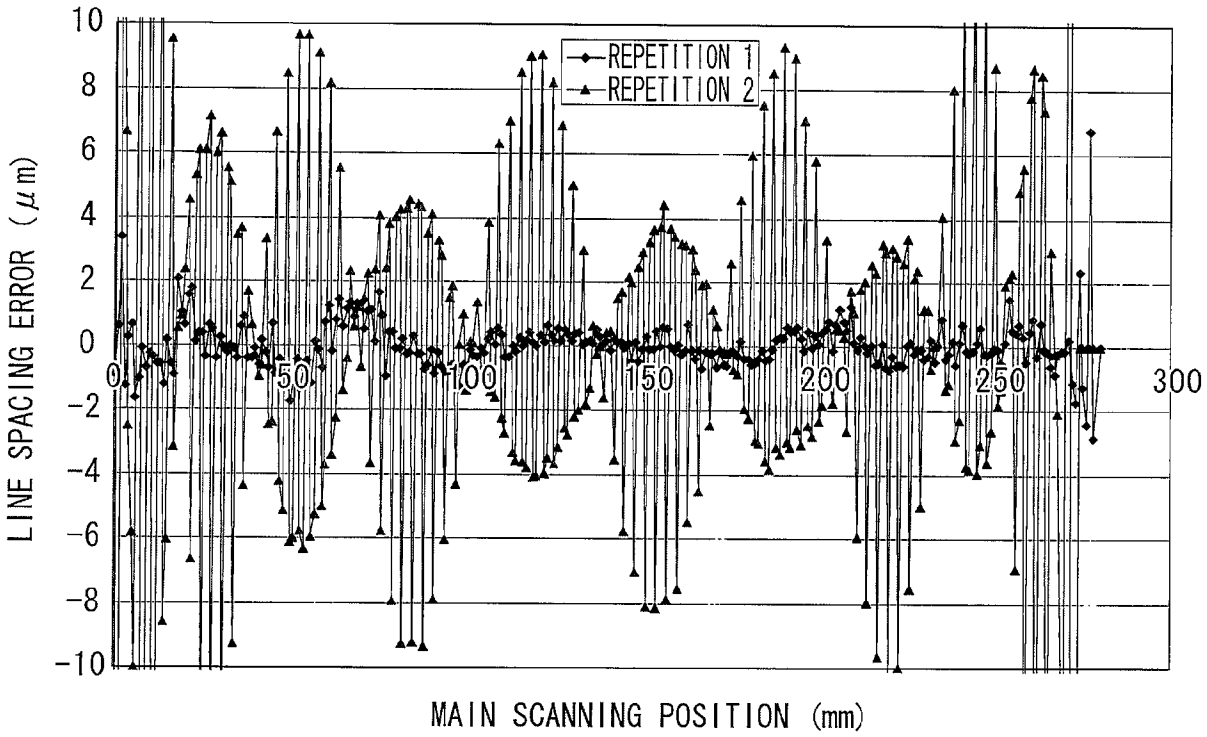
FIG. 35 shows the results of correction processing when repeatedly measuring the same test pattern using a high-order polynomial function for positional correction (a correction function) between line blocks.

FIG. 35 shows the results of correction processing when repeatedly measuring the same test pattern using a high-order polynomial function for positional correction (a correction function) between the line blocks. The horizontal axis indicates the main scanning direction position and the vertical axis indicates the line spacing error.

As shown in FIG. 35, a phenomenon occurs whereby even when the same test pattern is measured, the measurement values are not stable. In "repetition 1" in FIG. 35, it is possible to measure the test pattern with good accuracy, but in "repetition 2", the measurement value shows periodic positive or negative error. This phenomenon is an oscillatory effect which is characteristic of choosing a high-order polynomial expression.

Figure 49:
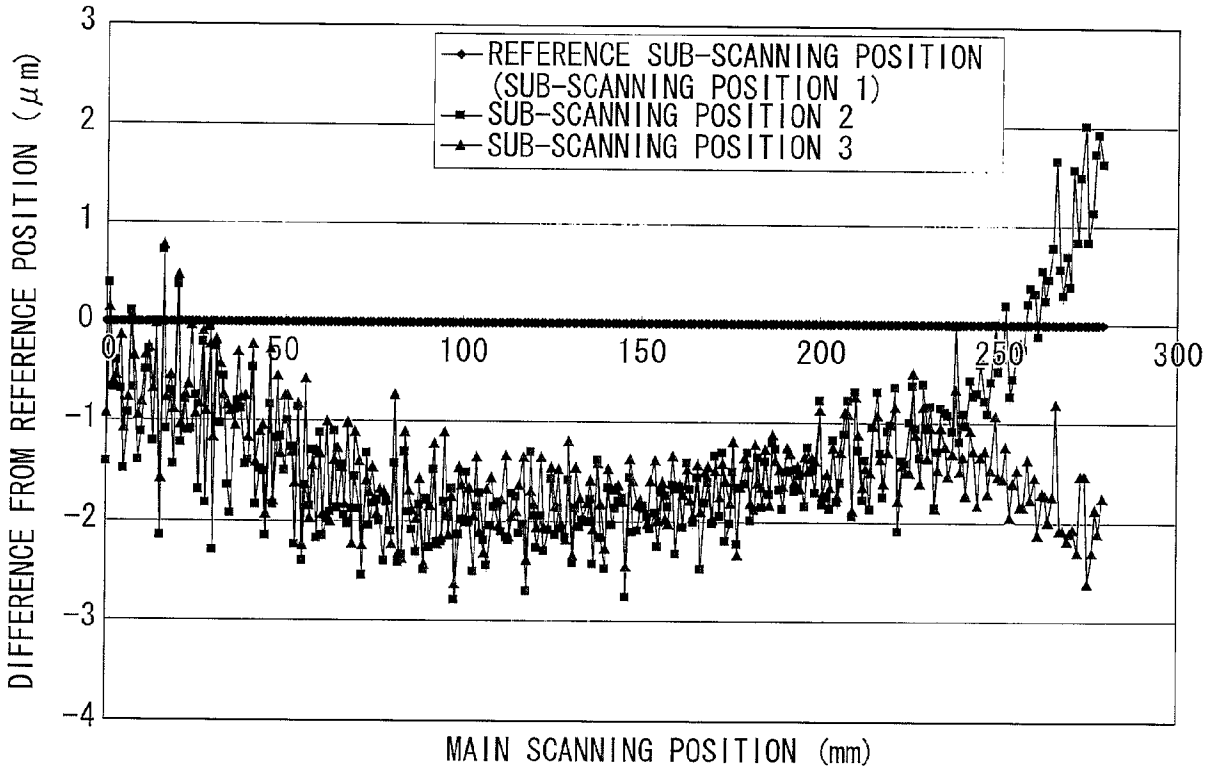
FIG.49 RELATED ART
FIG. 49 is a graph showing distortion in the main scanning direction which differs with the sub-scanning position in the related art.

It is surmised that an oscillatory effect of this kind has a high possibility of occurring when the difference in the main scanning direction positional distortion characteristics between respective sub-scanning positions contains a slight periodic component, as in FIG. 49.

Desirably, instead of using a high-order polynomial function in respect of scanner characteristics of this kind, a low-order polynomial function is selected in a piecewise fashion as the correction function.

Description of Correction Function Based on Piecewise Polynomial Expression

Figure 36:
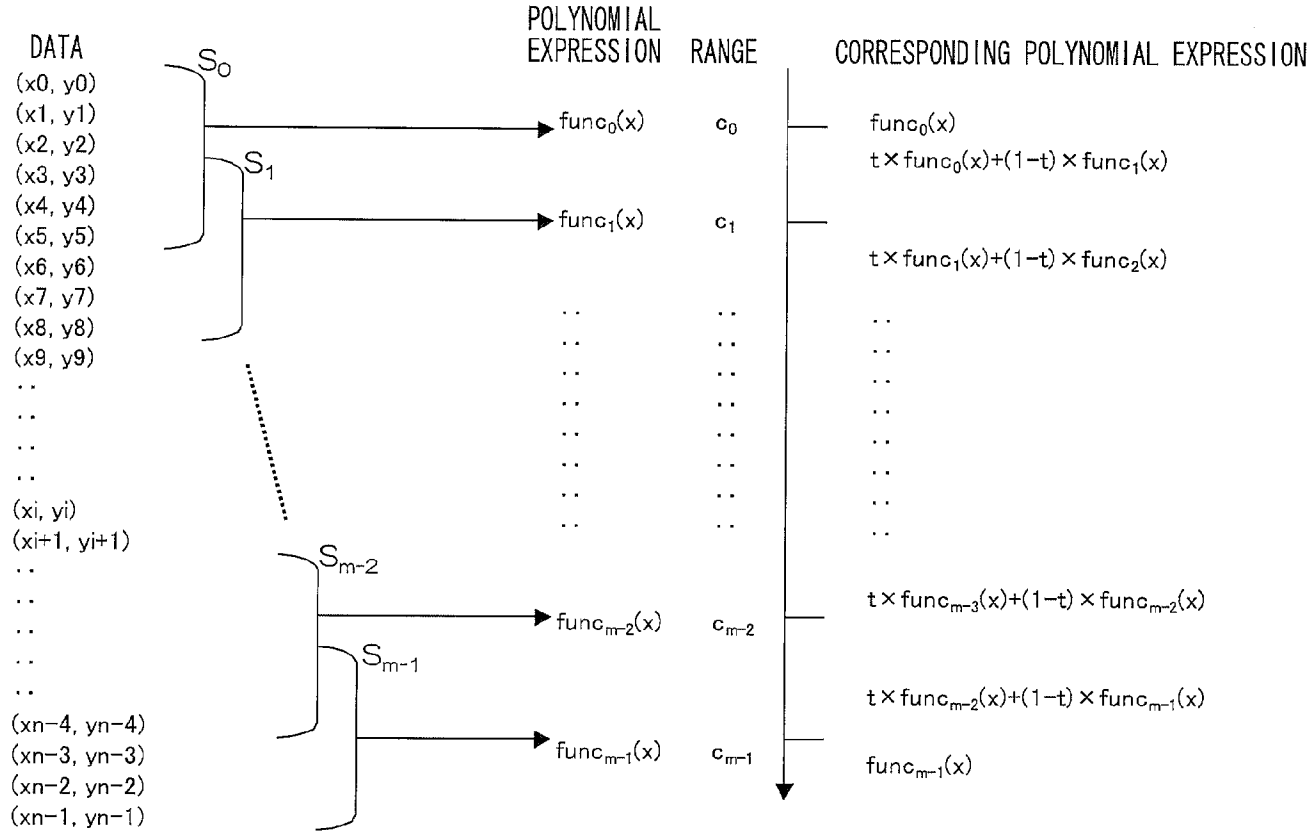
FIG. 36 is an illustrative diagram of a correction function based on a piecewise polynomial expression.

FIG. 36 is an explanatory diagram of correction functions based on a piecewise polynomial expression.

In the data sequence (xi, yi) shown on the left-hand side of FIG. 36 (where i=0, 1, 2, . . . n−1), a data group of a prescribed range (piece) is treated as one group (in this example, six consecutive data groups are taken as one piece unit), and a polynomial expression $func_j(x)$ (where j=0, 1, 2, . . . m−1) is associated respectively with the data sets $S_0$, $S_1$, . . . $S_{m-1}$ of each piece (n and m are natural numbers).

The data sets $S_0$, $S_1$, . . . $S_{m-1}$ of the respective pieces are made to overlap with each other partially, between adjacent pieces. The center values $C_0$, $C_1$, $C_{m-2}$ of the data sets of each piece $S_0$, $S_1$, . . . $S_{m-1}$ are determined, and corresponding polynomial expressions are defined for respective piece ranges set to have boundaries at these values $C_0$, $C_1$, . . . $C_{m-2}$. The corresponding polynomial expression for any particular piece range is a weighted average, using ratio t, of the two polynomial expressions $func_j(x)$ and $func_{j+1}(x)$ which relate to that range.

A specific example of application to the measurement data of the test pattern shown in FIG. 9 is given below.

The position data of each line belonging to any one line block is data which is virtually equally spaced in the X coordinate direction. In the case of virtually equally spaced data of this kind, a prescribed number (for example, 6) consecutive data elements taken from the end of the data sequence are extracted as the first data set $S_0$.

The position data (X coordinates) of the lines recorded by the same nozzles (common nozzles) in the line block 0 and the line block 4 are extracted as described below:

X0={lb0_x0, lb0_x20, lb0_x40, lb0_x60, lb0_x80, lb0_x100}

Y0={xave_0@LCB, xave_20@LCB, xave_40@LCB, xave_60@LCB, xave_80@ LCB, xave_100@LCB}

The elements in the set X0 belong to the line block 0, and are data for the positions corresponding to the nozzle numbers 0, 20, 40, 60, 80 and 100.

The elements in the set Y0 belong to the virtual line block 4', and are data for the positions corresponding to the common nozzle numbers 0, 20, 40, 60, 80 and 100. The elements in set X0 form the input values of the correction function, and the elements in set Y0 form the output values of the correction function. In other words, correction is applied in such a manner that the set X0 coincides with the set Y0.

The next data set $S_1$, which is partially overlapped with this data set $S_0$, is as follows:

X1={lb0_x60, lb0_x80, lb0_x120, lb0_x140, lb0_x160, lb0_x180}

Y1={xave_60@LCB, xave_80@LCB, xave_120@LCB, xave_140@LCB, xave_160@LCB, xave_180@LCB}

Thereafter, data sets $S_2$, S3 and so on are extracted similarly, in a partially overlapping fashion.

In other words, the whole of the data sequence that is to be corrected is progressively divided into partial sets $S_0$, $S_1$, $S_2$, . . . of a prescribed range (here, each partial set has 6 data elements, but this number can be set as desired).

Thereupon, the corresponding approximate polynomials $func_0(x)$, $func_1(x)$, $func_2(x)$, are determined by a least-squares method, respectively for the data sets $S_0$, $S_1$, $S_2$, and so on.

Moreover, for each partial set, a roughly central position (center value) is determined. In other words, the center value $C_0$ of the data set $S_0$ is specified. $C_0$ is taken as the average value of X0. The center value $C_1$ of the data set $S_1$ is similarly determined $C_1$ is taken as the average value of X1. Thereafter, similarly, the center value Ci (where Ci is the average value of Xi) is specified respectively for all of the data groups Si.

When determining the approximate polynomial expressions corresponding to the data sets $S_0$, $S_1$, $S_2$, . . . by the least squares method, the weighting of the least squares calculation can be determined in accordance with the distance rij from the central value $C_i$ corresponding to the data set $S_i$.

For example, the distance rij from $C_i$ of the element xj of data set $S_i$ is defined as:

$$rij=|xj-C_i|,\ xj\in S_i.$$

Taking the maximum value of rij as rmaxj, the weighting Wj is defined using the ratio (rij/qj) of rij to qj (qj=rmaxj×2) as follows:

$$wj=(1-(rij/qj))/(1+(rij/qj)).$$

It is possible to determine approximate functions corresponding to the respective data sets $S_0$, $S_1$, $S_2$, . . . by means of a least squares method incorporating this weighting Wj.

The approximate function corresponding to the data set $S_0$ is $func_0(x)$, the approximate function corresponding to the data set $S_1$ is $func_1(x)$ and similarly thereafter, the approximate function corresponding to $S_i$ is $func_i(x)$.

The measurement positions (X coordinates) of the line block 0 {lb0_x0, lb0_x4, lb0_x8, . . . } are converted using the thus determined group of correction functions $f\mathbf{0}(x)$={$func_0(x)$, $func_1(x)$, $func_2(x)$, . . . }.

Next, a conversion sequence (correction processing) using piecewise polynomial expressions will be described.

The input value is taken to be xk. Firstly, the input value is classified to one of the following cases, depending on the relative magnitude of xk and the values of c0, c1, c2, . . . .

[1] If xk=c0

[2] If $c_l$=xk=$c_{l+1}$ (where 1 is any integer from 0 to m−1)

[3] If $c_{m-1}$=xk

A case where the terms in [1] or [3] are equal can also be included in case [2].

In the case of [1], the conversion result yk is found from yk=$func_0$(xk) by inputting xk into the corresponding approximate polynomial expression $func_0(x)$.

In the case of [2], the conversion result yk is derived as follows by using the approximate polynomial expressions $func_l(x)$ and $func_{l+1}(x)$ corresponding respectively to $c_1$ and $c_{l+1}$, and the ratio t which is determined from the relative positions of $c_l$, $c_{l+1}$ and xk:

$$t=(c_{l+1}-xk)/(c_{l+1}-c_1)$$

$$yk=t\times func_l(xk)+(1-t)\times func_{l+1}(xk)$$

By combining the two polynomial expressions in a suitable ratio in respect of the overlapping region, it is possible to achieve smooth progression between the piecewise functions.

In the case of [3], the conversion result yk is found from yk=$func_{m-1}$(xk) by inputting xk to the corresponding approximate polynomial expression $func_{m-1}(x)$.

In this way, the measurement positions (X coordinates) of the line block 0 {lb0_x0, lb0_x4, lb0_x8, and so on} are converted.

A correction function f1($x$) is determined in a similar manner for the line block 1 and the line block 4 shown in FIG. 9, and the correction function f1($x$) thus determined is used to convert the measurement positions (X coordinates) of the line block 1 {lb1_x1, lb1_x5, lb1_x9, . . . }.

Correction functions f2($x$) and f3($x$) are determined similarly in respect of the line blocks 2 and 3, and the correction functions f2($x$) and f3($x$) thus determined are used respectively to convert the measurement positions (X coordinates) of the line blocks 2 and 3.

In this way, since the positions of the respective line blocks are corrected with reference to the position of the same reference line block, then it is possible to reduce positional error between the line blocks. Furthermore, even if the amount of deformation of the paper is different in the line block 3 compared to the line block 0, it is still possible to reduce measurement error due to deformation of the paper since correction is made with respect to the reference line block.

In particular, since good approximation is possible even if the number of orders of the piecewise polynomial expression described above is restricted to 3 to 5, then it is possible to prevent the occurrence of an oscillatory effect which is a concern when using a high-order polynomial expression as shown in FIG. 36.

For example, if it is sought to achieve an approximation for a page-wide (full-wide) head having A3 width and 1200 DPI, by using a single high-order polynomial expression, then the number of orders becomes 18 to 20 and an oscillatory effect is liable to occur, but according to the present embodiment, since a low-order polynomial expression of 2 to 5 orders is used, then the oscillatory effect is suppressed and correction which matches the distortion (deformation) can be achieved.

In the present embodiment in FIG. 36, three data elements are overlapped between the adjacent pieces, but there is no particular restriction on the amount of overlap. The greater the amount of data that is overlapped, the smoother the correction functions, whereas if the amount of data overlapped is reduced, then the correction functions obtained reflect the effects of the individual polynomial expressions corresponding to the respective pieces more strongly.

Consolidation of Line Blocks

Next, the processing for consolidating the positions corrected by the line position correction functions of the respective line blocks shown in step S70 in FIG. 17 will be described.

In this consolidation processing, the X coordinates of the positions of the respective line blocks which have been corrected by the fixed positional distortion correction table, are arranged into nozzle number order. The result of this arrangement into nozzle number order is the dot deposition positions of the respective nozzles.

According to the dot position measurement method of the present embodiment, it is possible to measure positions with high precision, by correcting the positional distortion in the scanner main scanning direction at the sub-scanning position where the reference line block has been read, by means of a fixed main scanning direction positional distortion correction table which has been determined previously. It is relatively easy to acquire a one-dimensional scale used with the object of creating a fixed correction parameter for correcting one-dimensional positional distortion of this kind, and such a one-dimensional scale is inexpensive compared to a two-dimensional scale.

Positional Distortion Correction Processing

Next, processing for correcting positional distortion (step S80 in FIG. 17) is carried out.

Figure 37:
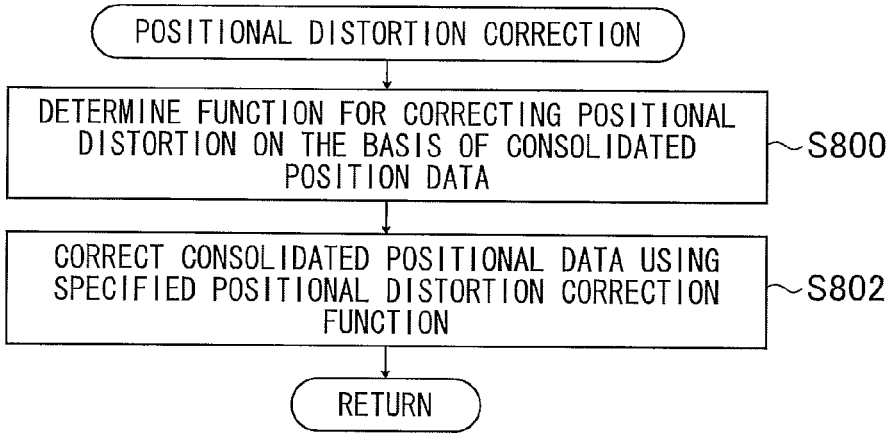
FIG. 37 is a flowchart showing a flow of positional distortion correction processing.

FIG. 37 is a flowchart showing a flow of positional distortion correction processing.

When the positional distortion correction sequence in FIG. 37 is started, firstly, a function for correcting the positional distortion is specified on the basis of the positional data which has been consolidated at step S70 in FIG. 17 (step S800). The consolidated positional data is then corrected using the positional distortion correcting function thus specified (step S802).

When the processing in step S802 in FIG. 37 has been completed, the procedure exits the sub-routine in FIG. 37 and returns to the general sequence in FIG. 17 and the process ends.

Here, a specific example of the calculation method used in steps S800 and S802 will be described.

First Example of Positional Distortion Correction Processing

Firstly, the consolidated positional data sequence obtained at step S70, R1={$xx_0$, $xx_1$, $xx_2$, $xx_3$ . . . $xx_{m-1}$} is converted to a data sequence R2 of spacing values. In other words, the difference between two adjacent data elements, xx_i+1 and xx_i, is calculated as a spacing value ssi, to yield the data set R2.

Figure 38:
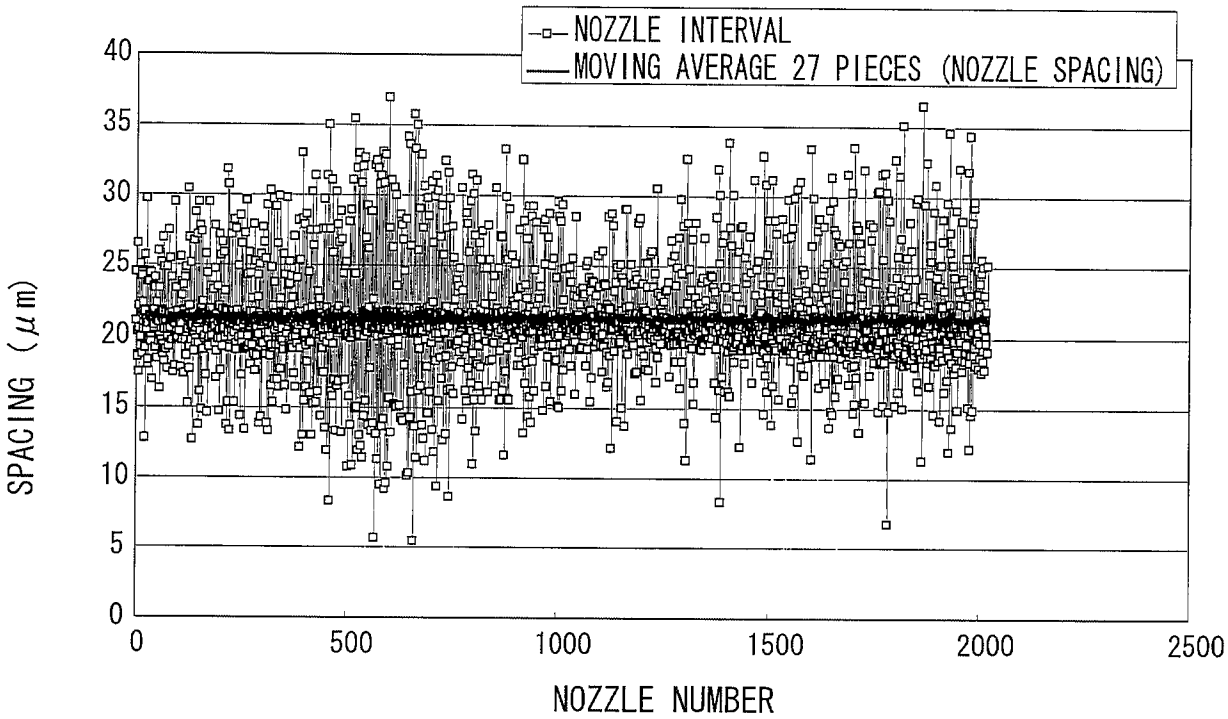
FIG. 38 is a graph showing an example of a data set R2 of spacing values (nozzle intervals)

FIG. 38 is a graph showing an example of the data set R2 of spacing values (nozzle intervals).

$$R2=\{ss_0,ss_1,ss_2, \ldots ,ss_{m-2}\},\ ss_i=xx_i+1-xx_i$$

A data set LR2 is then created by removing the high-frequency component from the data sequence R2 of spacing values ssi thus obtained, by means of a moving average or low-pass filtering process. FIG. 38 also shows the results of a moving average for 27 data pieces.

For example, if the moving average of the "2×nn+1" points is used (where "nn" is a natural number), then the data set LR2 is expressed as follows.

$$LR2=\{lss_0,lss_1,lss_2, \ldots ,lss_{m-2}\}$$

$$lss_i=\Sigma(s_{i+k})/(2\times nn+1),\ k=-nn, \ldots ,nn$$

Alternatively, if a low-pass filtering process is adopted, then the data set LR2 is expressed as follows.

$$LR2=\{lss_0,lss_1,lss_2, \ldots ,lss_{m-2}\}$$

$$lss_i=\Sigma lpf_k\times s_{i+k},\ k=-nn, \ldots ,nn$$

where $lpf_k$ is the coefficient of the low-pass filter.

Since the data set LR2 from which high-frequency components have been removed is a data sequence of spacing values in this way, then in order to convert this to a positional data sequence, the data sequence R2X of the successive cumulative sums of LR2 is calculated.

$$R2X=\{r2x_0,r2x_1,r2x_2, \ldots ,r2x_{m-1}\}$$

$$r2x_i=\Sigma(lss_k),\ k=0, \ldots ,i-1, \text{ where } r2x_0=0$$

The calculation for determining the set R2X corresponds to the reverse calculation of the step for converting the consolidated position data sequence R1 to the data sequence R2 of spacing values. The data sequence R2X determined in this way indicates the distortion characteristics in the main scanning direction of the scanner.

On the other hand, the data sequence R2Y of ideal positions (data sequence of ideal nozzle spacing of nozzle number X) is determined on the basis of the nozzle spacing.

If the nozzle pitch (dot deposition positions) is ideally a uniform pitch, then the nozzle pitch is taken to be LL. In this case, the data sequence R2Y of ideal positions is calculated by the following equations.

$$R2Y=\{r2y_0,r2y_1,r2y_2,\ldots,r2y_{m-1}\}$$

$$r2y_i=LL\times i,\text{ where } i=0,1,2,\ldots,m-1$$

The original consolidated position data sequence R1 is corrected by using a correction function which has the data sequence R2X as an input data sequence and the data set R2Y as an output data sequence.

For the correction function, it is possible to use linear interpolation, cubic interpolation, spline interpolation, or the like.

Second Example of Positional Distortion Correction Processing

Furthermore, as a further method, it is also possible to employ a method such as the following.

If it is supposed that the depositing position errors of the nozzles have a normal probability distribution, with respect to the ideal positions, then it is possible to determine the consolidated position data sequence R1 obtained at step S70 in FIG. 17 by using the correction function (polynomial expression) corresponding to the positional distortion in the main scanning direction of the scanner as an approximation by a least squares method, with respect to the position data sequence R1.

In other words, a function is determined by taking the ideal nozzle positions as the input values X and the data sequence R1 as the output values Y.

The data sequence of the ideal nozzle positions (input values X) is as follows.

$$X=\{xx_0,xx_i,xx_2,\ldots,xx_{m-1}\}$$

$$xx_i=LL\times i,\text{ where } i=0,1,2,\ldots,m-1$$

Figure 39:
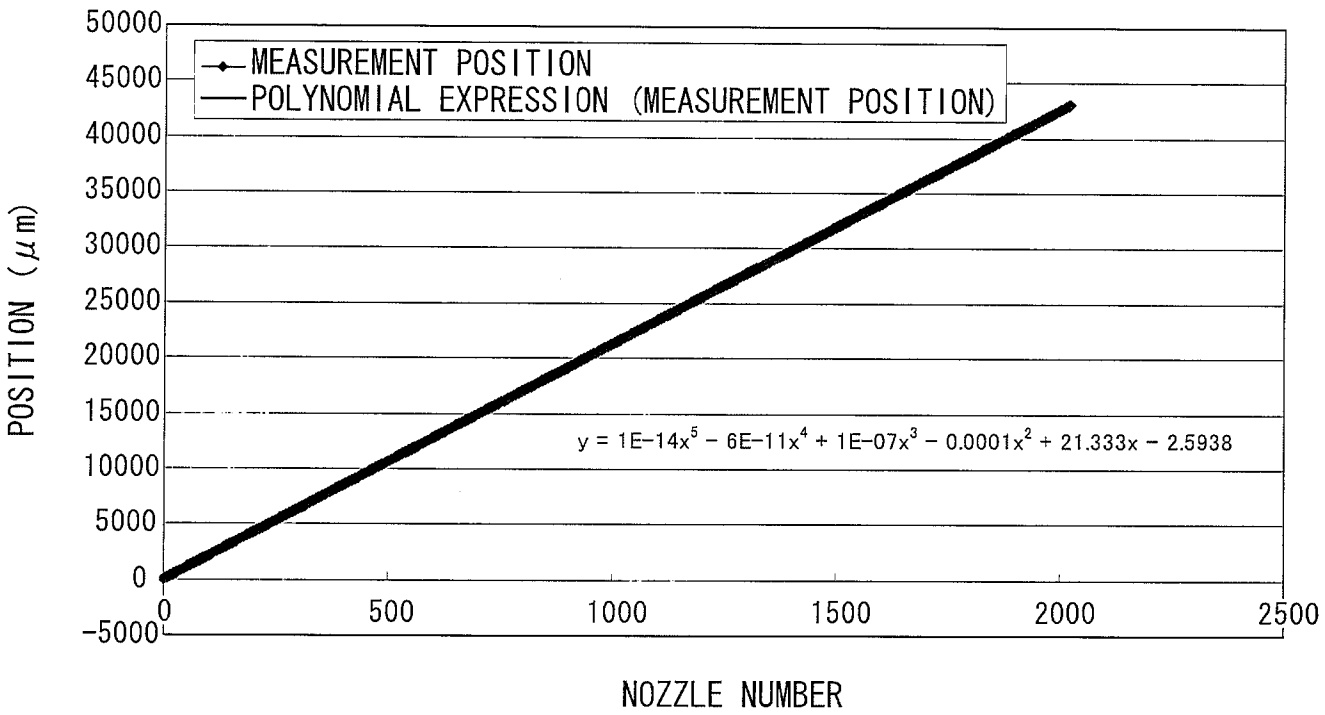
FIG. 39 is a diagram showing an example of measurement position data and an approximate polynomial expression.

An approximate polynomial expression func(x) is determined by a commonly known method for the consolidated position data sequence R1={yy0, yy1, yy2, . . . , $yy_{m-1}$}. FIG. 39 is a graph showing an example of measurement position data and an approximate polynomial expression.

In this approximate polynomial expression, similarly to FIG. 36, it is also possible to employ a piecewise polynomial expression.

Thereupon, the differences between the position data sequence R1 and the corresponding approximate expression are determined, and corrected positions (positions after correction) are given by adding the differences thus determined to the ideal nozzle positions.

$$(\text{Corrected position})=yy_i-\text{func}(xx_i)+xx_i$$

The method relating to this second example can also be applied even if the nozzle spacing is not uniform. In this case, $xx_i$ should be substituted for a data sequence of the ideal nozzle positions.

Determination of Dot Positions

The X coordinates of the line positions corrected as described above are the dot positions corresponding to the nozzle number. In this way, variation information about the dot depositing positions from each nozzle is obtained and can be used in calculation processes such as non-uniformity correction.

Measures for Further Improving Measurement Accuracy

Regarding the line block 4 which forms a reference, it is desirable to increase the overlap of the ROI, increase the line length and broaden the averaged range, with the object of improving accuracy in particular. Furthermore, a beneficial effect in reducing the effects of locality in the scanner is obtained if a plurality of line blocks 4 (reference line blocks) are provided in the measurement chart and the positions obtained by statistical processing of a plurality of measurement results are used as the position of the reference line block.

Further Embodiment of Positional Distortion Correction Processing

In the present embodiment, the measurement positions after correction of the line block positions are subjected to consolidation processing (step S70 in FIG. 17), whereupon positional distortion correction processing (step S80) is carried out, but it is also possible to adopt a mode in which, instead of the positional distortion correction processing, processing for correcting fixed distortion of the reference line block is carried out after the line block position correction processing in step S60.

Fixed Distortion Correction of Reference Line Block

More specifically, in the present embodiment, processing for correcting fixed distortion of the reference line block (FIG. 42) is carried out after the line block position correction processing (FIG. 34) has been completed.

This processing corrects the positions (X coordinates) converted by the correction functions (piecewise polynomial expressions) described above, using a fixed positional correction table corresponding to the reference line block (this table is referred to as the "fixed positional distortion correction table").

Next, the details of processing for correcting fixed distortion of the reference line block will be described.

Before carrying out correction of the fixed distortion of the reference line block, it is necessary to first create a fixed positional distortion correction table. More specifically, the positional distortion in the main scanning direction of the positions corresponding to the reference line block is measured in advance by reading in a test pattern with the scanner used for measurement, and this information is stored in the form of a fixed positional distortion correction table.

The fixed positional distortion correction table is acquired as described below.

A one-dimensional scale of equally spaced lines is prepared, and this one-dimensional scale is placed at a position (in the sub-scanning direction) corresponding to the reference line block on the test pattern, and the one-dimensional scale is read in with the scanner used for correction. Thereupon, the respective positions read in from the one-dimensional scale are determined on the basis of the scanner coordinates, and taking these results as input values and taking the actual values of the equally spaced lines as output values, the relationship between the input and output values can be determined by applying noise removal processing.

For example, it is possible to determine an approximate polynomial expression from the input-output value relationship and to set this approximate polynomial expression as a fixed positional distortion correction table.

Figure 40:
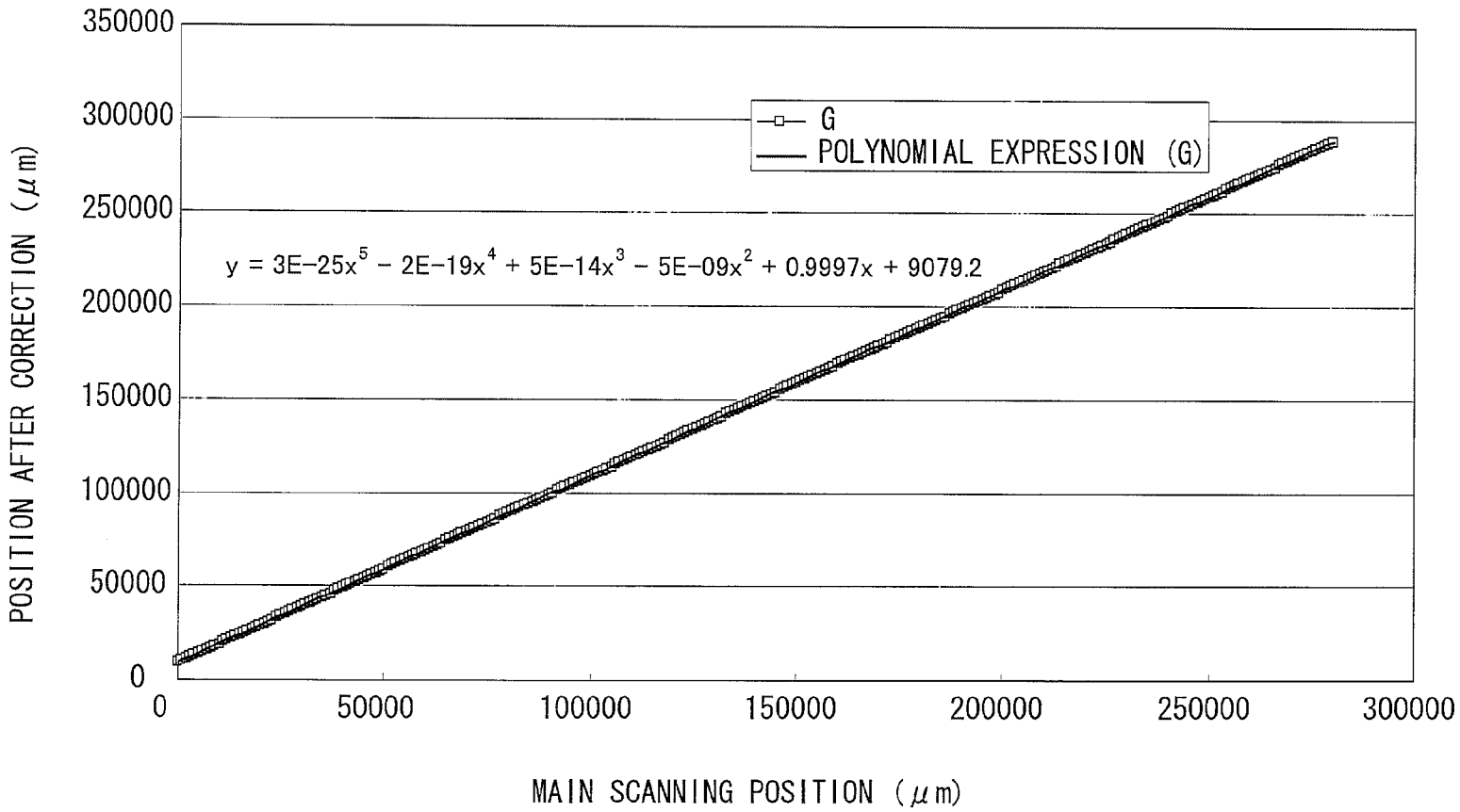
FIG. 40 is a diagram illustrating a fixed positional distortion correction table for respective RGB channels of a color scanner.
Figure 41:
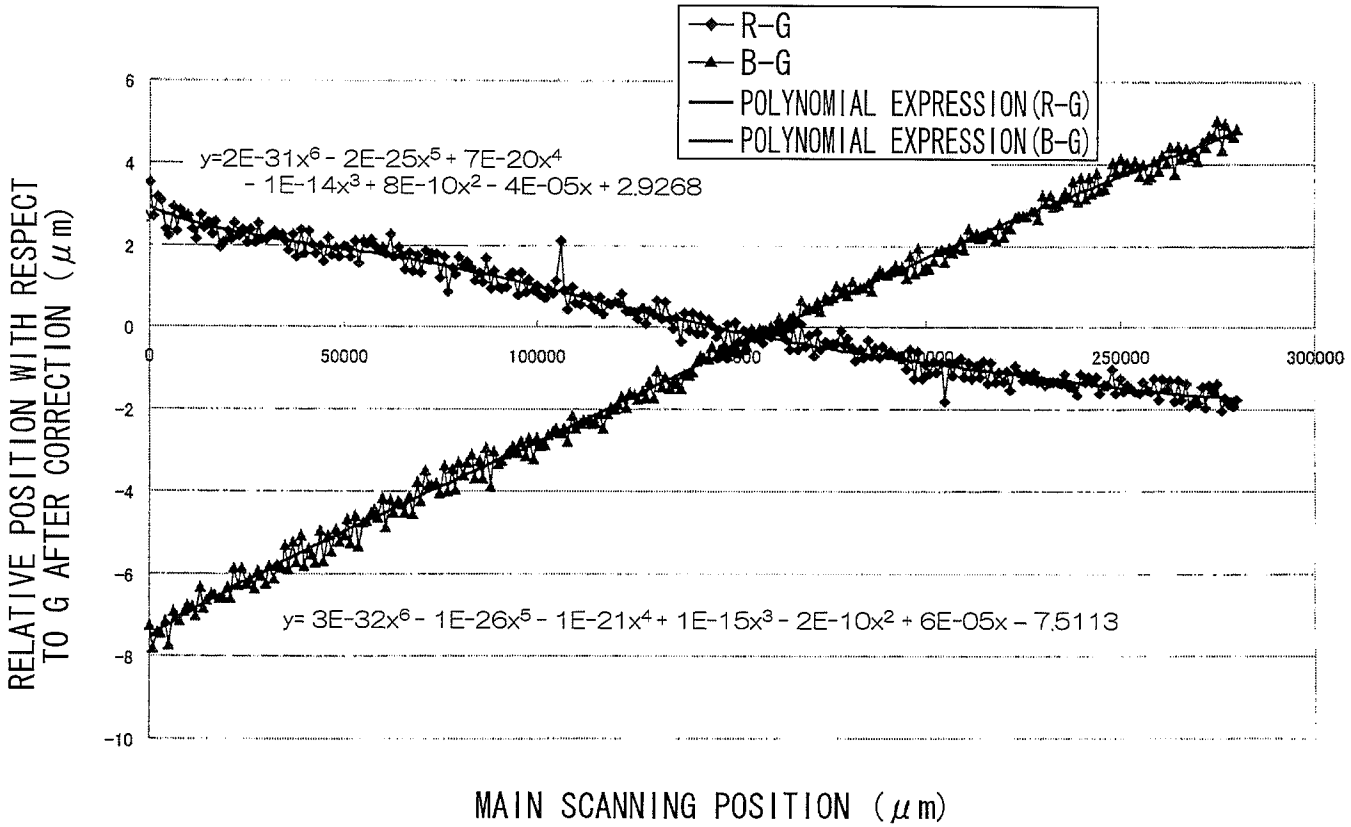
FIG. 41 is a diagram illustrating a fixed positional distortion correction table for respective RGB channels of a color scanner.

FIGS. 40 and 41 are graphs for describing the fixed positional distortion correction tables for respective RGB channels of a color scanner.

FIG. 40 shows an approximation of the input values and output values of the G channel of a color scanner, using a 6th-order polynomial expression, when the lines of the one-dimensional scale are formed by a coloring material having virtually uniform spectral reflectivity. Furthermore, FIG. 41 shows a fixed positional distortion correction table in which the respective differentials between the position data of the G channel and the R channel and that of the B channel are determined, and these differential values are approximated by a polynomial expression.

For the positions read in the G channel, the fixed positional distortion correction table for the G channel (FIG. 40) is used directly. On the other hand, for the positions read in the R channel, a table which sums together the fixed positional distortion correction table (FIG. 40) for the G channel and a fixed positional distortion correction table for the differential (R−G) (FIG. 41) is used. For the positions read in the B channel, a table which sums together the fixed positional distortion correction table (FIG. 40) for the G channel and the fixed positional distortion correction table for the differential (B−G) (FIG. 41) is used. In FIGS. 40 and 41, the term "E−α" in the polynomial expression means the (−α)th power of ten.

The fixed positional distortion tables such as that shown in FIGS. 40 and 41 are stored in advance in a storage device, such as a memory, and the table is read out in order to perform correction when carrying out the reference line block fixed distortion correction processing.

Figure 42:
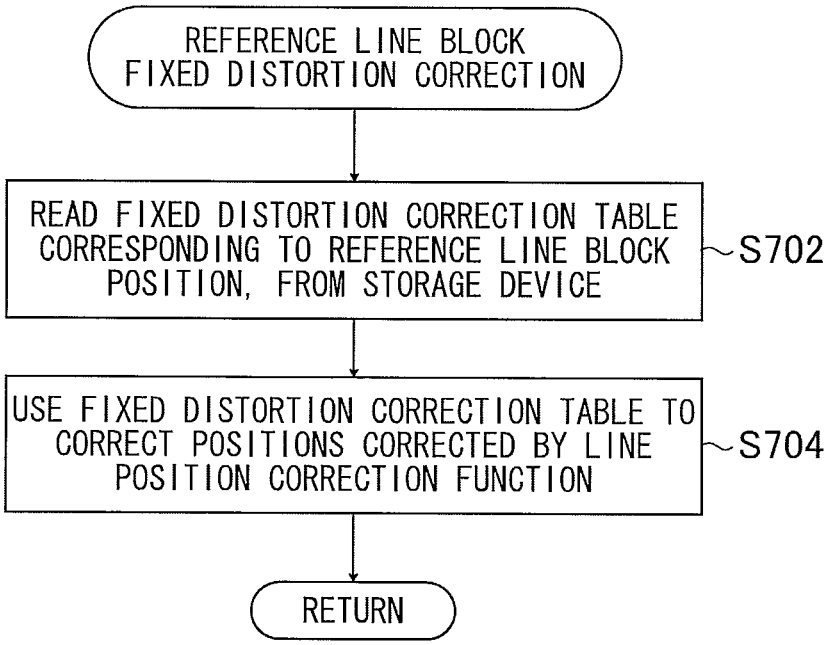
FIG. 42 is a flowchart of reference line block fixed distortion correction processing.

FIG. 42 is a flowchart of the reference line block fixed distortion correction processing. When the reference line block fixed distortion correction flow in FIG. 42 is started, firstly, the fixed distortion correction table corresponding to the reference line block position is read out from the storage device (step S702).

Thereupon, the positions which have been corrected by the line block position correction processing (step S60 in FIG. 17) are further corrected by using the fixed distortion correction table that has been thus read out (step S704 in FIG. 42). The dot positions thus determined are X coordinates after correction using the fixed position correction table corresponding to the reference line block.

When the processing in step S704 in FIG. 42 has been completed, then the post-processing in which consolidation of the line blocks has been carried out (step S70 in FIG. 17) ends.

Operating Effects of Embodiments

In this embodiment, the direction of the dot deposition positions on the test pattern to be measured is the same as the main scanning direction of the scanner (FIG. 14), and the reading is performed by lowering the scanner reading resolution in the sub-scanning direction with respect to that of the main scanning direction (FIG. 15). This allows even commercially available scanners to read a whole A3 page in one pass and allows the measurement time to be shortened.

The amount of read image data is approximately 257 MB (at 2400 DPI for the main scanning and 200 DPI for the sub-scanning) and therefore small. This leads to a valuable reduction in the data processing time and prevents the computer performance required for this processing from increasing. Hence, the highly accurate dot position measurement which is aimed at can be implemented at relatively low cost.

In the embodiments, an average profile image, obtained by performing a partial averaging in terms of the line longitudinal direction (the sub-scanning direction of the scanner) when determining a line position in a read image, is formed, and this average profile image is subjected to a filter process. Scattering of ink (satellite droplets) and the contrast of dirt are relatively lowered due to the aforementioned reading at a low resolution in the sub-scanning direction, the averaging, and the filtering process. As a result, there is no requirement for a special method of removing dirt.

The averaging processing simultaneously reduces the adverse effect of irregular noise in the averaging direction, which has the effect of increasing the reliability of tone values and improving the accuracy of the algorithm for determining the position based on these tone values. The filtering process also reduces irregular noise components and sampling distortion, thereby smoothing the profile image and improving reliability in terms of the line position.

As a result of the processing (W/B correction processing) to correct tone values, in an average profile image, on the basis of the white background close to each line and the ink density, distortion of the profile image, caused by the effects of scanner flare or disruption of the recording paper, is corrected, together with reducing the shading of the scanner in the main scanning direction. Positional accuracy based on tone values can be improved by correcting the tone values in this way.

With the embodiments, a line position is calculated by using a plurality of average profile images with regions (ROI) for calculating the average profile displaced from one another by a fixed amount in a line longitudinal direction, and the plurality of line positions obtained are averaged. This processing adjusts the relative positional relationship (so-called sampling phase) between the read lines and scanner reading elements, thereby improving the line position accuracy still further.

In the embodiments, the reference line block is arranged including a line formed by the nozzles in substantially equal fashion in respect of each of the plurality of line blocks on the line pattern to be measured (FIG. 7). With this reference line block used as a reference position, a measurement position for each line block is corrected, thereby reducing influence of disturbance of a reading image grid caused by the variation in the scanner carriage. Moreover, in use of such a correction method, measurement that renders the reduction of the influence of paper deformation can be achieved.

Figure 43:
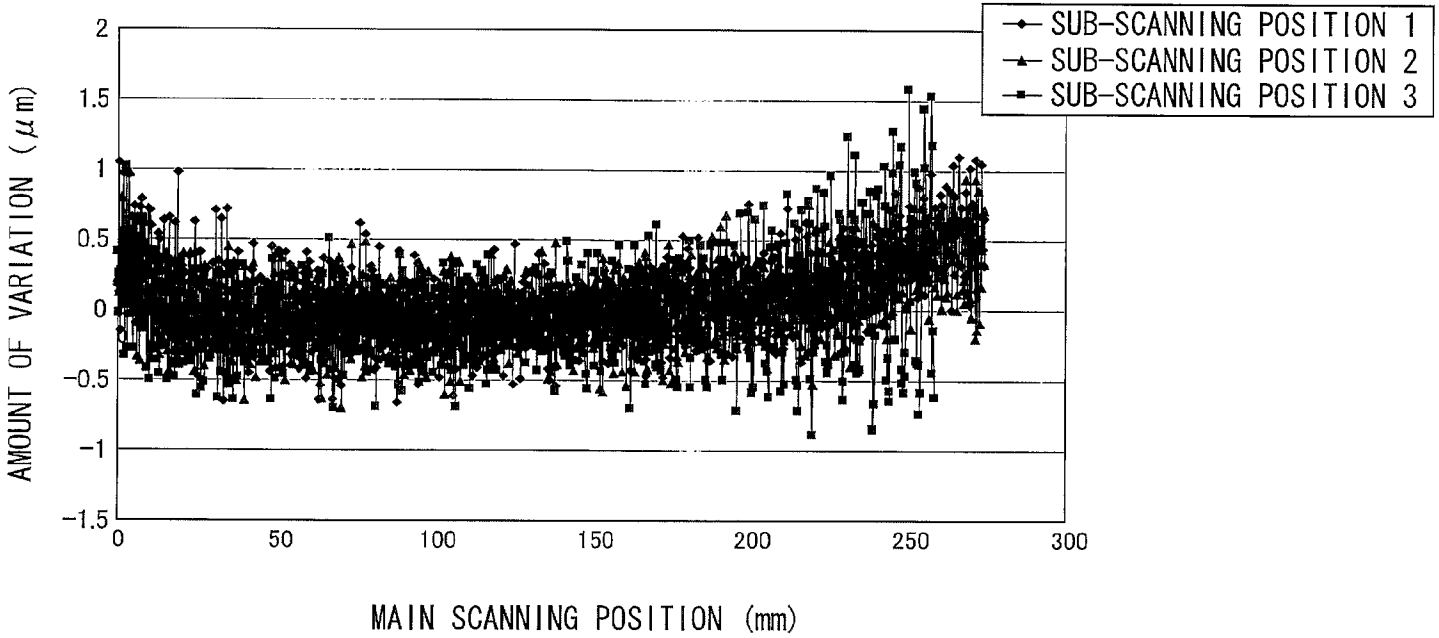
FIG. 43 is a graph showing the variation in distortion in the main scanning direction for each scan.

FIG. 43 is a graph showing the variation in distortion in the main scanning direction for each scan. In the example shown in FIG. 43, the tendency of the variation in distortion in the main scanning direction varies with the sub-scanning position 1, 2, 3. In this way, the tendency of the variation of distortion in the main scanning direction may show great local variation only in the vicinity of the right end portion, as in the sub-scanning position 3 in FIG. 43, in each scan.

It is conceivable to determine and correct dot positions based on the premise that positions recorded by the same recording element (hereinafter, called "common nozzle") will be matching. In this case, if local variation (variation of distortion in the main scanning direction) occurs in the scanner picture, and if the range (region) where this picture variation occurs includes a drawing region of the same recording element, then a problem arises in that measurement accuracy declines. More specifically, this problem is particularly marked in a case where other measurement values are corrected with reference to the data in a block including a common nozzle, and where picture variation occurs locally in a position including the common nozzle which is a reference.

In cases such as that described above where picture variation is included in the measurement object region of the scanner, and a position where there is great variation in the distortion in the main scanning direction is situated inside a block including the common nozzle, then the measurement data which is used as a reference to correct the other measurement values contains non-linear distortion, and hence there is a problem of severe decline in the overall measurement accuracy achieved by the scanner.

The position (line position) of each line pattern specified on the basis of the image read by the scanner is taken as Pi=(xi, yi). Here, i is the recording element number, the X direction is the alignment direction of the lines in the measurement sample and the main scanning direction of the scanner, and the Y direction is the alignment direction of the line blocks in the measurement sample and the sub-scanning direction of the scanner. The actual numerical value of the line position Pi=(xi, yi) is the scanner reading coordinates (μm).

The line position Pi=(xi, yi) includes errors Es(x, y), Esr(y) and Ep(y) in the X-direction measurement value. In other words, if the true value of the X coordinate xi of the measurement value of a line position is <xi>, then the measurement value xi is expressed by the Expression (12) below.

$$xi=\langle xi\rangle+Es(xi,y)+Esr(y)+Ep(y) \tag{12}$$

Here, Es(xi, y) is a fixed part of the distortion in the main scanning direction of the scanner which is dependent on the sub-scanning position of the scanner, Esr(y) is a random variation part in distortion in the main scanning direction position of the scanner, and Ep(y) is a random variation part in the recording position which is associated with the recording element and occurs each time an image is recorded. Es(xi, y) has a small amount of variation (high correlation) in an approximation, but may be a significant component in the main scanning direction as a whole. Furthermore, since Esr (y) and Ep(y) are random variations, then the amount of variation does not change with the location.

If other measurement positions are corrected on the basis of the measurement position of a recording element selected as a common nozzle, and if the random variation components in the measurement value xi, such as Esr(y) and Ep(y), are sufficiently large so that they cannot be ignored, then there is a possibility that the measurement accuracy declines overall since the error of the common nozzle has a great effect on the other measurement line blocks.

In response to this, in the present embodiment, a plurality of reference line blocks including a common nozzle are provided (in this embodiment, LCB, LCBb in FIG. 30, etc.) in order to improve the accuracy of the measurement position corresponding to the common nozzle.

If x@LC is taken to be the measurement position (X coordinate) of a recording element i in the line block Lc, then the measurement position xi@Lc of the line block Lc corresponding to the recording element i and the adjacent measurement positions $x_{i-k}$@Lc and $x_{i+k}$@Lc are expressed by Expressions (13-1) to (13-3) below.

$$x_i@Lc=\langle Xi\rangle+Es(x_i@Lc,y@Lc)+Esr(y@Lc)+Ep(y@Lc) \tag{13-1}$$

$$x_{i-k}@Lc=\langle Xi-k\rangle+Es(x_{i-k}@Lc,y@Lc)+Esr(y@Lc)+Ep(y@Lc) \tag{13-2}$$

$$x_{i+k}@Lc=\langle Xi+k\rangle+Es(x_{i+k}@Lc,y@Lc)+Esr(y@Lc)+Ep(y@Lc) \tag{13-3}$$

The average value of these three measurement positions (the characteristic value of the reference line) XAve_i@Lc is expressed by Expression (14) below.

$$\begin{aligned}\text{XAve_i@}Lc &= (x_i@Lc + x_{i-k}@Lc + x_{i+k}@Lc)/3 \\ &= (\langle Xi\rangle + \langle Xi-k\rangle + \langle Xi+k\rangle)/3 + \\ &\quad (Es(x_i@Lc,\ y@Lc) + Es(x_{i-k}@Lc,\ y@Lc) + \\ &\quad Es(x_{i+k}@Lc,\ y@Lc))/3 + \{Esr(y@Lc) + \\ &\quad Ep(y@Lc) + Esr(y@Lc) + Ep(y@Lc) + \\ &\quad Esr(y@Lc) + Ep(y@Lc)\}/3\end{aligned} \tag{14}$$

Similarly, the average value in the line block Lcb is expressed by Expression (15) below.

$$\begin{aligned}\text{XAve_i@}Lcb &= (x_i@Lcb + x_{i-k}@Lcb + x_{i+k}@Lcb)/3 \\ &= (\langle Xi\rangle + \langle Xi-k\rangle + \langle Xi+k\rangle)/3 + \\ &\quad \{Es(x_i@Lc,\ y@Lcb) + Es(x_{i-k}@Lc,\ y@Lcb) + \\ &\quad Es(x_{i+k}@Lc,\ y@Lcb)\}/3 + \{Esr(y@Lcb) + \\ &\quad Ep(y@Lcb) + Esr(y@Lcb) + Ep(y@Lcb) + \\ &\quad Esr(y@Lcb) + Ep(y@Lcb)\}/3\end{aligned} \tag{15}$$

In this case, {(<Xi>+<Xi−k>+<Xi+k>)/3+(Es($x_i$@Lc, y@Lc)+Es($x_{i-k}$@Lc, y@Lc)+Es($x_{i+k}$@Lc, y@Lc))}/3 is a main scanning distortion component of the scanner corresponding to the line block Lc. Furthermore, (<Xi>+<Xi−k>+<Xi+k>)/3+{Es($x_i$@Lc, y@Lcb)+Es($x_{i-k}$@Lc, y@Lcb)+Es($x_{i+k}$@Lc, y@Lcb)}/3 is, similarly, a main scanning distortion component of the scanner corresponding to the line block Lcb.

{Esr(y@Lc)+Ep(y@Lc)+Esr(y@Lc)+Ep(y@Lc)+Esr(y@Lc)+Ep(y@Lc)}/3 is a random characteristic and therefore the random error component σ of the original measurement value is reduced to 1/√3.

{Esr(y@Lcb)+Ep(y@Lcb)+Esr(y@Lcb)+Ep(y@Lcb)+Esr(y@Lcb)+Ep(y@Lcb)}/3 is also a random characteristic and therefore the random error component σ of the original measurement value is reduced to 1/√3.

Consequently, between the line blocks Lc and Lcb, by correcting each measurement value $x_i$@Lcb of Lcb on the basis of XAve_i@Lcb which corresponds to XAve_i@Lc, it is possible to reduce the effects of random variation and to correct the main scanning fixed distortion component Es ($x_i$@Lc, y@Lcb). Here, Es($x_i$@Lc, y@Lcb), Es($x_{i-k}$@Lc, y@Lcb) and Es($x_{i+k}$@Lc, y@Lcb) have almost equal values.

Next, if a measurement value obtained by correcting a measurement value of the line block Lcb according to the line block Lc is taken as $x_i$@Lcb(Lc), then the following Expression (16) is satisfied.

$$x_i@Lcb(Lc)=\langle Xi\rangle+Es(x_i@Lc,y@Lc)+Esr(y@Lcb)+Ep(y@Lcb) \tag{16}$$

If the average value (the statistical measurement position) of the corrected measurement values and the measurement values of the line block Lc is calculated, then the following Expression is satisfied.

$$\begin{aligned}\text{XAve_i} &= \{x_i@Lc + x_i@Lcb(Lc)\}/2 \\ &= (\langle Xi\rangle) + (Es(x_i@Lc,\ y@Lc)) + \\ &\quad \{Esr(y@Lc) + Ep(y@Lc) + Esr(y@Lcb) + \\ &\quad Ep(y@Lcb)\}/2\end{aligned}$$

{Esr(y@Lc)+Ep(y@Lc)+Esr(y@Lcb)+Ep(y@Lcb)}/2 is a random characteristic and therefore the random error component σ of the original measurement value is reduced to 1/√2.

In the foregoing example, there are three adjacent recording elements and two common line blocks (reference line blocks), but if the number of adjacent recording elements is M and the number of common line blocks (reference line blocks) is N, then it is possible to achieve measurement calculation processing of higher accuracy by setting M and N to large numbers.

Example of Composition of Dot Position Measurement Apparatus

Next, an example of the composition of a dot position measurement apparatus which uses the dot position measurement method described above will be explained. A program (dot position measurement processing program) is created which causes a computer to execute the image analysis processing algorithm used in the dot position measurement according to the present embodiment, and by running a computer on the basis of this program, it is possible to cause the computer to function as a calculating apparatus for the dot position measurement apparatus.

Figure 44:
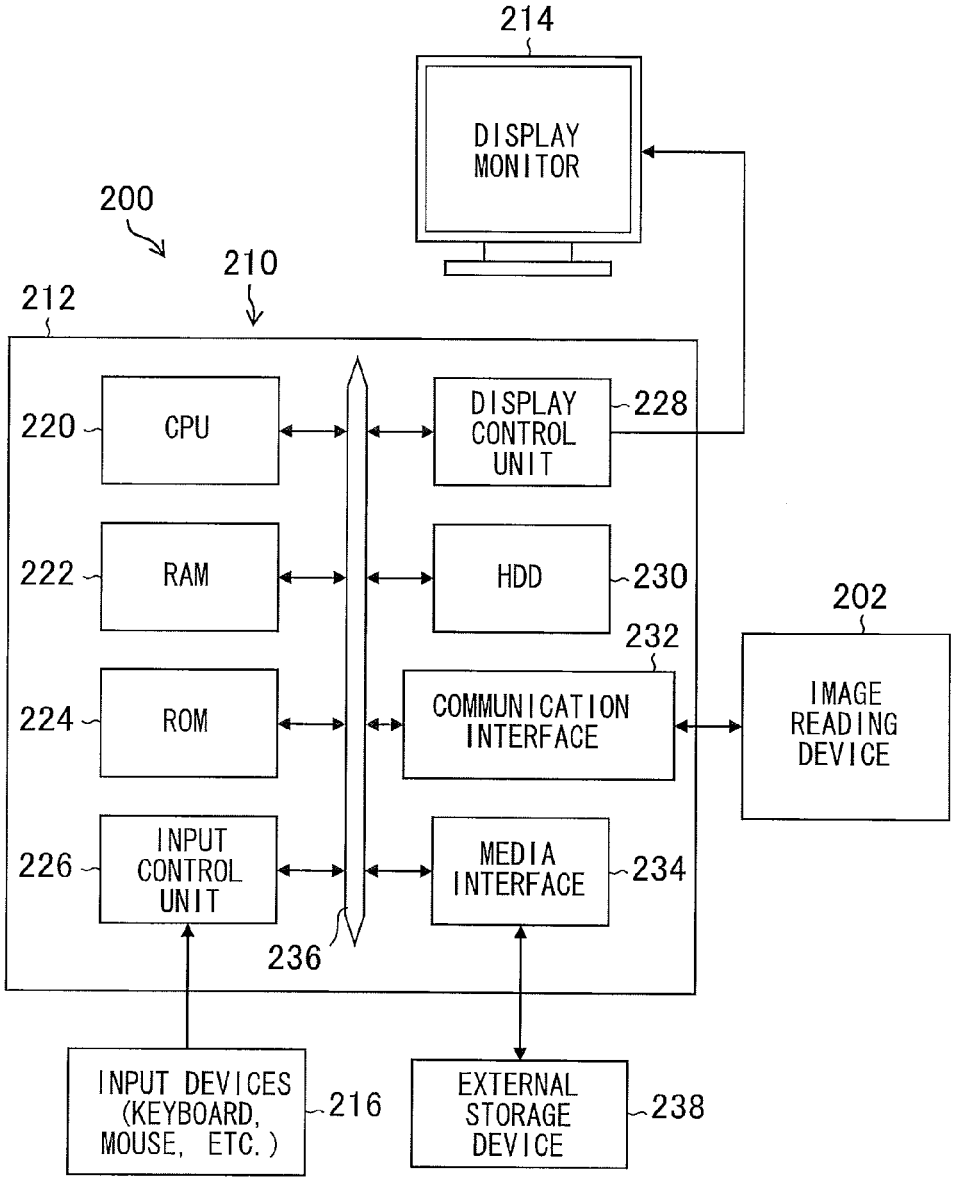
FIG. 44 is a block diagram illustrating an example of the composition of a dot position measurement apparatus.
Figure 45:
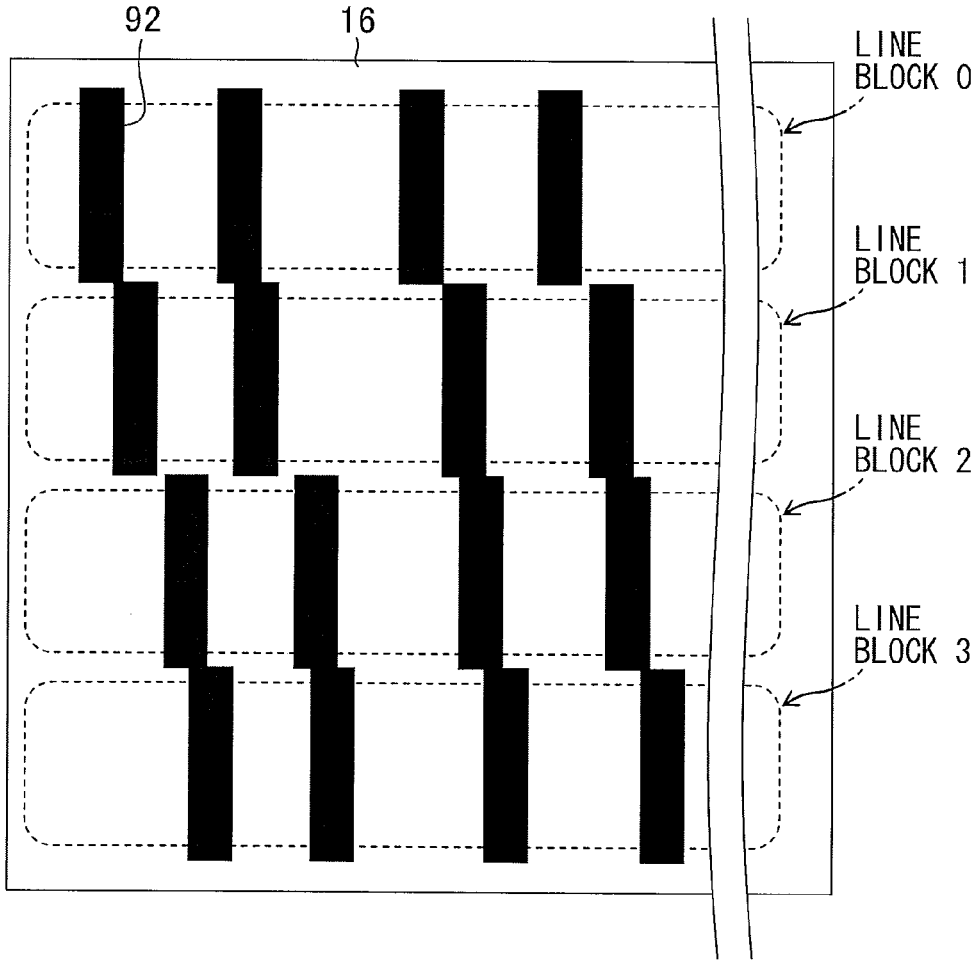
FIG.45 RELATED ART
FIG. 45 is a diagram showing an example of a line pattern for dot position measurement in the related art.
Figure 46:
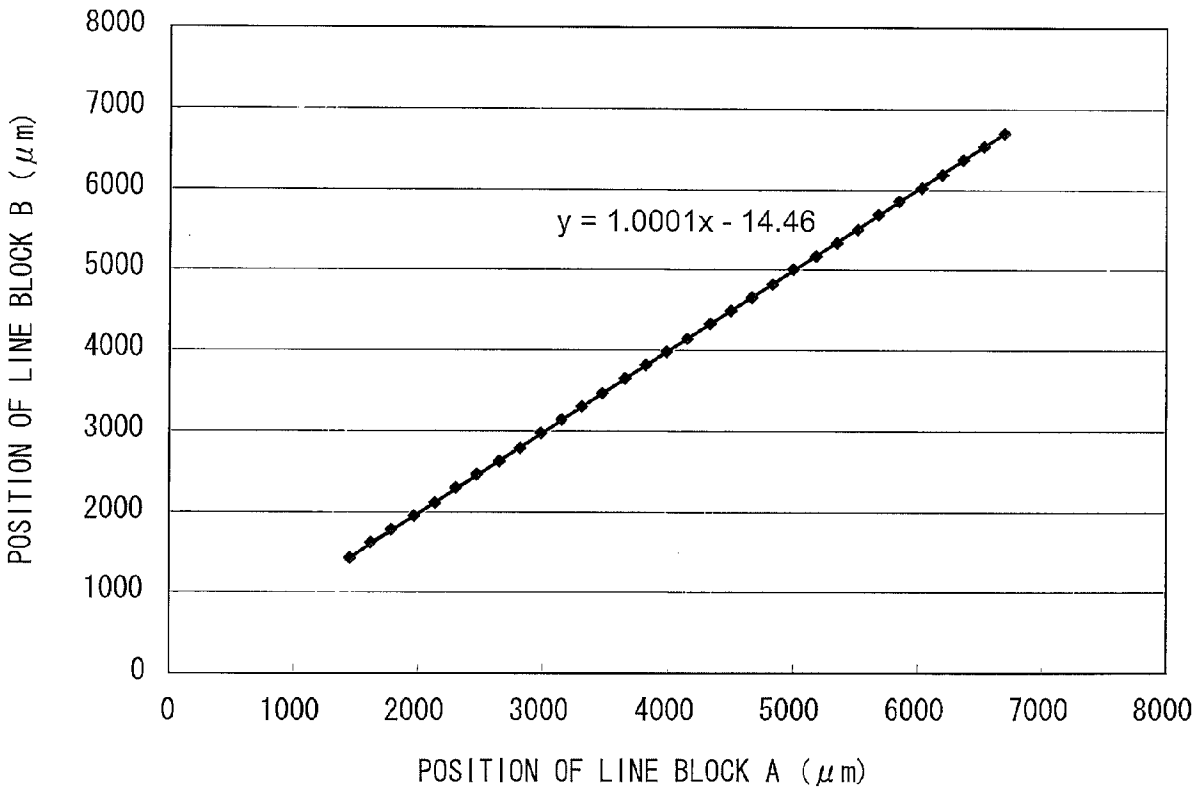
FIG.46 RELATED ART
FIG. 46 is a graph showing positional variation depending on the sub-scanning position of the scanner in the related art.

FIG. 44 is a block diagram illustrating an example of the composition of the dot position measurement apparatus.

The dot position measurement apparatus 200 illustrated in FIG. 44 includes: a flatbed scanner, which forms an image reading apparatus 202; and a computer 210, which performs calculations for image analysis, and the like.

The image reading apparatus 202 is provided with an RGB line sensor, which images the line patterns for measurement, and also includes a scanning mechanism, which moves the line sensor in the reading scanning direction (the scanner sub-scanning direction in FIG. 14), a drive circuit of the line sensor, and a signal processing circuit, which converts the output signal from the sensor (image capture signal), from analog to digital, in order to obtain a digital image data of a prescribed format, and so on.

The computer 210 includes a main body 212, a display (display device) 214, and an input device 216, such as a keyboard and mouse (input devices for inputting various commands). The main body 212 houses a central processing unit (CPU) 220, a RAM 222, a ROM 224, an input control unit 226, which controls the input of signals from the input device 216, a display control unit 228, which outputs display signals to the display 214, a hard disk device 230, a communication interface 232, a media interface 234, and the like, and these respective circuits are mutually connected by means of a bus 236.

The CPU 220 functions as a general control apparatus and computing apparatus (computing device). The RAM 222 is used as a temporary data storage region, and as a work area during execution of the program by the CPU 220. The ROM 224 is a rewriteable non-volatile storage device which stores a boot program for operating the CPU 220, various settings values and network connection information, and the like. An operating system (OS) and various applicational software programs and data, and the like, are stored in the hard disk apparatus 230.

The communication interface 232 is a device for connecting to an external device or communication network, on the basis of a prescribed communications system, such as USB (Universal Serial Bus), LAN, Bluetooth (registered trademark), or the like. The media interface 234 is a device which controls the reading and writing of an external storage device 238, which is typically a memory card, a magnetic disk, a magneto-optical disk, or an optical disk.

In the present embodiment, the image reading apparatus 202 and the computer 210 are connected through the communication interface 232, and the data of a captured image which is read in by the image reading apparatus 202 is input to the computer 210. A composition can be adopted in which the data of the captured image acquired by the image reading apparatus 202 is stored temporarily in the external storage device 238, and the captured image data is input to the computer 210 via this external storage device 238.

The image analysis processing program used in the method of measuring the dot positions according to an embodiment of the present invention is stored in the hard disk device 230 or the external storage device 238, and the program is read out, developed in the RAM 222 and executed, according to requirements. Alternatively, it is also possible to adopt a mode in which a program is supplied by a server situated on a network (not illustrated) which is connected via the communications interface 232, or a mode in which a computation processing service based on the program is supplied by a server based on the Internet.

The operator is able to input various initial values, by operating the input device 216 while observing the application window (not illustrated) displayed on the display monitor 214, as well as being able to confirm the calculation results on the monitor 214.

Furthermore, the data resulting from the calculation operations (measurement results) can be stored in the external storage device 238 or output externally via the communications interface 232. The information resulting from the measurement process is input to the inkjet recording apparatus through the communication interface 232 or the external storage device 238.

Modified Embodiment 1

A composition in which the functions of the dot position measurement apparatus 200 illustrated in FIG. 44 are incorporated in the inkjet recording apparatus is also possible. An embodiment in which a series of operations such as printing and then reading a measurement line pattern, and then performing dot position measurement by analyzing the image are carried out continuously by a control program of the inkjet recording apparatus, is also possible.

For example, a line sensor (print detection unit) for reading a print result may be provided downstream of the print unit 12 in the inkjet recording apparatus 10 illustrated in FIG. 1, and a measurement line pattern can be read with the line sensor.

Modified Embodiment 2

In the respective embodiments described above, an inkjet recording apparatus using a page-wide full line type head having a nozzle row of a length corresponding to the entire width of the recording medium has been described, but the scope of application of the present invention is not limited to this, and the present invention may also be applied to an inkjet recording apparatus which performs image recording by means of a plurality of head scanning actions which move a short recording head, such as a serial head (shuttle scanning head), or the like.

Modified Embodiment 3

In FIG. 1, the belt conveyance method is used as the conveyance device for the recording medium (recording paper 16), but in implementing the present invention, the conveyance device of the recording medium is not limited to the belt conveyance method and various other modes, such as a drum conveyance method or nip conveyance method, may be adopted.

Modified Embodiment 4

In the foregoing description, the inkjet recording apparatus has been described as one example of the image forming apparatus having the recording head, but the scope of application of the present invention is not limited to this. It is also possible to apply the present invention to image forming apparatuses employing various types dot recording methods, apart from an inkjet apparatus, such as a thermal transfer recording apparatus equipped with a recording head which uses thermal elements (heaters) are recording elements, an LED electrophotographic printer equipped with a recording head having LED elements as recording elements, or a silver halide photographic printer having an LED line type exposure head, or the like.

Furthermore, the meaning of the term "image forming apparatus" is not restricted to a so-called graphic printing application for printing photographic prints or posters, but rather also encompasses industrial apparatuses which are able to form patterns that may be perceived as images, such as resist printing apparatuses, wire printing apparatuses for electronic circuit substrates, ultra-fine structure forming apparatuses, etc., which use inkjet technology.

In other words, the present invention can be applied broadly, as a dot deposition (landing) position measurement technology, to various apparatuses (coating apparatus, spreading apparatus, application apparatus, line drawing apparatus, wiring drawing apparatus, fine structure forming apparatus, and so on) that eject a functional liquid or various other liquids toward a liquid receiving medium (recording medium) by using a liquid ejection head that functions as a recording head.

The technical idea of the present invention—the measurement positions of lines included in a common line block (reference line block) being corrected on the basis of reference line position characteristic values, and the statistical processing (averaging) being carried out—can also be applied to line blocks other than the reference line blocks. In other words, the same patterns corresponding to the line blocks respectively are created for the line blocks 0, 1, 2, 3 in FIG. 30, and taken as line block 0*b*, line block 1*b*, line block 2*b* and line block 3*b* respectively. It is possible that the accuracy of the measurement position of each line can be raised by averaging the measurement positions of the lines in respect of the line blocks 0 and 0*b*, 1 and 1*b*, and so on, and then the correction can be carried out in respect of nozzle numbers which match the common line block.

The dot position measurement method relating to the present embodiment can be realized also as a computer program which causes the system controller 64 and the print controller 78, or the dot position measurement apparatus 200 of the inkjet recording apparatus 10 to execute the processing described above, or as a recording medium or program product on which this computer program is recorded.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A dot position measurement method, comprising:

a line pattern forming step of forming a measurement line pattern including a plurality of lines of rows of dots corresponding to a plurality of recording elements arranged in a first direction of a recording head respectively, on a recording medium, while causing relative movement between the recording head and the recording medium in a second direction perpendicular to the first direction, the measurement line pattern including a plurality of line blocks respectively including a group of the lines recorded by the recording elements spaced at a prescribed interval in the first direction, and a plurality of common line blocks respectively including the lines recorded by the recording elements which are same as the recording elements recording the lines included in the plurality of line blocks respectively;

a reading step of reading an image of the measurement line pattern formed on the recording medium in the line pattern forming step, by an image reading apparatus;

a line position measurement step of measuring positions of the lines included in the plurality of line blocks and the plurality of common line blocks, from the image of the measurement line pattern read by the image reading apparatus;

an averaging step of determining average values with respect to the recording elements, each of the average values being an average value of measurement values of positions of the lines recorded by a same one of the recording elements and included in a same one of the plurality of common line blocks; and a line position correction step of correcting the measurement values of the positions of the lines according to the average values.

2. The dot position measurement method as defined in claim 1, further comprising:

a characteristic value calculation step of calculating a characteristic value obtained by averaging the measurement values of the position of a second line recorded by a second recording element which is adjacent to a first recording element used to record a first line which is included in each of the plurality of common line blocks; and a step of line position correction within a common line block, the step correcting the measurement values of the position of the first line according to the characteristic value, wherein, in the averaging step, the average values of the measurement values which have been corrected in the step of line position correction within common line block are determined.

3. The dot position measurement method as defined in claim 1, further comprising a distortion correction step of correcting distortion in terms of a main scanning direction of a fixed positional of the image read by the image reading apparatus.

4. The dot position measurement method as defined in claim 3, further comprising:

a positional distortion correction function specification step of specifying a positional distortion correction function for the image reading apparatus according to the measurement values of the positions of the lines which have been corrected in the line position correction step; and a positional distortion correction step of further correcting the measurement values of the positions of lines which have been corrected in the line position correction step, according to the specified positional distortion correction function.

5. The dot position measurement method as defined in claim 3, wherein:

a fixed positional distortion correction table for correcting positional distortion characteristics of the image reading apparatus is created in advance;

the dot position measurement method further comprises a fixed positional distortion correction step of further correcting the measurement values of the positions of the lines which have been corrected in the line position correction step according to the fixed positional distortion correction table, or correcting data of the positions of the lines before correction in the line position correction step according to the fixed positional distortion correction table.

6. A dot position measurement apparatus comprising:

an image reading apparatus reading an image of a measurement line pattern including a plurality of lines of rows of dots which are formed on a recording medium by an image forming apparatus and which corresponds to respective recording elements of a recording head arranged in a first direction while relative movement between the recording head and the recording medium is caused in a second direction perpendicular to the first direction, the measurement line pattern including a plurality of line blocks respectively including a group of the lines recorded by the recording elements spaced at a prescribed interval in the first direction, and a plurality of common line blocks respectively including the lines recorded by the recording elements which are same as the recording elements recording the lines included in the plurality of line blocks respectively;

a line position measurement device which measures positions of the lines included in the plurality of line blocks and the plurality of common line blocks, from the image of the measurement line pattern read by the image reading apparatus;

an averaging device which determines average values with respect to the recording elements, each of the average values being an average value of measurement values of positions of the lines recorded by a same one of the recording elements and included in a same one of the plurality of common line blocks; and a line position correction device which corrects the measurement values of the positions of the lines according to the average values.

7. The dot position measurement apparatus as defined in claim 6, further comprising:

a characteristic value calculation device which calculates a characteristic value obtained by averaging the measurement values of the position of a second line recorded by a second recording element which is adjacent to a first recording element used to record a first line which is included in each of the plurality of common line blocks; and a correction device of a line position within a common line block, the correction device correcting the measurement values of the position of the first line according to the characteristic value, wherein the averaging device determines the average values of the measurement values which have been corrected by the correction device of a line position within a common line block.

8. The dot position measurement apparatus as defined in claim 6, further comprising a distortion correction device which corrects distortion in terms of a main scanning direction of a fixed positional of an image read by the image reading apparatus.

9. The dot position measurement apparatus as defined in claim 8, further comprising:

a positional distortion correction function specification device which specifies a positional distortion correction function for the image reading apparatus according to the measurement values of the positions of the lines which have been corrected by the line position correction device; and a positional distortion correction device which further corrects the measurement values of the positions of the lines which have been corrected by the line position correction device, according to the specified positional distortion correction function.

10. The dot position measurement apparatus as defined in claim 8, wherein:

a fixed positional distortion correction table for correcting positional distortion characteristics of the image reading apparatus is created in advance;

the dot position measurement apparatus further comprises a fixed positional distortion correction device which further corrects the measurement values of the positions of the lines which have been corrected by the line position correction device according to the fixed positional distortion correction table, or correcting data of the positions of the lines before correction by the line position correction device according to the fixed positional distortion correction table.

* * * * *